US007694966B2

(12) United States Patent
Nagasako et al.

(10) Patent No.: US 7,694,966 B2
(45) Date of Patent: Apr. 13, 2010

(54) SHEET PROCESSING APPARATUS AND IMAGE FORMING APPARATUS

(75) Inventors: Shuuya Nagasako, Kanagawa (JP); Masahiro Tamura, Tokyo (JP); Nobuyoshi Suzuki, Tokyo (JP); Kazuhiro Kobayashi, Kanagawa (JP); Shohichi Satoh, Kanagawa (JP); Akira Kunieda, Tokyo (JP); Hiroshi Maeda, Aichi (JP); Tomoichi Nomura, Aichi (JP); Hitoshi Hattori, Tokyo (JP); Makoto Hidaka, Tokyo (JP); Ichiro Ichihashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 196 days.

(21) Appl. No.: 11/727,949

(22) Filed: Mar. 29, 2007

(65) Prior Publication Data

US 2007/0235917 A1 Oct. 11, 2007

(30) Foreign Application Priority Data

| | | | |
|---|---|---|---|
| Apr. 10, 2006 | (JP) | ..... | 2006-107581 |
| May 26, 2006 | (JP) | ..... | 2006-146980 |
| Jul. 7, 2006 | (JP) | ..... | 2006-188161 |
| Jan. 26, 2007 | (JP) | ..... | 2007-016565 |

(51) Int. Cl.
*B65H 39/10* (2006.01)

(52) U.S. Cl. ..... 271/303; 270/58.06; 270/58.11; 270/58.13

(58) Field of Classification Search ..... 271/303, 271/207; 270/37, 45, 58.08, 58.11, 58.13
See application file for complete search history.

(56) References Cited

U.S. PATENT DOCUMENTS 6,957,810 B2 10/2005 Yamada et al.

(Continued)

FOREIGN PATENT DOCUMENTS

EP 1 568 636 8/2005

(Continued)

OTHER PUBLICATIONS

Office Action dated Jun. 26, 2009 for corresponding Chinese Application No. 2007100963201 and English translation thereof.

*Primary Examiner*—David H Bollinger
(74) *Attorney, Agent, or Firm*—Harness, Dickey & Pierce, P.L.C.

(57) ABSTRACT

A sheet processing apparatus includes a first processing unit, a second processing unit, a roller, a guide member, and a conveying unit. The first processing unit applies first processing to a recording medium. The second processing unit applies second processing to the recording medium. The roller has a conveying path to convey the recording medium from the first processing unit to the second processing unit along the outer circumference. The guide member guides the recording medium to the conveying path to lead the recording medium to the second processing unit. The conveying unit applies a conveying force to a stack of recording media at an upstream of the guide member in a recording-medium conveying direction.

18 Claims, 41 Drawing Sheets

U.S. PATENT DOCUMENTS

| | | | | |
|---|---|---|---|---|
| 6,988,729 | B2 | 1/2006 | Tamura et al. | |
| 7,134,654 | B2 | 11/2006 | Yamada et al. | |
| 7,137,625 | B2 * | 11/2006 | Yamada et al. | 270/58.07 |
| 7,331,572 | B2 * | 2/2008 | Yamada et al. | 270/37 |
| 2005/0067777 | A1 | 3/2005 | Ilda et al. | |
| 2005/0225021 | A1 * | 10/2005 | Yamada et al. | 270/37 |
| 2007/0029716 | A1 | 2/2007 | Yamada et al. | |

FOREIGN PATENT DOCUMENTS

| | | |
|---|---|---|
| JP | 10-059610 | 3/1998 |
| JP | 11-199118 | 7/1999 |
| JP | 2000-211795 | 8/2000 |
| JP | 2000-344414 | 12/2000 |
| JP | 2003-095506 | 4/2003 |
| JP | 2003-155155 | 5/2003 |
| JP | 2004-115197 | 4/2004 |
| JP | 2004-292163 | 10/2004 |

* cited by examiner

| FIG. 26AA |
| --- |
| FIG. 26AB |

| FIG. 26BA |
| --- |
| FIG. 26BB |

| FIG. 48AA |
| --- |
| FIG. 48AB |

| FIG. 48CA |
| --- |
| FIG. 48CB |

SHEET PROCESSING APPARATUS AND IMAGE FORMING APPARATUS

CROSS-REFERENCE TO RELATED APPLICATIONS

The present document incorporates by reference the entire contents of Japanese priority documents, 2007-016565 filed in Japan on Jan. 26, 2007, 2006-146980 filed in Japan on May 26, 2006, 2006-107581 filed in Japan on Apr. 10, 2006 and 2006-188161 filed in Japan on Jul. 7, 2006.

BACKGROUND OF THE INVENTION

1. Field of the Invention

The present invention relates to a sheet processing apparatus and an image forming apparatus.

2. Description of the Related Art

As a technique concerning the sheet processing apparatus, for example, Japanese Patent Application Laid-Open No. 2003-95506 discloses a technology relating to a sheet processing apparatus that applies predetermined processing to a sheet-like recording medium (sheet). The sheet processing apparatus includes a staple processing tray that applies alignment and staple processing to a sheet stack, a conveying path that directly discharges the sheet stack subjected to the alignment and staple processing by the staple processing tray, upper and lower stack conveying guides that convey the sheet stack to the side of a folding plate that performs center folding, and a branch guide plate and a movable guide plate that switch a path for conveyance of the sheet stack to the conveying path and the upper and lower stack conveying guides. When the branch guide plate and the movable guide plate switch the path for conveyance of the sheet stack to the upper and lower stack conveying guides, the branch guide plate and the movable guide plate deflect the sheet stack along the outer periphery of a discharging roller located on a most downstream side of the staple processing tray to guide the sheet stack to the upper and lower stack conveying guides.

Japanese Patent Application Laid-Open No. 2003-155155 discloses a technology relating to another sheet processing apparatus that applies predetermined processing to sheets conveyed thereto. The sheet processing apparatus includes a staple processing tray that applies alignment and staple processing to a sheet stack, a conveying path for directly discharges the sheet stack subjected to the alignment and staple processing by the staple processing tray, upper and lower stack conveying guides that convey the sheet stack to the side of a folding plate that performs center folding processing, and a branch guide plate and a movable guide plate that switch a path for conveying the sheet stack to the conveying path and the upper and lower stack conveying guides. The branch guide plate and the movable guide plate are set in any one of a first position for conveying the sheet stack to the conveying path, a second position for conveying the sheet stack to the folding plate side, and a third position in the middle of the first position and the second position. It is possible to perform deflection of the sheet stack more surely by providing the third position.

In a technology disclosed in Japanese Patent Application Laid-Open No. 2000-211795, an end in a direction orthogonal to a sheet conveying direction is aligned by a jogger fence and a trailing end in the sheet conveying direction is aligned by a trailing end fence. A discharging pawl that pushes up a sheet stack on a staple tray and discharges the sheet stack is moved in a counter-discharge direction to bring a rear side of the discharging pawl into contact with a leading end of the sheet stack and perform an operation for aligning the sheet stack.

In a technology disclosed in Japanese Patent Application Laid-Open No. H11-199118, a sheet is received until a leading end of the sheet exceeds a downstream side end according to operation control by a control device in a separated state of a stack discharging roller pair including an upper stack discharging roller and a lower stack discharging roller. The upper stack discharging roller is brought into contact the lower stack discharging roller to hold the received sheet between the stack discharging roller pair. The lower stack discharging roller is reversely rotated to pull back the sheet to an upstream side. The upper stack discharging roller is separated from the lower stack discharging roller in a position where a center of gravity portion of the sheet passes a downstream side end. After the processing is finished, a sheet stack is discharged onto second stacking tray means. In this way, a pull-back action for the sheet-like recording medium during aligning operation is effectively performed to prevent alignment failure. In this conventional technology, when more than half of a discharged sheet is discharged to the second stacking tray, it is difficult to draw the sheet with a drawing paddle that strikes a trailing end of the sheet into contact against a trailing end stopper. Therefore, the discharged sheet is nipped by the stack discharging roller pair, which is a roller pair that discharges a stack, and conveyed in a direction opposite to a sheet conveying direction, and more than half of the sheet is pulled back onto the first stacking tray to strike the trailing end of the sheet against the trailing end stopper and improve an alignment state.

When center binding or folding processing is performed, after sheets are aligned in a conveying direction and a width direction by an end-binding processing unit, a sheet stack is conveyed to a center binding processing unit located downstream to align the sheets in the conveying direction and the width direction again. In that case, it is more advantageous to maintain an aligned state of the sheet stack conveyed to the center binding processing unit as much as possible to improve an alignment quality of the sheet stack after alignment processing and center binding and folding processing to be performed thereafter.

However, in the conventional sheet processing apparatuses disclosed in Japanese Patent Application Laid-Open Nos. 2003-95506 and 2003-155155, the conveying path that conveys the sheet stack from the end-binding processing unit to the center-binding processing unit is bent. When the conveying path is formed in such a shape, since a conveyance resistance applied to the sheet stack increases, a sheet jam tends to occur. Moreover, since a sheet conveyance difference occurs between an inner side and an outer side of a bent section, shift of the sheets occurs in a conveying direction.

When the center binding or folding processing is performed, after the sheets are aligned in the conveying direction and the width direction, conveying unit that applies a conveying force to the sheet stack in conveying the sheet stack to the center binding processing unit located downstream is located above an upper end-binding processing unit. Therefore, it is necessary to prevent the position, control, and the like of the conveying unit from hindering the sheet alignment in the end-binding processing unit. For example, in aligning the sheets in the end-binding processing unit, when the conveying unit located above and a leading end of the sheets entering the end-binding processing unit come into contact with each other, the entrance of the sheets is hindered if the conveying unit operates in a direction opposite to the conveying direction. Moreover, since a force in the direction opposite to the conveying direction is suddenly applied to the sheets, the sheets may be buckled. The conventional technologies disclosed in Japanese Patent Application Laid-Open Nos. 2003-95506, 2000-211795, and H11-199188 cannot cope with such a bend of the sheets.

SUMMARY OF THE INVENTION

It is an object of the present invention to at least partially solve the problems in the conventional technology.

According to an aspect of the present invention, a sheet processing apparatus includes a first processing unit that applies first processing to a recording medium, a second processing unit that applies second processing to the recording medium, a roller that has a conveying path to convey the recording medium from the first processing unit to the second processing unit along an outer circumference, a guide member that guides the recording medium to the conveying path to convey the recording medium to the second processing unit, and a conveying unit that applies a conveying force to a stack of recording media at an upstream of the guide member in a recording-medium conveying direction while holding the stack.

According to another aspect of the present invention, a sheet processing apparatus includes a processing unit that applies predetermined processing to a recording medium or a stack of recording media, and a conveying unit that is located in the processing unit and conveys the recording medium or the stack. The conveying unit stops or applies a conveying force in a conveying direction when a leading end of the recording medium or the stack passes through the conveying unit first time.

According to still another aspect of the present invention, a sheet processing apparatus includes a holding unit that temporarily holds a recording medium or a stack of recording media, a processing unit that applies predetermined processing to the recording medium or the stack, and a conveying unit that is located in the holding unit and conveys the recording medium or the stack. The conveying unit includes a swing fulcrum that defines a position of the recording medium being aligned and a position of the stack being conveyed. The swing fulcrum is arranged such that displacement of each recording medium is minimum when the conveying unit comes into contact with the stack during conveyance of the stack.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
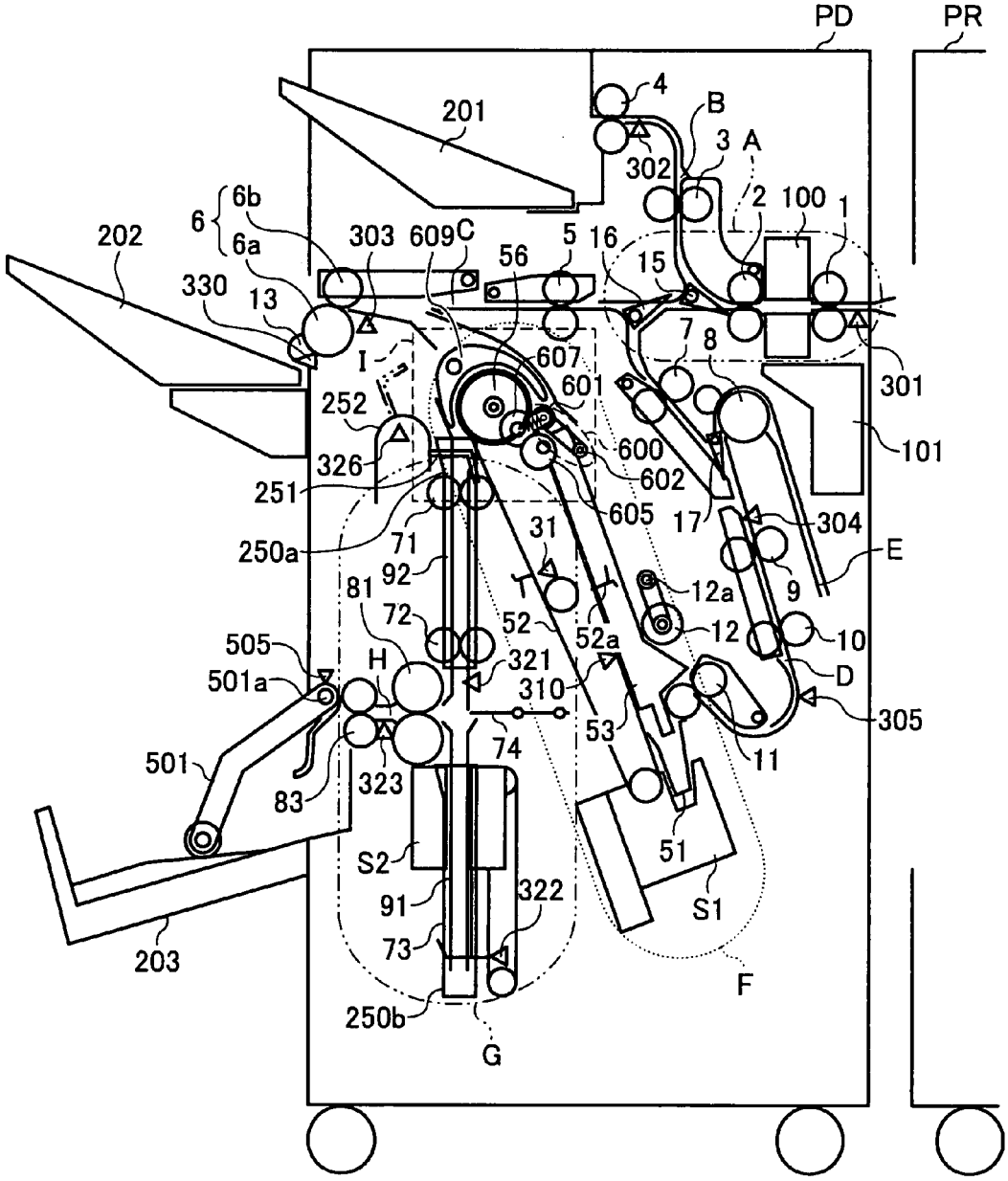
FIG. 1 is a schematic diagram of a system including a sheet processing apparatus and an image forming apparatus according to a first embodiment of the present invention.

Like reference characters refer to corresponding parts throughout the drawings, and the same explanation is not repeated. FIG. 1 is a diagram of a system including a sheet processing apparatus and an image forming apparatus according to a first embodiment of the present invention. In FIG. 1, the entire sheet processing apparatus and a part of the image forming apparatus are shown.

In FIG. 1, a sheet processing apparatus PD is attached to a side of an image forming apparatus PR. Sheet-like recording media (sheets) discharged from the image forming apparatus PR are guided to the sheet processing apparatus PD. The sheets pass through a conveying path A having a post processing unit (a punch unit 100 to punch sheets in the first embodiment), which applies post processing to each sheet, and are divided by a branch pawl 15 and a branch pawl 16 to a conveying path B that guides the sheets to an upper tray 201, a conveying path C that guides the sheets to a shift tray 202, and a conveying path D that guides the sheets to a processing tray F (also referred to as end-face-binding processing tray) that performs alignment, staple binding, and the like.

The image forming apparatus PR includes, although not shown in the drawings, at least an image processing circuit that converts inputted image data into printable image data, an optical writing device that performs optical writing in a photosensitive member based on an image signal outputted from the mage processing circuit, a developing device that toner-develops a latent image formed on the photosensitive member by the optical writing, a transferring device that transfers a toner image visualized by the developing device onto a sheet, and a fixing device that fixes the toner image transferred onto the sheet. The image forming apparatus PR delivers the sheet having the toner image fixed thereon to the sheet processing apparatus PD. Desired post processing is performed by the sheet processing apparatus PD. In the first embodiment, the image forming apparatus PR is an image forming apparatus of an electrophotographic system. However, it is possible to use all publicly-known image forming apparatuses of an ink jet system, a thermal transfer system, and the like. In the first embodiment, the image processing circuit, the optical writing device, the developing device, the transferring device, and the fixing device constitute image forming means.

The sheets guided to the end-face-binding processing tray F through the conveying paths A and D and subjected to alignment, stapling, and the like in this end-face-binding processing tray F are divided to the conveying path C, which guides the sheets to the shift tray 202, and a center-binding and center-folding processing tray G (hereinafter, "folding processing tray") by a turn guide member 609 as deflecting means. The sheets subjected to folding and the like in the folding processing tray G are guided to a lower tray 203 through a conveying path H. A branch pawl 17 is arranged in the conveying path D and held in a state as shown in FIG. 1 by a low-load spring (not shown). After a trailing end of a sheet conveyed by conveying rollers 7 passes the branch pawl 17, the sheet is conveyed backward along a turn roller 8 by reversely rotating, among conveying rollers 9 and 10 and staple sheet discharging rollers 11, at least the conveying rollers 9. The trailing end of the sheet is guided to a sheet storing unit E to hold up the sheet in the sheet storing unit E. This makes it possible to stack the next sheet on the sheet and convey both the sheets. It is also possible to stack and convey two or more sheets by repeating this operation.

In the conveying path A provided upstream the conveying paths B, C, and D and commonly connected to the conveying paths B, C, and D, an entrance sensor 301 that detects sheets received from the image forming apparatus PR. Downstream from the entrance sensor 301, entrance rollers 1, the punch unit 100, a punch dust hopper 101, conveying rollers 2, the branch pawl 15, and the branch pawl 16 are sequentially arranged. The branch pawls 15 and 16 are held in the state in FIG. 1 by springs (not shown). By turning on a solenoid (not shown), the branch pawl 15 and the branch pawl 16 are rotated upward and downward, respectively, to divide the sheets to the conveying paths B, C, and, D.

By turning off the solenoid in the state in FIG. 1 when the sheets are guided to the conveying path B or turning on the solenoid in the state in FIG. 1 when the sheets are guided to the conveying path C, the branch pawl 15 and the branch pawl 16 are rotated upward and downward, respectively. When the sheets are discharged from conveying rollers 3 to the upper tray 201 through discharging rollers 4 and guided to the sheet conveying path D, the branch pawl 16 is rotated upward by turning off the solenoid in the state in FIG. 1 and the branch pawl 15 is rotated upward by turning off the solenoid in the state in FIG. 1. The branch pawls 15 and 16 convey the sheets to the shift tray 202 side through conveying rollers 5 and a sheet discharging roller pair 6 (6*a* and 6*b*).

In this sheet processing apparatus, it is possible to apply various kinds of processing such as punching (the punch unit 100), sheet alignment and end binding (a jogger fence 53 and an end-face binding stapler S1), sheet alignment and center binding (a center-binding upper jogger fence 250*a*, a center-binding lower jogger fence 250*b*, and a center-binding stapler S2), sheet dividing (the shift tray 202), and center folding (a folding plate 74 and folding rollers 81).

As shown in FIG. 1, a shift-tray sheet discharging unit located in a most downstream section of the sheet processing apparatus PD includes the sheet discharging roller pair 6 (6*a* and 6*b*), a return roller 13, a sheet surface sensor 330, the shift tray 202, a shift mechanism (not shown) for reciprocatingly moving the shift tray 202 in a direction orthogonal to the sheet conveying direction, and a shift-tray elevating mechanism for lifting and lowering the shift tray 202.

In FIG. 1, the return roller 13 is a roller made of sponge for coming into contact with sheets discharged from the sheet discharging roller pair 6 and striking a trailing end of the sheets against an end fence to align the sheets. The return roller 13 is rotated by a rotation force of the sheet discharging roller pair 6. A tray-rise limit switch is provided near the return roller 13. When the shift tray 202 rises to push up the return roller 13, the tray-rise limit switch is turned on to stop a tray elevating motor to prevent overrun of the shift tray 202. As shown in FIG. 1, the sheet surface sensor 330 as sheet-surface position detecting means for detecting a sheet surface position of sheets or a stack of sheet-like recording media (sheet stack) discharged onto the shift tray 202 is provided near the return roller 13. In the first embodiment, a sheet-surface sensor (for stapling) and a sheet-surface sensor (for non-stapling) are turned on when the sensors are shielded by a shielding unit. Therefore, when the shift tray 202 rises and a contact section of a sheet-surface detecting lever rotates upward, the sheet surface sensor (for stapling) is turned off. When the contact section further rotates, the sheet surface sensor (for non-stapling) is turned on. When it is detected by the sheet surface sensor (for stapling) and the sheet surface sensor (for non-stapling) that a stacked quantity of sheets has reached a predetermined height, the shift tray 202 falls by a predetermined amount according to driving by the tray elevating motor. Consequently, a sheet-surface position of the shift tray 202 is kept substantially constant.

The sheets guided to the end-face-binding processing tray F by the staple sheet discharging rollers 11 are sequentially stacked on the end-face binding processing tray F. In this case, each of the sheets is aligned in a vertical direction (the sheet conveying direction) by a tapping roller 12 and aligned in a horizontal direction (a direction orthogonal to the sheet conveying direction, i.e., sheet width direction) by the jogger fence 53. The end-face binding stapler S1 is driven according to a staple signal from a control unit 350 (see FIG. 8) and binding processing is performed in a pause of jobs, i.e., between a last sheet of a sheet stack and a first sheet of the next sheet stack. The sheet stack subjected to the binding processing is immediately sent to the sheet discharging roller pair 6 by a discharging belt 52 protrudingly provided with a discharging pawl 52*a* and discharged onto the shift tray 202 set in a receiving position.

A home position of the discharging pawl 52*a* is detected by a discharging belt home position (HP) sensor 311. The discharging belt HP sensor 311 is turned on and off by the discharging pawls 52*a* provided in the discharging belt 52. Two discharging pawls 52*a* are arranged in opposed positions on the outer periphery of the discharging belt 52 and move and convey sheet stacks stored in the end-face binding processing tray F by turns. It is also possible to reversely rotate the discharging belt 52 when necessary to align a leading end in the conveying direction of a sheet stack, which are stored in the end-face binding processing tray F, in the back of the discharging pawl 52*a* on the opposite side of the discharging pawl 52*a* put on standby to be about to move a sheet stack. Therefore, the discharging pawls 52*a* also function as means for aligning a sheet stack in the sheet conveying direction.

On a driving shaft of the discharging belt 52 driven by a discharging motor (not shown), the discharging belt 52 and a driving pulley therefor are arranged in an alignment center in the sheet width direction. A discharging roller 56 is arranged and fixed symmetrically to the driving pulley. Peripheral speed of the discharging roller 56 is set higher than peripheral speed of the discharging belt 52.

A pendulum motion is given to the tapping roller 12 by a tapping solenoid (SOL) to turn around a fulcrum 12*a*. The tapping roller 12 intermittently acts on sheets sent into the end-face-binding processing tray F to bring the sheets into contact with a trailing end fence 51. The tapping roller 12 rotates counterclockwise. The jogger fence 53 is driven by a jogger motor (not shown), which is capable of rotating regularly and reversely, via a timing belt and reciprocatingly moves in the sheet width direction.

The end-face binding stapler S1 is driven by a stapler moving motor (not shown), which is capable of rotating regularly and reversely, via a timing belt and moves in the sheet width direction to bind a predetermined position at an end of sheets. At one side end in a moving range of the end-face binding stapler S1, a stapler movement HP sensor that detects a home position of the end-face binding stapler S1 is provided. A binding position in the sheet width direction is controlled according to an amount of movement of the end-face binding stapler S1 from the home position. The end-face binding stapler S1 is constituted to make it possible to change a driving angle of staples to be parallel to or oblique to a sheet end. Moreover, the end-face binding stapler S1 is constituted to make it possible to obliquely rotate only a binding mechanism section of the stapler S1 by a predetermined angle in the home position and easily replace staples. The stapler S1 is obliquely rotated by an oblique motor. When it is detected by a staple replacement position sensor that the stapler S1 has rotated to a predetermined oblique angle or has reached a position for replacement of the staples, the oblique motor stops. When the oblique driving of the staples is finished or the replacement of the staples is finished, the stapler S1 rotates to the original position and prepares for the next stapling.

A sheet presence/absence sensor 310 in FIG. 1 detects presence or absence of sheets on the end-face-binding processing tray F.

Figure 2:
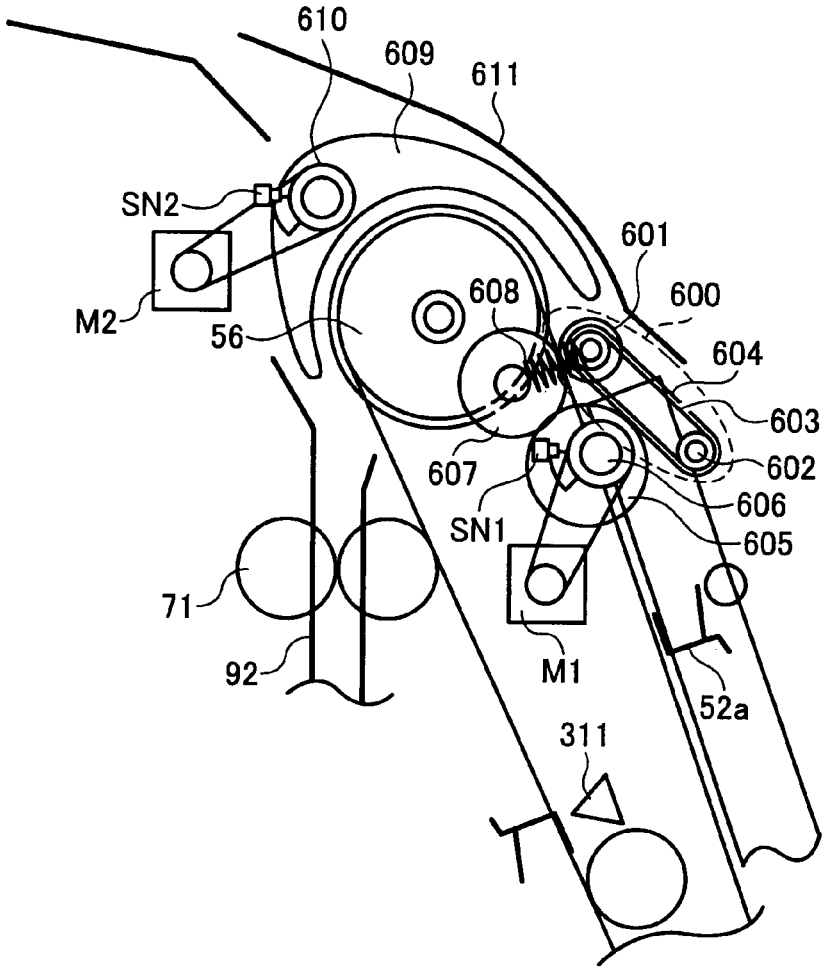
FIG. 2 is an enlarged diagram of a section of an end-face-binding processing tray and a folding processing tray in the sheet processing apparatus according to the first embodiment.

As shown in FIG. 1 and an enlarged diagram of the end-face-binding processing tray F and the folding processing tray G in FIG. 2, a sheet-stack deflecting mechanism includes a conveying mechanism 600 that applies a conveying force to a sheet stack, the discharging roller 56 that turns the sheet stack, and the turn guide member 609 that guides the sheet stack in a turn section. As described above, the discharging roller 56 is provided at an upper end of the end-face-binding processing tray F. The turn guide member 609 is arranged in an outer periphery of the discharging roller 56.

FIG. 2 is an enlarged diagram of the section of the end-face-binding processing tray and the folding processing tray in the sheet processing apparatus according to the first embodiment. As detailed structures of the end-face-binding processing tray and the folding processing tray, as shown in FIGS. 1 and 2, a driving force of a driving shaft 602 is transmitted to a roller 601 of the conveying mechanism 600 by a timing belt 603. The roller 601 and the driving shaft 602 is coupled and supported by an arm 604 and can move with the driving shaft 602 as a rotation fulcrum. Rotational movement of the roller 601 of the conveying mechanism 600 is performed by a cam 605. The cam 605 rotates around a rotation shaft 606 and a driving force for the cam 605 is transmitted from a motor M1.

Figure 3:
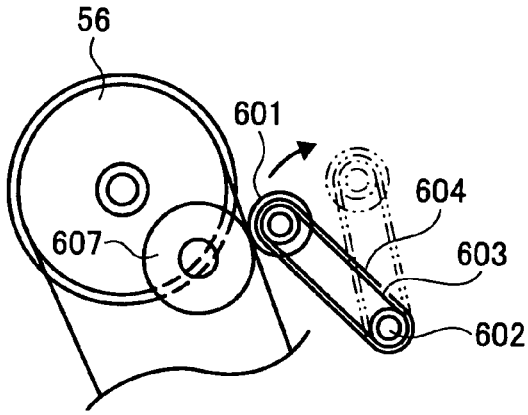
FIG. 3 is an enlarged diagram of an example of an arrangement of a conveying mechanism in the sheet processing apparatus according to the first embodiment.
Figure 4:
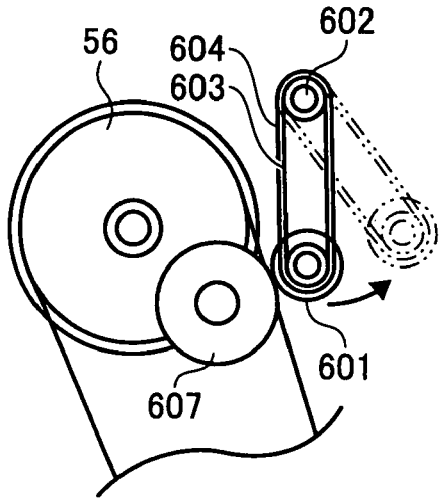
FIG. 4 is an enlarged diagram of another example of the arrangement of the conveying mechanism in the sheet processing apparatus according to the first embodiment.
Figure 5:
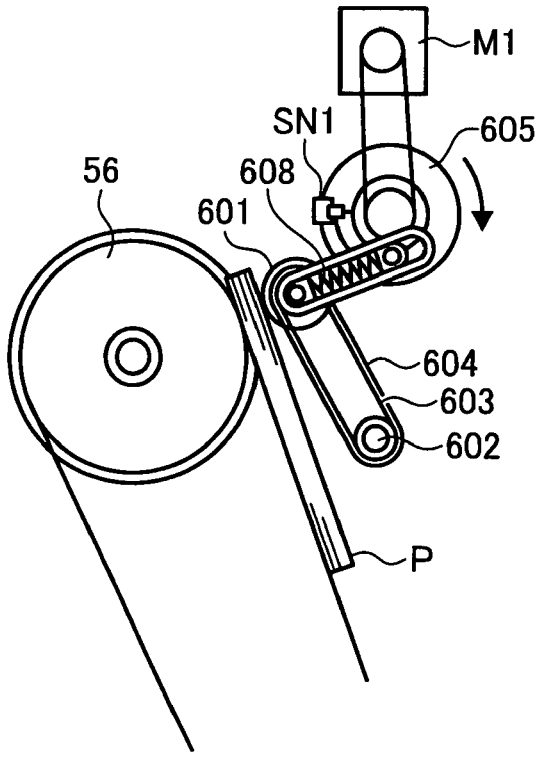
FIG. 5 is an enlarged diagram of a relation among a roller of the conveying mechanism, a discharging roller, and a sheet stack in the sheet processing apparatus according to the first embodiment.

A home position of the cam 605, which rotationally moves the conveying mechanism 600, is detected by a sensor SN1. A rotation angle from the home position may be controlled by adding sensors in FIG. 2 or may be adjusted according to pulse control by the motor M1. In FIG. 5, a driven roller 607 is arranged in a position of the conveying mechanism 600 opposed to the roller 601. A sheet stack P is nipped by the driven roller 607 and the roller 601 and pressed by an elastic member 608 formed by, for example, a tension spring and applied with a conveying force. As thickness of the sheet stack P increases, a larger conveying force, i.e., a larger pressing force is required. Thus, as shown in FIG. 3 or 4, it is also possible constitute the conveying mechanism 600 to be swingable in a cantilever manner. Moreover, as shown in FIG. 5, the roller 601 of the conveying mechanism 600 may be pressed against a sheet stack by the cam 605 biased by the elastic member 608 and a pressing force may be adjusted according to a pressing angle of the cam 605.

Figure 6:
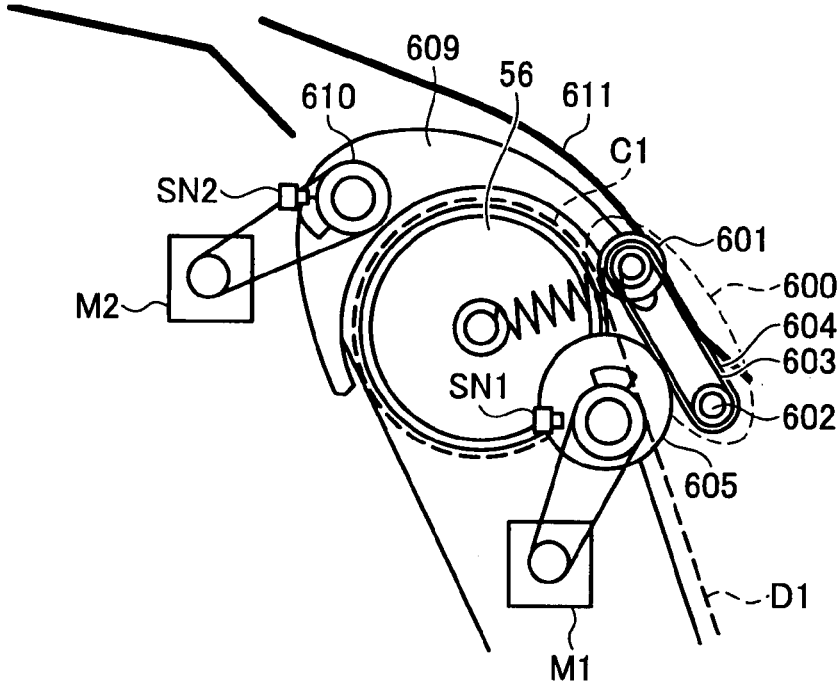
FIG. 6 is a diagram of a state of a turn conveying unit at the time when the sheet stack is conveyed to a center-binding processing tray side in the sheet processing apparatus according to the first embodiment.

As shown in FIG. 6, it is also possible to cause the discharging roller 56 to also function as the driven roller opposed to the roller 601 of the conveying mechanism 600 in FIG. 2. However, in this case, a nip position of the roller 601 and the discharging roller 56 is set in a contact position where a stack conveyance locus line Dl and an eccentric circle C1 of the discharging roller 56 come into contact with each other or set near the contact position.

Figure 7:
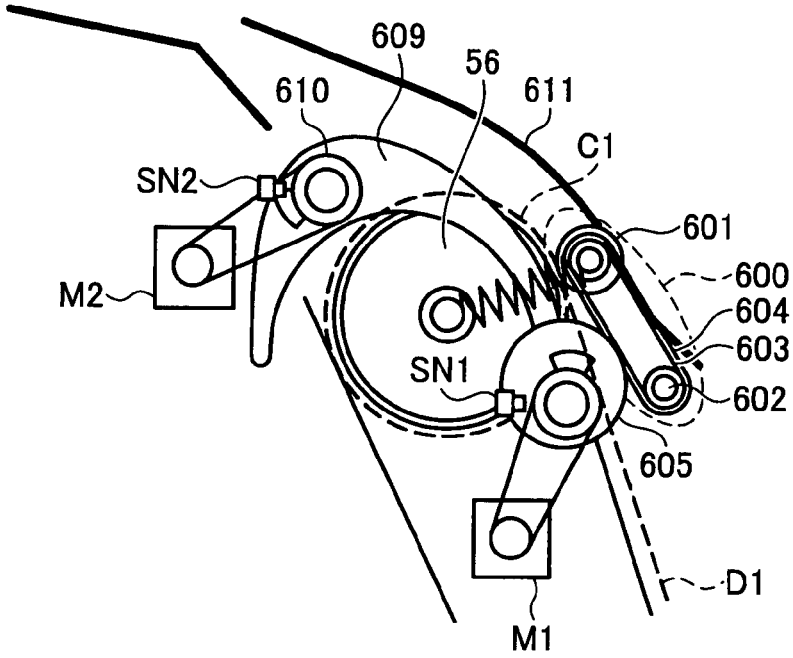
FIG. 7 is an enlarged diagram of the turn conveying unit at the time when the sheet stack is conveyed to a shift tray side in the sheet processing apparatus according to the first embodiment.

A conveying path that conveys a sheet stack from the end-face-binding processing tray F to the folding processing tray G includes the discharging roller 56 and the turn guide member 609 on the opposite side of the discharging roller 56. The turn guide member 609 rotates around a fulcrum 610 and a driving force for the turn guide member 609 is transmitted from the motor M2. A home position of the turn guide member 609 is detected by a sensor SN2. A conveying path that conveys a sheet stack from the end-face-binding processing tray F to the shift tray 202 as the stacking means is formed by the turn guide member 609 and a guide plate 611 in a state in which the turn guide member 609 rotates in the clockwise direction around the fulcrum 610 as shown in FIG. 7.

Center binding and center folding are performed in the folding processing tray G provided on a downstream side of the end-face-binding processing tray F. A sheet stack is guided from the end-face-binding processing tray F to the folding processing tray G by the sheet-stack deflecting mechanism. Structure of the center-binding tray and the center-folding processing tray are explained below.

As shown in FIG. 1, the folding processing tray G is provided on a downstream side of the sheet-stack deflecting mechanism including the conveying mechanism 600, the turn guide member 609, and the discharging roller 56. The folding processing tray G is provided substantially vertically on the downstream side of the sheet-stack deflecting mechanism. The center folding mechanism, an upper stack-conveying guide plate 92, and a lower stack-conveying guide plate 91 are arranged in the center, above, and below the folding processing tray G, respectively. Upper stack conveying rollers 71 and lower stack conveying rollers 72 are provided above and below the upper stack-conveying guide plate 92, respectively. The center binding upper jogger fences 250*a* are arranged on both sides of the upper stack-conveying guide plate 92 astride over both the stack conveying rollers 71 and 72. Similarly, the center binding lower jogger fences 250*b* are provided on both sides of the lower stack-conveying guide plate 91. The center binding stapler S2 is arranged in a place where the center binding lower jogger fences 250*b* are set. The center binding upper jogger fences 250*a* and the center binding lower jogger fences 250*b* are driven by a driving mechanism (not shown) and perform an aligning operation in a direction (the sheet width direction) orthogonal to the sheet conveying direction. The center binding stapler S2 includes a pair of a clincher section and a driver section. Two pairs of the center binding staplers S2 are provided at a predetermined interval in the sheet width direction. Although the two pairs of the center binding staplers S2 are provided in a fixed state here, it is also possible to move one pair of the clincher section and the driver section in the sheet width direction to bind sheets in two places.

A movable trailing end fence 73 is arranged to traverse the lower stack-conveying guide plate 91. The movable trailing end fence 73 is movable in the sheet conveying direction (an up to down direction in FIG. 1) by a timing belt and a driving mechanism therefor. The driving mechanism includes, as shown in FIG. 1, a driving pulley and a driven pulley over which the timing belt is laid and a stepping motor that drives the driving pulley. Similarly, a trailing end tapping pawl 251 and a driving mechanism therefor are provided on an upper end side of the upper stack-conveying guide plate 92. The trailing end tapping pawl 251 is reciprocatingly movable by a timing belt 252 and the driving mechanism (not shown) in a direction away from the sheet-stack deflecting mechanism and a direction in which the trailing end tapping pawl 251 pushes a trailing end (corresponding to a trailing end at the time when a sheet stack is lead in). In FIG. 1, a home position sensor 326 detects a home position of the trailing end tapping pawl 251.

The center folding mechanism is provided substantially in the center of the folding processing tray G. The center folding mechanism includes the folding plate 74, the folding rollers 81, and a conveying path H for conveying a folded sheet stack.

The folding plate 74 is supported by loosely fitting two shafts erected on front and rear side plates (not shown), respectively, in long hole sections thereof. A shaft section erected from the folding plate 74 is loosely fit in a long hole section of a link arm and the link arm swings around a fulcrum thereof, whereby the folding plate 74 reciprocatingly moves to the left and right in FIG. 1. A shaft section of a folding plate driving cam is loosely fit in the hold hole section of the link arm. The link arm swings according to a rotational motion of the folding plate driving cam. According to the swing of the link arm, in FIG. 1, the folding plate 74 reciprocatingly moves in a direction perpendicular to the upper and lower stack-conveying guide plates.

In the first embodiment, center folding is performed on condition that a sheet stack is bound. However, the present invention is applicable when one sheet is folded. Since center binding is unnecessary for the one sheet, the one sheet is delivered to the folding processing tray G side when the one sheet is discharged. Folding processing is executed by the folding plate 74 and the folding rollers 81 to discharge the sheet onto the lower tray 203 from sheet discharging rollers 83. A folding-unit passage sensor 323 detects center-folded sheets.

In the first embodiment, a detecting lever 501 that detects a stacking height of a center folded sheet stack is provided in the lower tray 203 to be swingable around a fulcrum 501*a*. An angle of the detecting lever 501 is detected by a sheet surface sensor 505 to perform an operation for lifting and lowering the lower tray 203 and detection of overflow from the lower tray 203.

Figure 8:
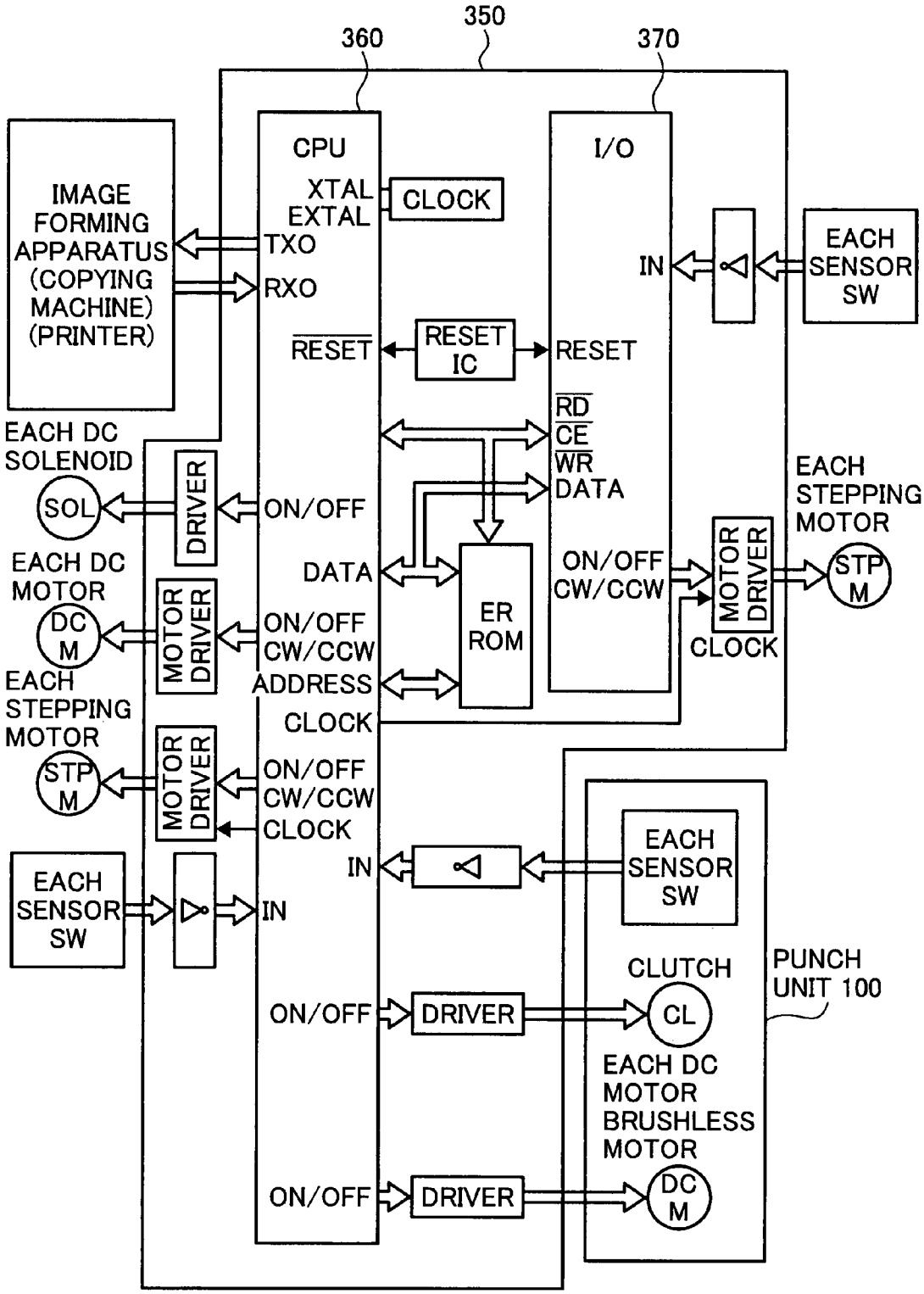
FIG. 8 is a block diagram of a schematic structure of a control unit of the sheet processing apparatus according to the first embodiment.

FIG. 8 is a block diagram of a schematic structure of the control unit of the sheet processing apparatus according to the first embodiment. The control unit 350 is a microcomputer including a central processing unit (CPU) 360 and an input/output (I/O) interface 370. Signals from switches and the like of a control panel in a main body of the image forming apparatus PR and sensors such as the entrance sensor 301, an upper sheet-discharge sensor 302, a shift sheet-discharge sensor 303, a pre-stack sensor 304, a staple sheet-discharge sensor 305, the sheet presence/absence sensor 310, a discharging belt HP sensor 311, a staple movement home position sensor (not shown), a stapler oblique home-position sensor (not shown), a jogger fence home-position sensor (not shown), a stack arrival sensor 321, a movable trailing-end-fence home-position sensor 322, the folding-unit passage sensor 323, a lower sheet-discharge sensor 324, the sheet surface sensor 330, the sheet surface sensor 505, and the sensors SN1 and SN2 are inputted to the CPU 360 via the I/O interface 370.

The CPU 360 controls, on the basis of the signals inputted, the tray elevating motor for the shift tray 202, a sheet-discharge-guide-plate opening and closing motor that opens and closes an opening and closing guide plate, a shift motor that moves the shift tray 202, a tapping roller motor that drives the tapping roller 12, the solenoids such as the tapping SOL, a conveyance motor that drives the respective conveying rollers, a sheet discharge motor that drives the respective sheet discharging rollers, a discharge motor that drives the discharging belt 52, the stapler moving motor that moves the end-face binding stapler S1, the oblique motor that obliquely rotates the end-face binding stapler S1, the jogger motor that moves the jogger fence 53, the motor M1 that drives the conveying mechanism 600, the motor M2 that swings and drives the turn guide member 609, a trailing end fence moving motor (not shown) that moves the movable trailing end fence 73, a folding-plate driving motor 166 that moves the folding plate 74, a folding-roller driving motor (not shown) that drives the folding rollers 81, and the like.

A pulse signal of the staple conveyance motor (not shown) that drives the staple sheet discharging roller is inputted to the CPU 360 and counted. A tapping SOL 170 and a jogger motor 158 are controlled according to this count. The punch unit 100 executes punching according to an instruction of the CPU 360 that controls a clutch and a motor for the punch unit 100. The control of the sheet processing apparatus PD is performed by the CPU 360 executing a program stored in a read only memory (ROM) (not shown) using a random access memory (RAM) (not shown) as a work area.

Figure 9:
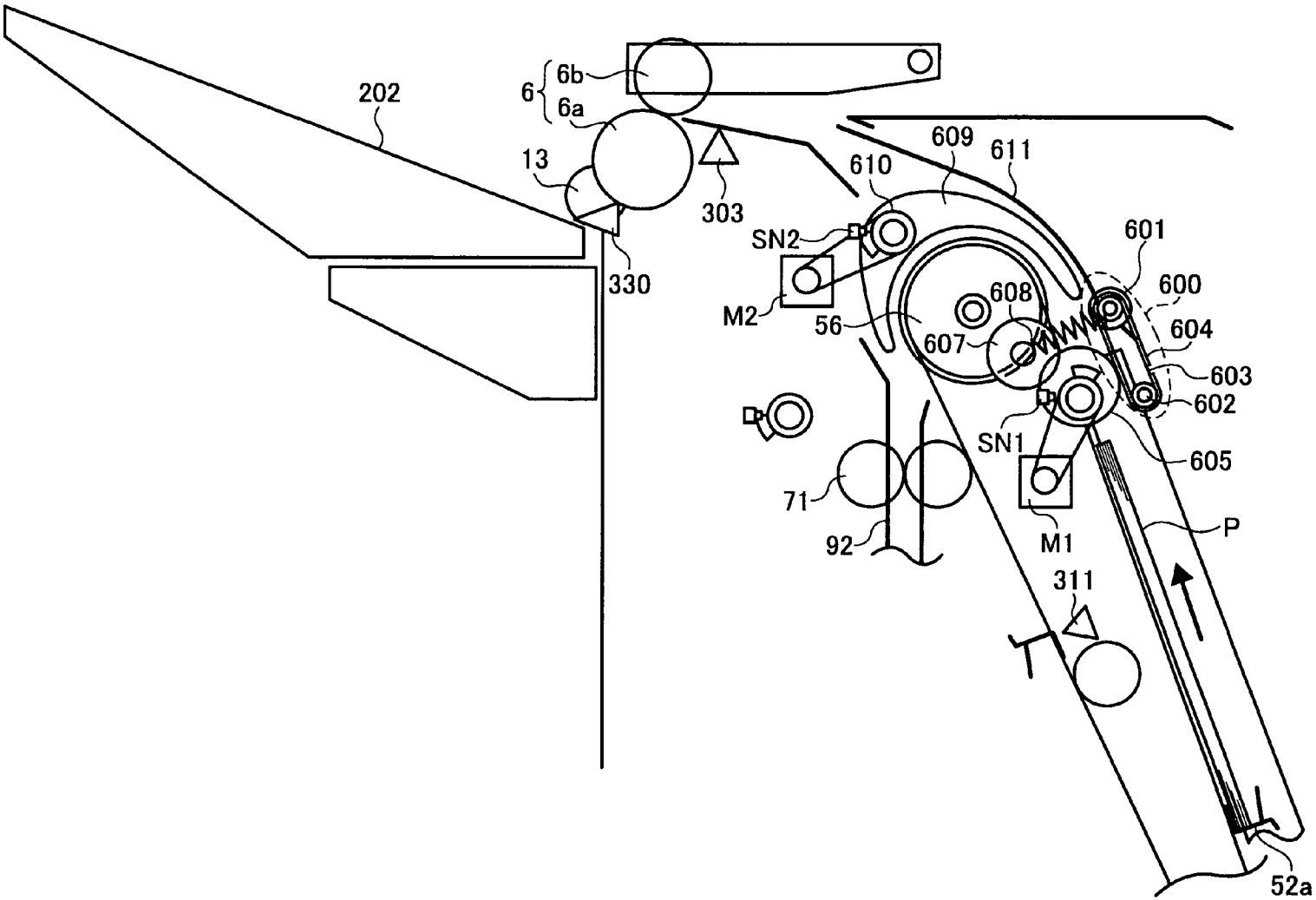
FIG. 9 is a diagram of a main part of a sheet-stack deflecting unit of the sheet processing apparatus according to the first embodiment.
Figure 10:
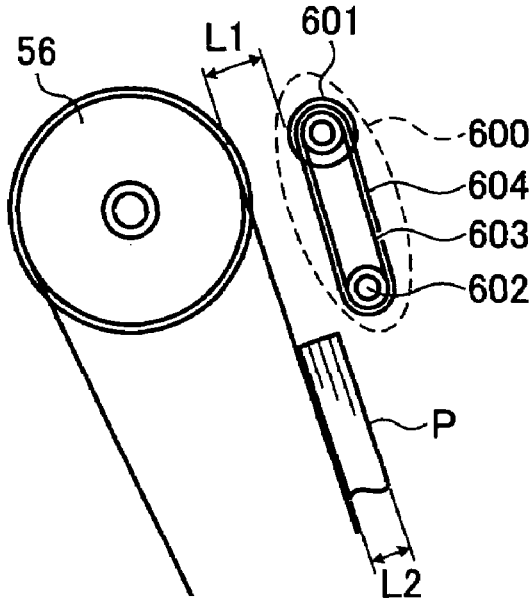
FIG. 10 is a diagram for explaining relative positions of the discharging roller and the conveying mechanism in the sheet processing apparatus according to the first embodiment.

FIG. 9 is a diagram of a main part of a sheet stack deflecting unit of the sheet processing apparatus according to the first embodiment. When a sheet stack is sent from the end-face-binding processing tray F to the folding processing tray G, as shown in FIG. 9, a trailing end of a sheet stack aligned by the trailing end fence 51 and the jogger fence 53 in the end-face-binding processing tray F is pushed up by the discharging pawl 52*a*. The sheet stack is nipped by the roller 601 located above the end-face-binding processing tray F and the driven roller 607 opposed to the roller 601 and applies a conveying force to the sheet stack. In this case, the roller 601 located on a leading end side of the sheet stack is on standby in a position where the roller 601 does not bump against the leading end of the sheet stack. As shown in a diagram for explaining relative positions of the discharging roller 56 and the conveying mechanism 600 in FIG. 10, a distance L1 is set larger than a maximum thickness L2 of the sheet stack sent from the end-face-binding processing tray F to the folding processing tray G to prevent collision of the leading end of the sheet stack and the roller 601. The distance L1 is a distance between a surface on which the sheet stack is stacked during alignment in the end-face-binding processing tray F or a surface to which the sheet stack is guided when the sheet stack is pushed up by the discharging pawl 52*a* and the roller 601.

Since the thickness of the sheet stack changes according to the number of sheets aligned in the end-face-binding processing tray F and a sheet type, a position at least required for preventing collision of the roller 601 and the leading end of the sheet stack also changes.

Figure 11:
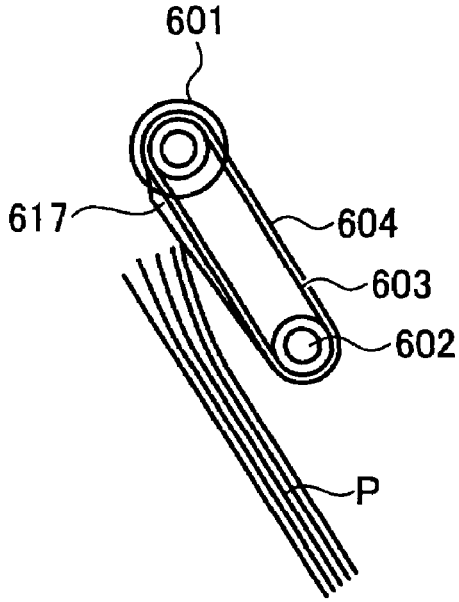
FIG. 11 is an enlarged diagram of a main part of the conveying mechanism in the sheet processing apparatus according to the first embodiment.

Thus, if a retracting position is varied according to information on the number of sheets and the sheet type, it is also possible to set time for moving from the retracting position to a position where a conveying force is applied to a necessary minimum time. This advantageously works for productivity. The information on the number of sheets and the sheet type may be job information from the main body or may be obtained by a sensor in the sheet processing apparatus PD. However, when curl larger than anticipated occurs in the sheet stack aligned by the end-face-binding processing tray F, it is conceivable that the leading end of sheets and the roller 601 come into contact with each other when the sheet stack is pushed up by the discharging pawl 52*a*. Thus, as shown in an enlarged diagram of a main part of the conveying mechanism 600 in FIG. 11, a conveyance support member 617 is provided immediately before the roller 601 to reduce an angle of contact between the leading end of the sheets and the roller 601. An effect of the conveyance support member is not different whether the conveyance support member is a fixed member or an elastic member.

Figure 12:
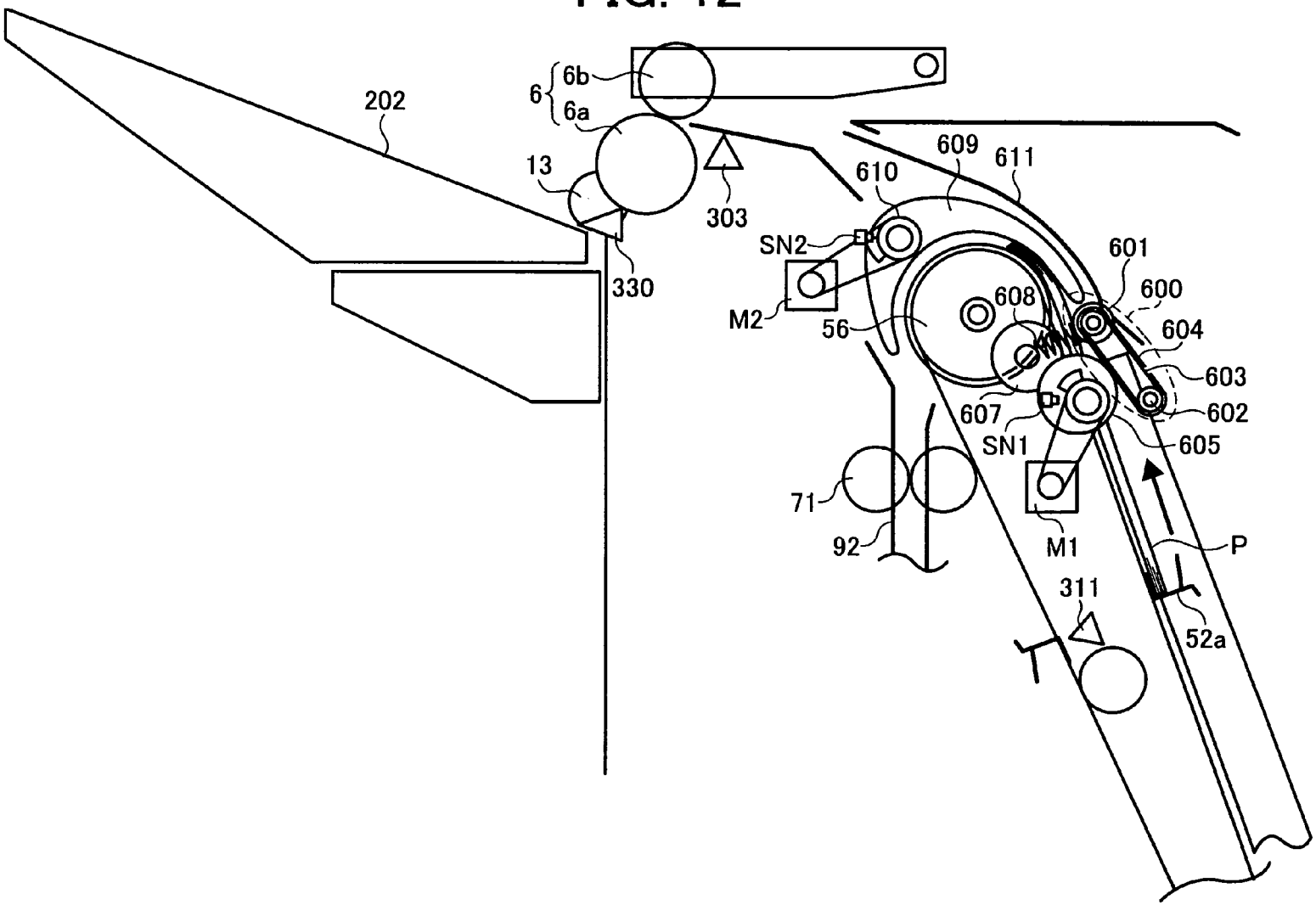
FIG. 12 is a diagram of the main part of the sheet-stack deflecting unit during sheet stack deflection of the sheet processing apparatus according to the first embodiment.

As shown in FIG. 12 in which a main part of the sheet-stack deflecting unit during deflection of the sheets is shown, the roller 601 of the conveying mechanism 600 is brought into contact with the surface of the sheets to apply a conveying force to the sheet stack after the leading end of the sheets passes the conveying mechanism 600. In this case, a guide for a turn section is formed by the turn guide member 609 and the discharging roller 56 and the sheet stack is conveyed to the folding processing tray G on the downstream side along this guide.

Figure 13:
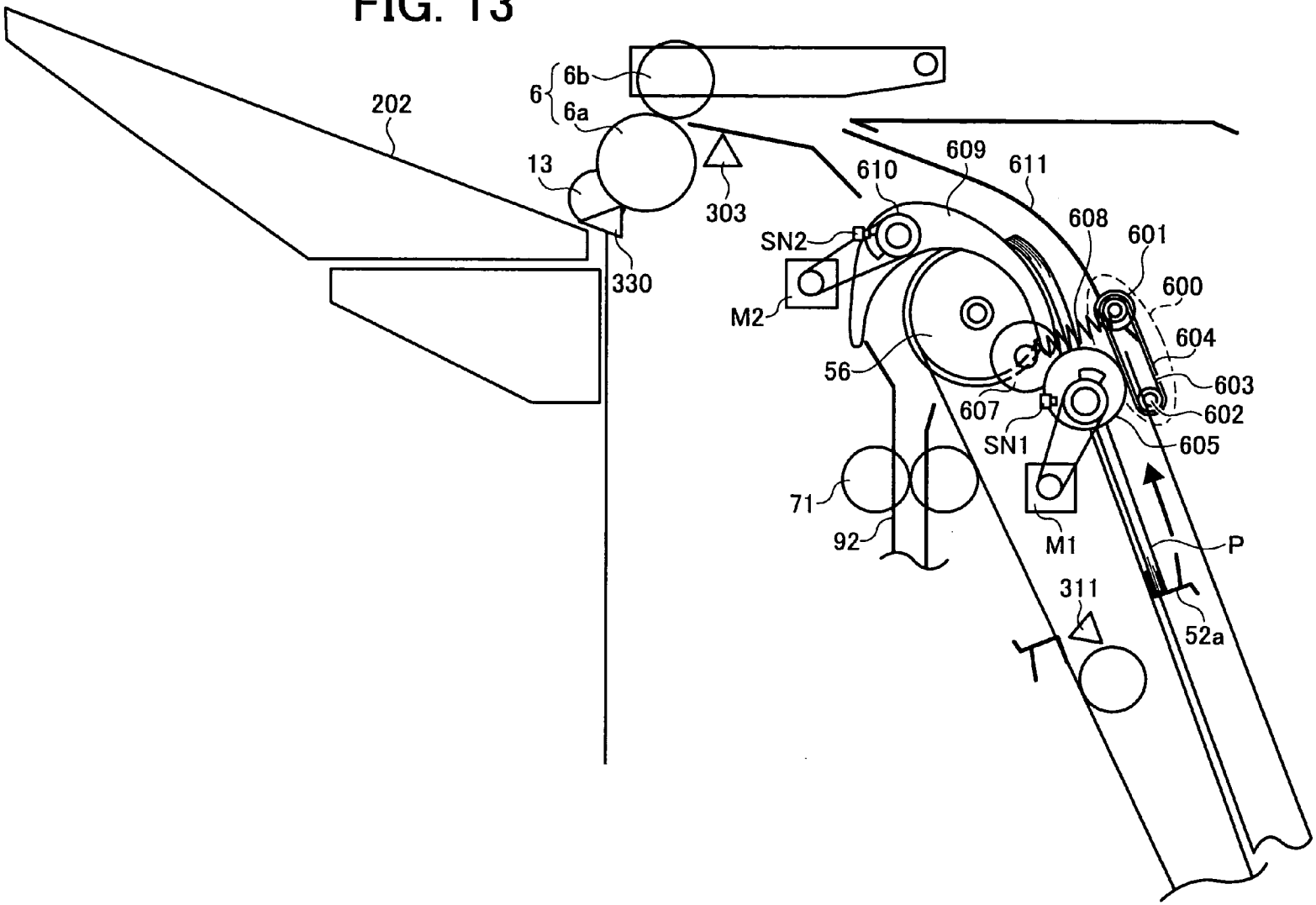
FIG. 13 is a diagram of the main part of the sheet-stack deflecting unit during sheet stack conveyance to the shift tray side of the sheet processing apparatus according to the first embodiment.

FIG. 13 is a diagram of the main part of the sheet-stack deflecting unit during conveyance of a sheet stack to the shift tray 202 side. When the sheet stack is sent from the end-face-binding processing tray F to the shift tray 202, as shown in FIG. 13, the turn guide member 609 is rotated in the clockwise direction in FIG. 13 and a conveying path connected to the shift tray 202 is formed by the outer peripheral surface of the turn guide member 609 and the guide plate 611. A trailing end of the sheet stack aligned by the end-face-binding processing tray F is pushed up by the discharging pawl 52*a* and the sheet stack is conveyed to the shift tray 202.

When the discharging roller 56 is a driven roller that is not driven by a driving roller driving by a motor and follows conveyance of the sheet stack, it is possible to deflect the sheet stack and convey the sheet stack to the folding processing tray G side and the sheet-stack shift tray 202 side.

Figure 14:
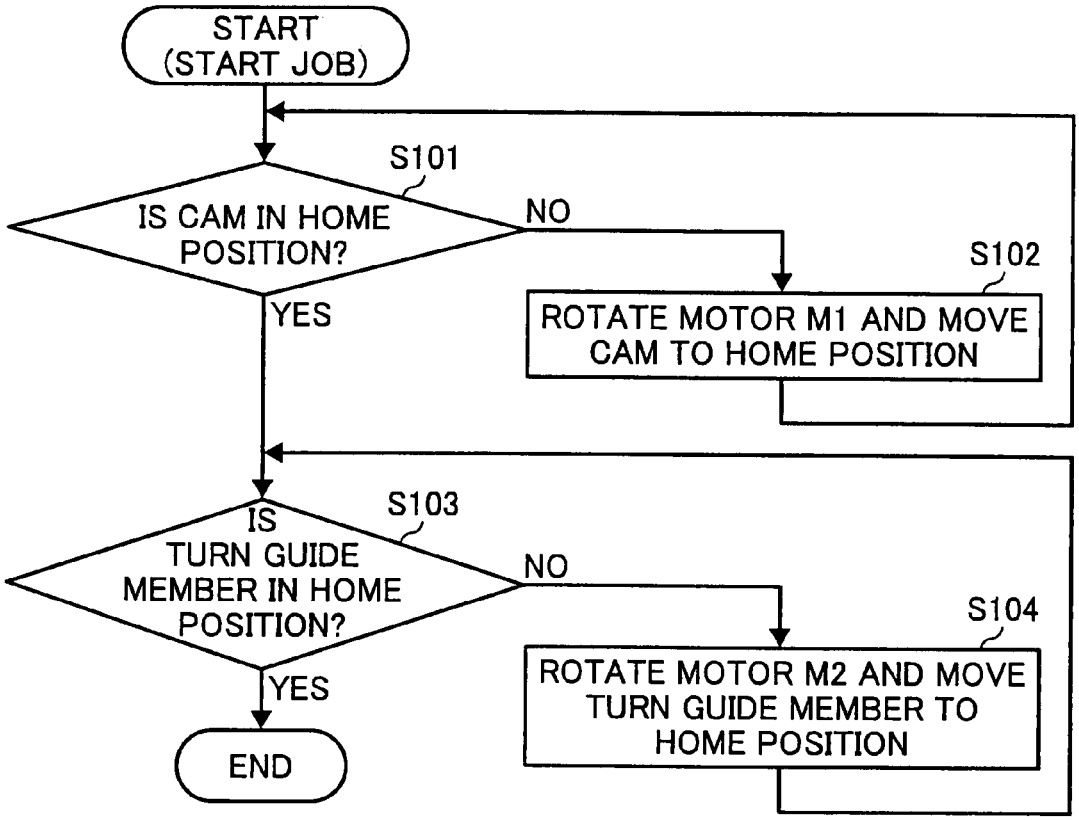
FIG. 14 is a flowchart of a processing procedure of initial processing by the sheet processing apparatus according to the first embodiment.
Figure 15A:
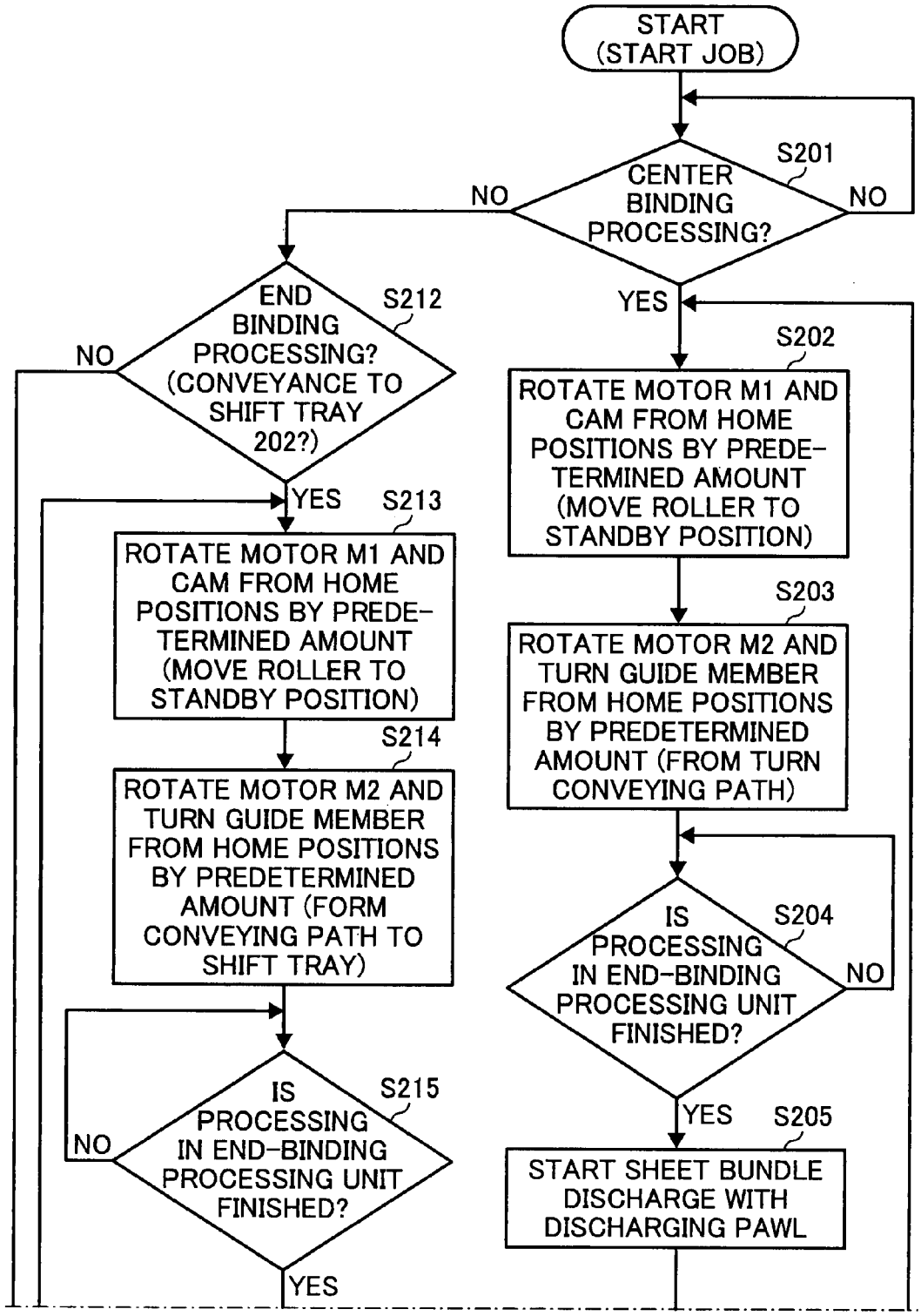
FIG. 15 is a flowchart of a control procedure of a conveyance operation from the end-face-binding processing tray to the center-binding processing tray or the shift tray of the sheet processing apparatus according to the first embodiment.
Figure 15B:
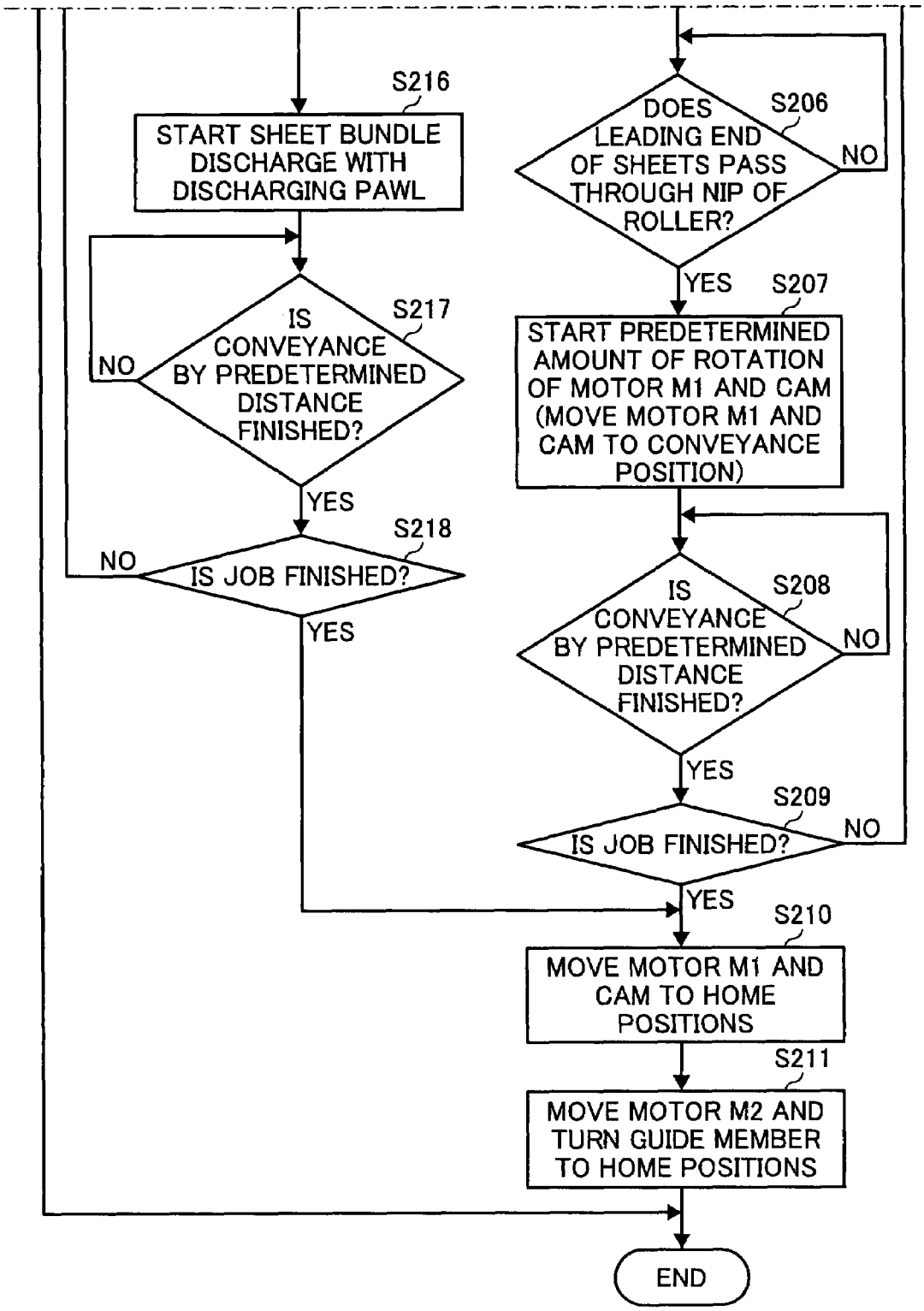

Control procedures of the operation for conveyance to the folding processing tray G and the operation for conveyance to the shift tray 202 shown in FIGS. 12 and 13 are shown in flowcharts in FIGS. 14 and 15, respectively. FIG. 14 is a flowchart of a processing procedure of initial processing. In the initial processing, the CPU 360 executes processing for setting the cam 605 and the turn guide member 609 in initial positions (steps S101 to S104).

FIG. 15 is a flowchart of a control procedure of the operation for conveyance from the end-face-binding processing tray F to the folding processing tray G or the shift tray 202. As shown in FIG. 15, when a job is started, first, the CPU 360 checks whether the job is center binding processing (step S201). When the job is center binding processing, the CPU 360 rotates the motor M1 and the cam 605 from home positions by an amount set in advance and, at the same time, moves the roller 601 to a standby position (step S202). Subsequently, the CPU 360 moves the motor M2 and the turn guide member 609 from home positions by an amount set in advance to form a turn conveying path for deflection of a sheet stack (step S203). When the processing in the end-face-binding processing tray F is finished (step S204), the CPU 360 starts discharge (pushing up) of the sheet stack with the discharging pawl 52*a* (step S205).

When a discharge operation is started and a leading end of the sheet stack passes through the nip position of the roller 601 (step S206), the CPU 360 rotates the motor M1 and the cam 605 by a predetermined amount and moves the roller 601 to a conveyance position (step S207). Thereafter, when an operation of conveyance of the sheet stack by a conveyance distance set in advance is finished (step S208), the CPU 360 checks whether the conveyance operation is an operation of a last job. When the conveyance operation is not an operation of the last job, the CPU 360 returns to step S202 and repeats the same processing. When the job is finished (step S209), the CPU 360 moves the motor M1 and the cam 605 to the home positions (step S210) and moves the motor M2 and the turn guide member 609 to the home positions (step S211) to finish the processing.

On the other hand, when the job is not center binding processing at step S201, the CPU 360 checks whether the job is end-face binding processing (step S212). When end-face binding is not performed either, the CPU 360 directly finishes the processing (sheets are directly discharged to the shift tray 202). When end-face binding is performed, the CPU 360 conveys a sheet stack subjected to end-face binding to the shift tray 202. The CPU 360 rotates the motor M1 and the cam 605 from the home positions by an amount set in advance to move the roller 601 to a standby position (step S213). Subsequently, the CPU 360 rotates the motor M2 and the turn guide member 609 from the home positions by an amount set in advance to form a conveying path to the shift tray 202 (step S214). When the processing in the end-face-binding processing tray F is finished (step S215), the CPU 360 starts discharge (pushing up) of the sheet stack with the discharging pawl 52*a* (step S216).

When a discharge operation is started and conveyance in a distance set in advance is finished (step S217), the CPU 360 checks whether the conveyance operation is an operation of a last job. When the conveyance operation is not an operation of a last job, the CPU 360 returns to step S213 and repeats the same processing. When the job is finished (step S218), the CPU 360 moves the motor M1 and the cam 605 to the home positions (step S210) and moves the motor M2 and the turn guide member 609 to the home positions (step S211) to finish the processing.

As described above, according to the first embodiment, the conveying mechanism of the sheet processing apparatus is provided and the conveying mechanism includes the conveying roller that conveys sheets and the driven roller opposed to the conveying roller. Consequently, a sheet processing mechanism that enables more highly accurate sheet alignment is provided.

A second embodiment of the present invention is different from the first embodiment in that a driving roller is provided opposed to a conveying roller.

Figure 16:
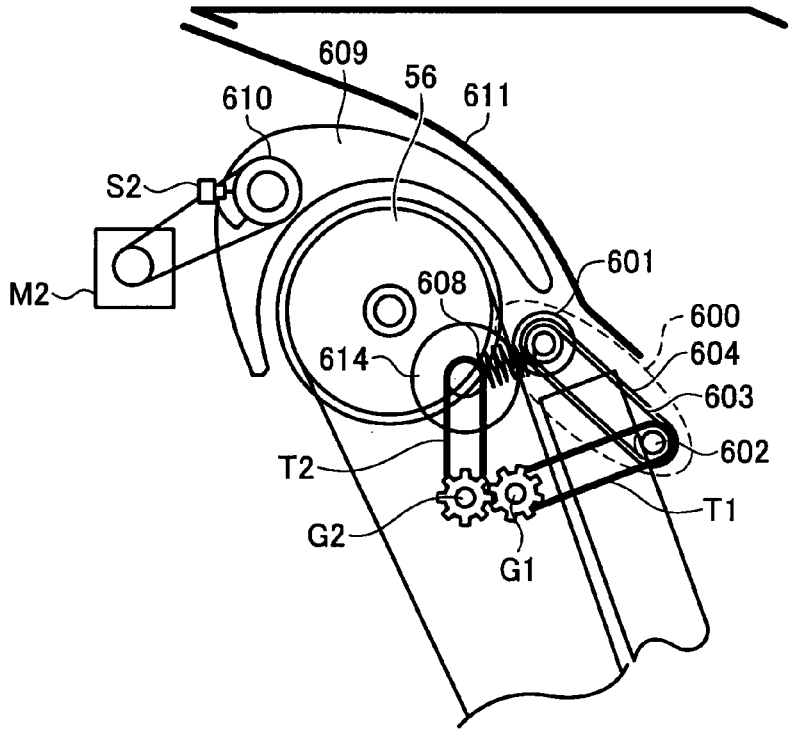
FIG. 16 is a diagram of details near a conveying mechanism in a sheet processing apparatus according to a second embodiment of the present invention.
Figure 17:
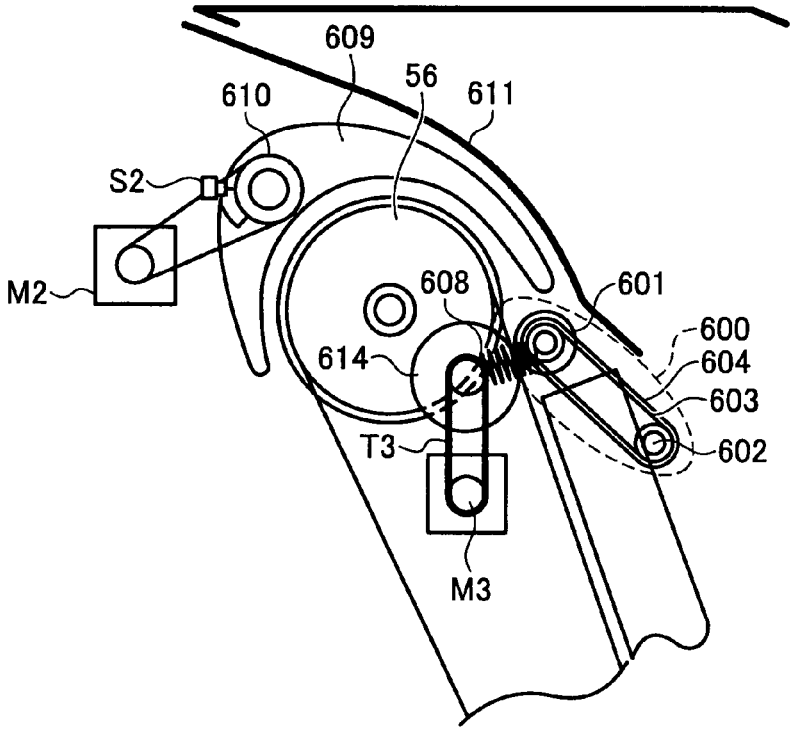
FIG. 17 is a diagram of another example of the details near the conveying mechanism in the sheet processing apparatus according to the second embodiment.

FIGS. 16 and 17 are diagrams of a main part of a sheet processing apparatus according to the second embodiment. Since components of the sheet processing apparatus except those shown in FIGS. 16 and 17 are the same as those in the first embodiment, the same components are denoted by the same reference numerals and signs and redundant explanations of the components are omitted.

Whereas a driving force is applied to the outer side of the sheet stack and the sheet stack is conveyed by the conveying mechanism 600 or the sheet stack is turned by the discharging roller 56 in the first embodiment, a driving force is also applied to the inner side of the sheet stack and the sheet stack is conveyed in the second embodiment. Therefore, the driven roller (FIG. 4) according to the first embodiment is changed to a driving roller 614 and the driving roller 614 is brought into press contact with the roller 601 at a predetermined pressure using the elastic member 608 to apply a driving force (a conveying force) from the inner side of the sheet stack as well.

Therefore, in an example in FIG. 16, the driving roller 614 is driven from the driving shaft 602, which drives the roller 601, via a first timing belt T1, first and second gears G1 and G2, and a second timing belt T2. In this case, the first gear G1 is driven by the first timing belt T1 and the second timing belt T2, which transmits a driving force to the driving roller 614, is driven by the second gear G2 that meshes with the first gear G1. The roller 601 and the driving roller 614 are driven by the driving force of the driving shaft 602, respectively, and the sheet stack is conveyed while being held in a nip between the roller 601 and the driving roller 614.

In an example in FIG. 17, a driving force for the driving roller 614 is obtained from a motor M3 provided separately from the sheet processing apparatus. A third timing belt T3 is driven by the motor M3, the driving force is applied to the driving roller 614, and a sheet stack is conveyed by the roller 601 and the driving roller 614.

Except the above, the sheet processing apparatus according to the second embodiment is constituted and functions the same as the sheet processing apparatus according to the first embodiment unless specifically noted otherwise.

As described above, according to the second embodiment, the driving roller is provided opposed to the conveying roller. Consequently, a sheet processing mechanism that prevents a difference in a frictional force applied to each of sheets of a sheet stack and enables more highly accurate sheet alignment is provided.

A third embodiment of the present invention is different from the first embodiment in operation control for the roller 601.

Figure 18:
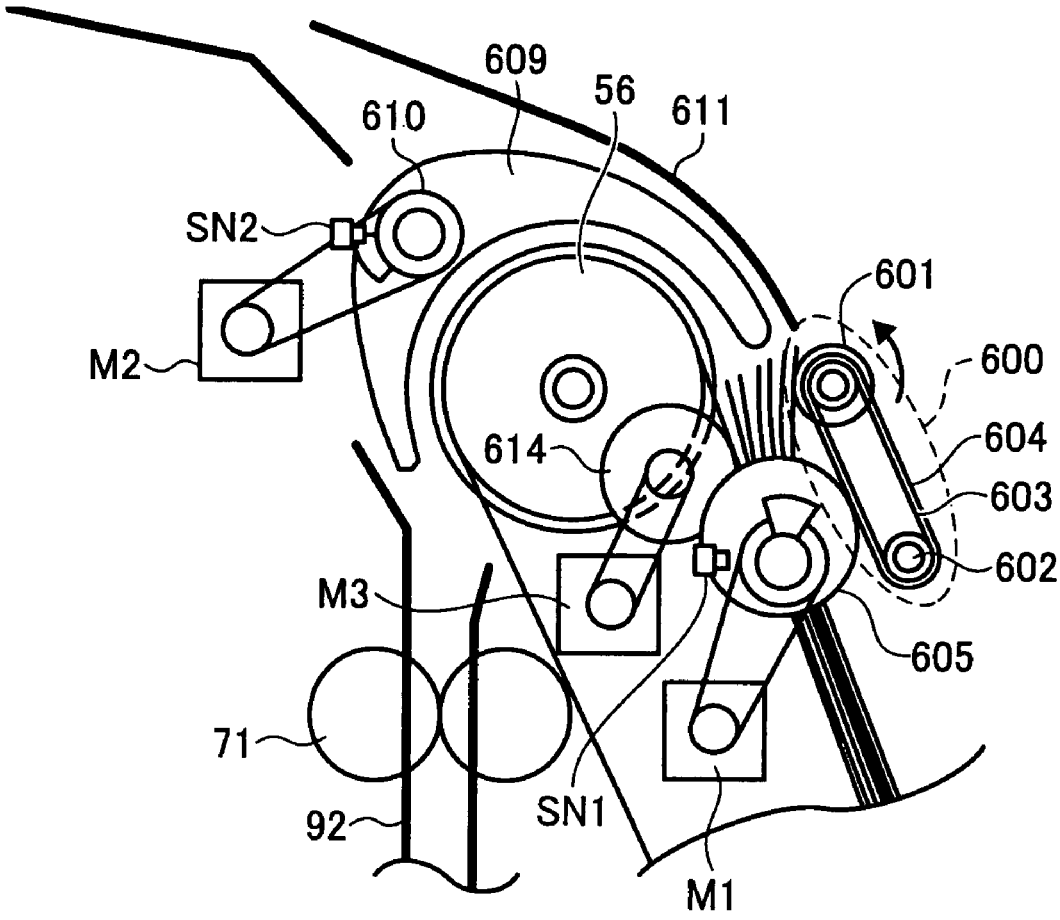
FIG. 18 is a diagram of a state in which sheets are conveyed into an end-binding processing tray and a leading end of the sheets comes into contact with a roller in a sheet processing apparatus according to a third embodiment of the present invention.
Figure 19:
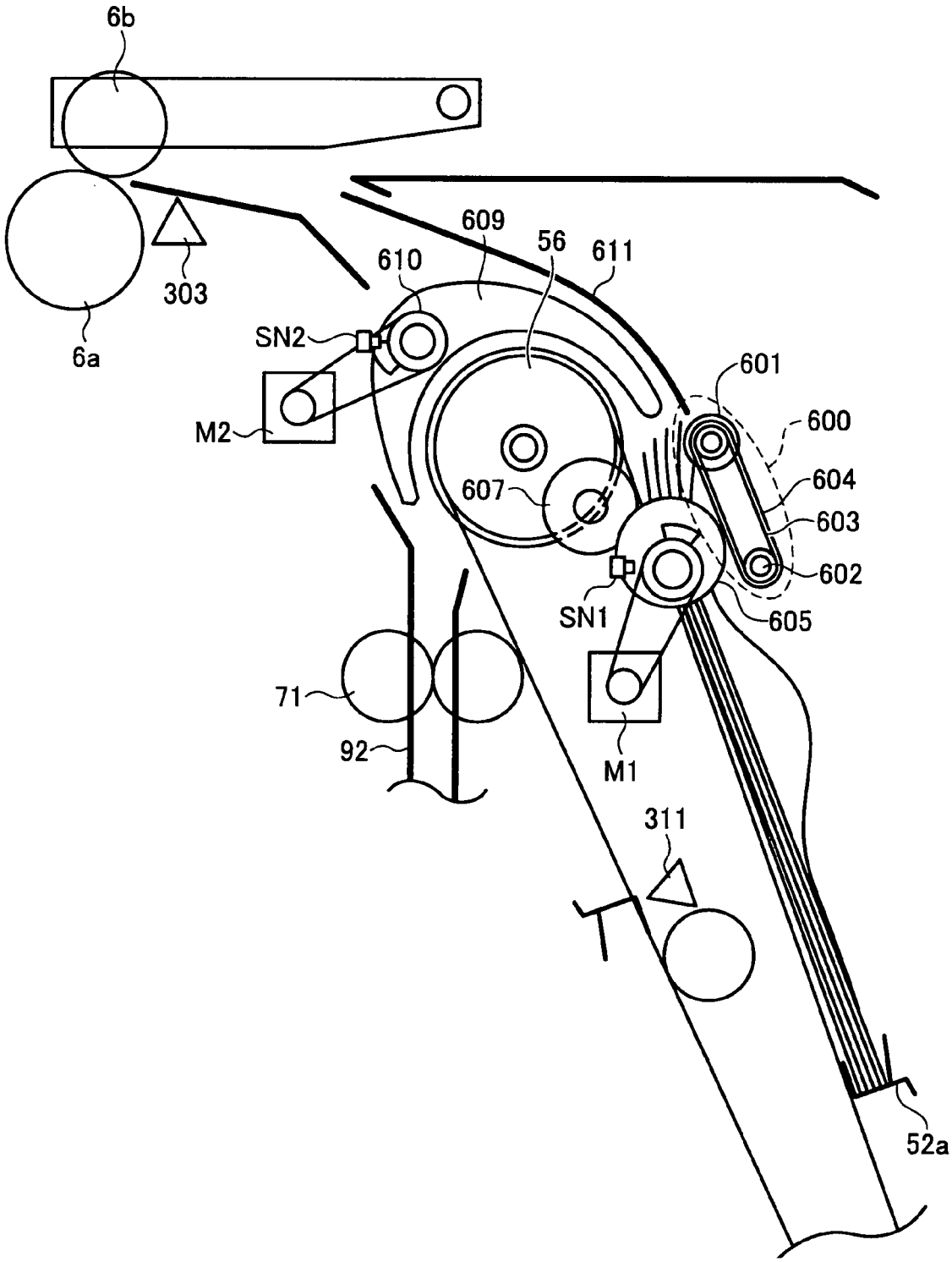
FIG. 19 is a diagram of an example in which a bend occurs in a sheet in the state in FIG. 19 in the sheet processing apparatus according to the third embodiment.

As shown in FIG. 18, when sheets are conveyed into the end-binding processing tray F, a leading end of the sheets conveyed may come into contact with the roller 601 depending on length of the sheets or curl that occurs in the sheets. In that case, when the roller 601 rotates in a direction opposite to a conveying direction of the sheets, the sheets may be buckled as shown in FIG. 19. Therefore, when the leading end of the sheets passes the roller 601 or near the roller 601, the roller 601 is stopped or rotated in the conveying direction to prevent the roller 601 from hindering conveyance of the sheets. Then, the roller 601 is rotates in the direction opposite to the conveying direction to facilitate a trailing end of the sheets to fall into the trailing end fence 51 (see FIG. 20).

Figure 20:
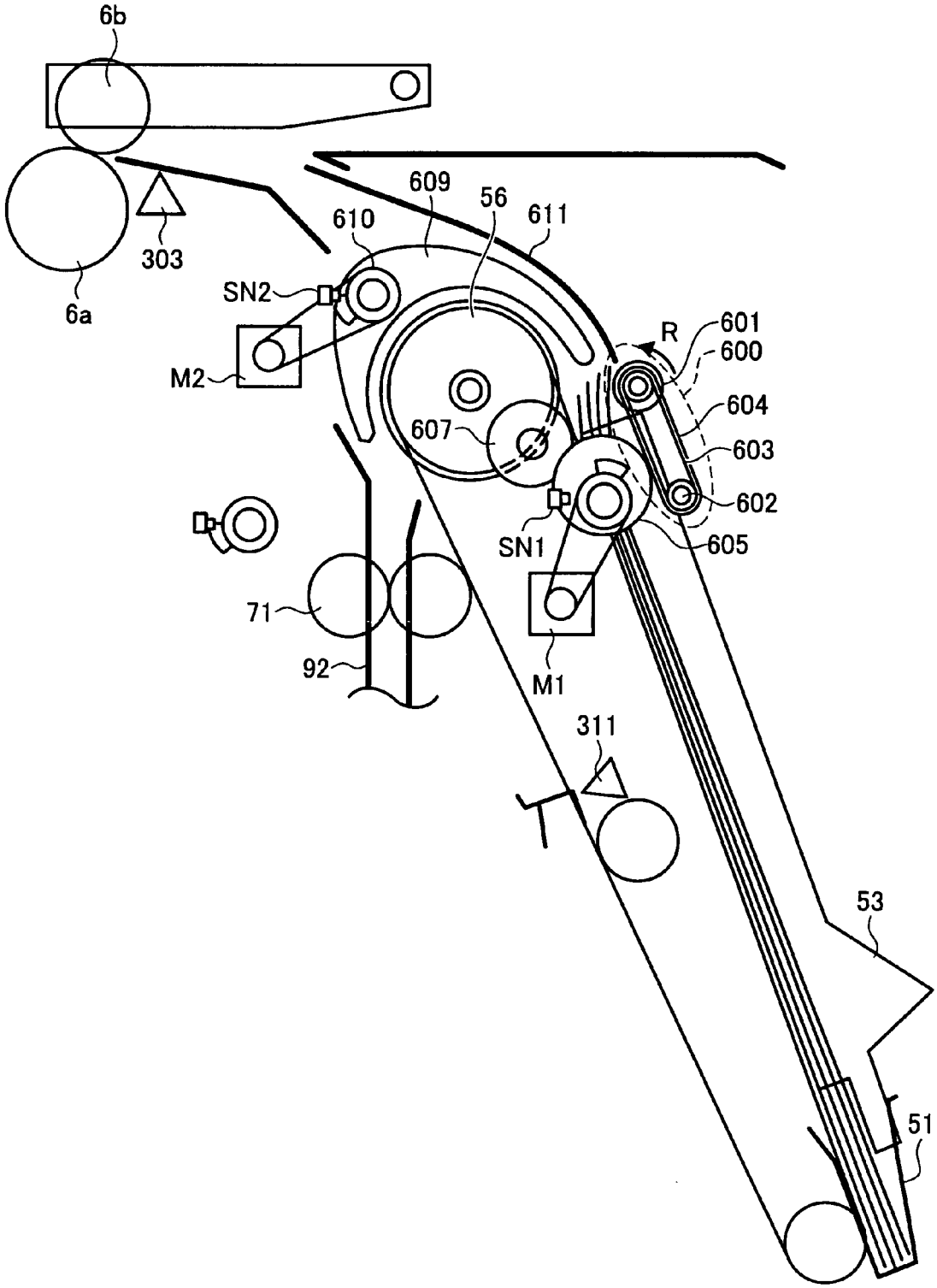
FIG. 20 is a diagram of a state in which the roller is rotated in a direction opposite to a conveying direction during alignment in the end-binding processing tray in the sheet processing apparatus according to the third embodiment.

When sheets are aligned in a direction orthogonal to the conveying direction by the jogger fence 53 (see FIG. 20) in the end-binding processing tray F, it is necessary to apply a conveying force to the sheets to drop the sheets to the trailing end fence 51 side. Thus, as shown in FIG. 20, the roller 601 is rotated in the direction opposite to the conveying direction (an arrow R) when the sheets are aligned. When the leading end of the sheets is always in contact with the roller 601, it is conceivable that the sheets are excessively sent back by the roller 601 rotating in the direction opposite to the conveying direction and the trailing end of the sheets is buckled. Thus, the rotation in the direction opposite to the conveying direction (the arrow R) is started after the leading end of the sheets entering the end-binding processing tray F passes the roller 601 or near the roller 601. A reverse rotation operation is discontinuously performed to prevent the sheets from being excessively sent back to the trailing end fence 51.

Figure 21:
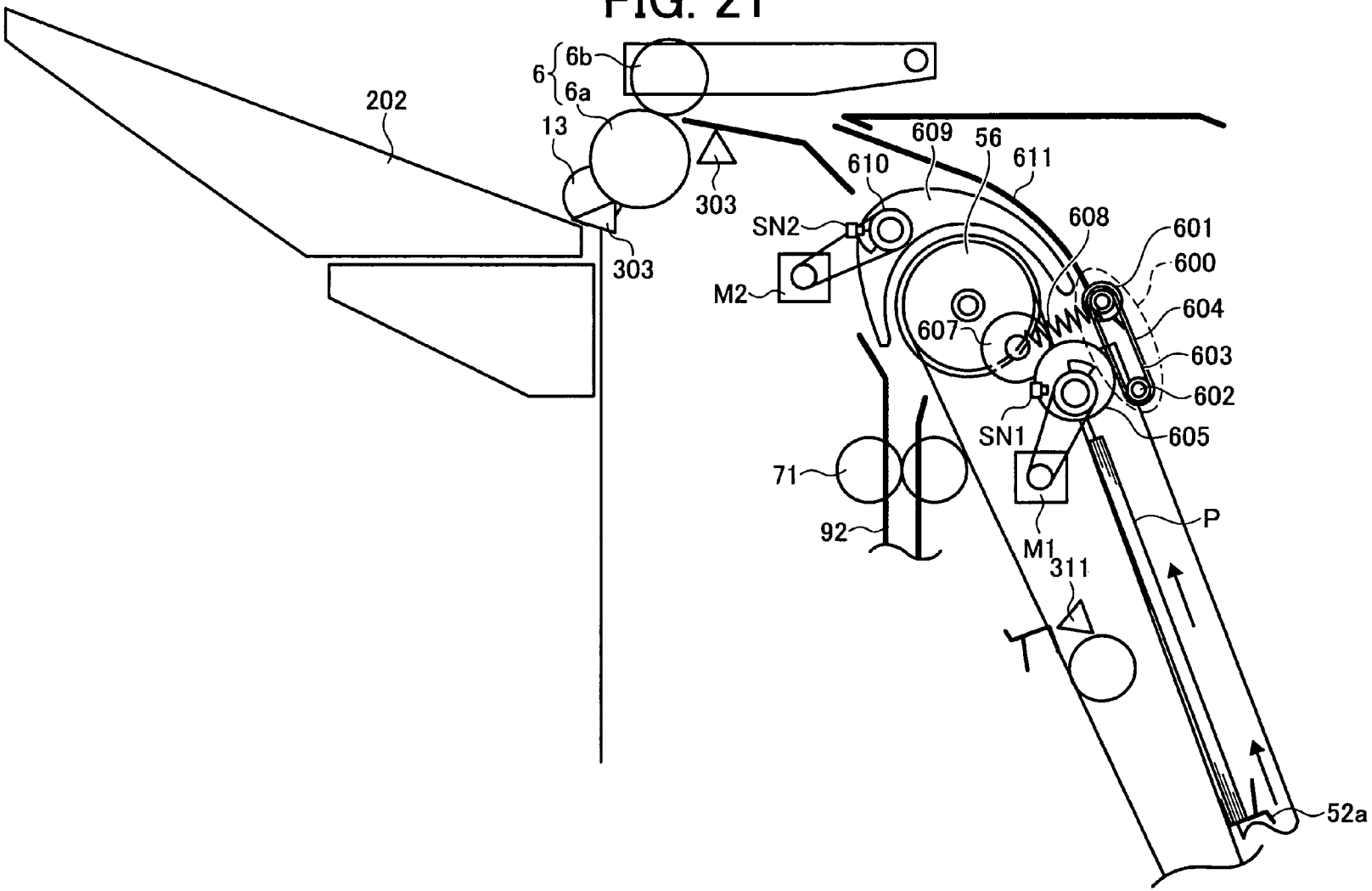
FIG. 21 is a diagram of a state in which a trailing end of a sheet stack is pushed up by a discharging pawl when the alignment in the end-binding processing tray is finished and the sheet stack is conveyed downstream in the sheet processing apparatus according to the third embodiment.
Figure 22:
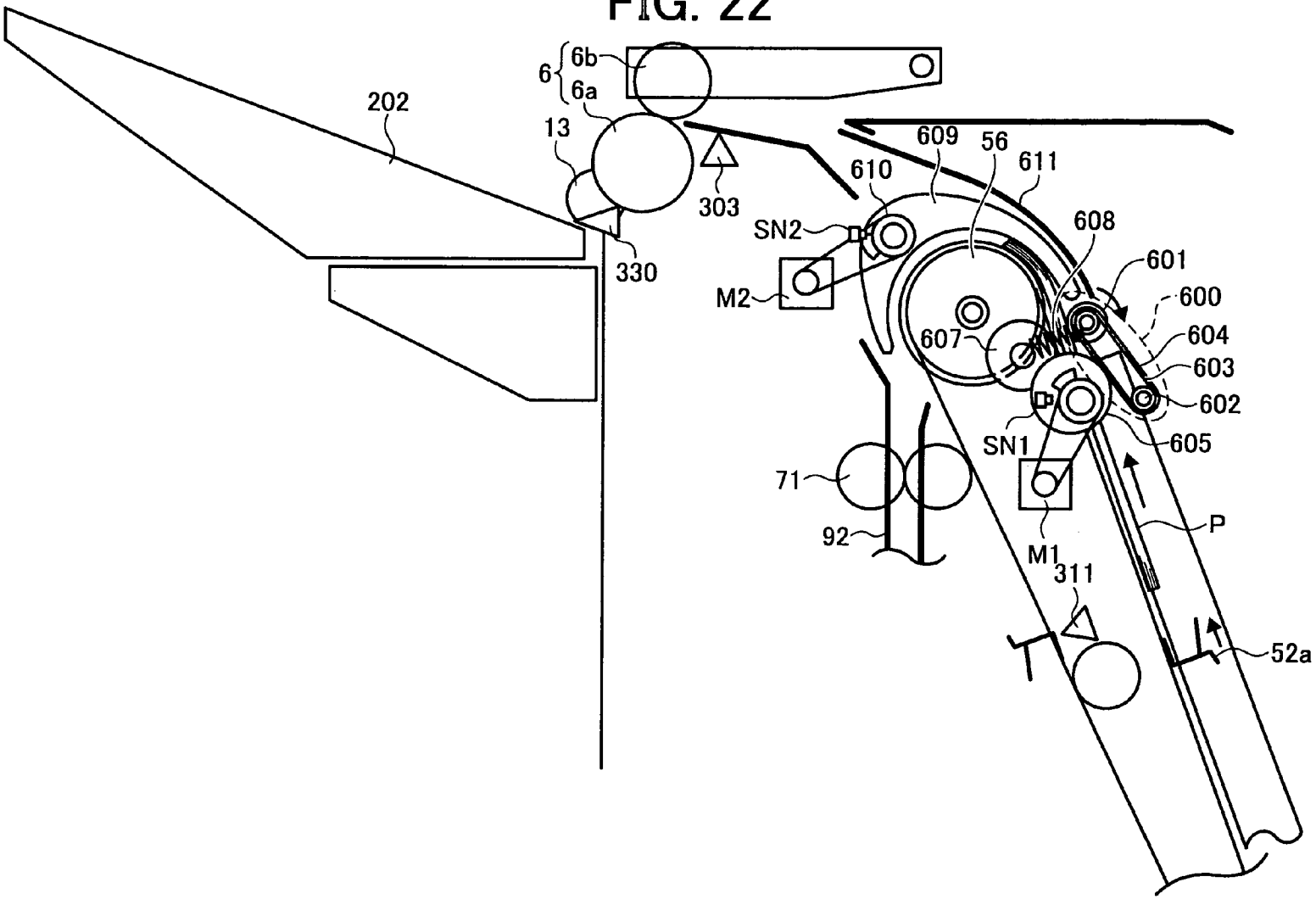
FIG. 22 is a diagram of a state in which a conveying force is applied to the sheets by a roller of a conveying mechanism to start conveyance when the trailing end of the sheet stack is pushed up by the discharging pawl in the state in FIG. 21 in the sheet processing apparatus according to the third embodiment.

When the alignment in the end-binding processing tray F is finished and the sheet stack is conveyed downstream, as shown in FIG. 21, the trailing end of the sheet stack is pushed up by the discharging pawl 52*a*. When the conveyance is started by applying a conveying force to the sheets with the roller 601 of the conveying mechanism 600 as shown in FIG. 22, conveying speed by the roller 601 is set to be equal to or higher than conveying speed by the discharging pawl 52*a* to prevent the roller 601 and the discharging pawl 52*a* from applying a load to the sheet stack and to each other.

Figure 23:
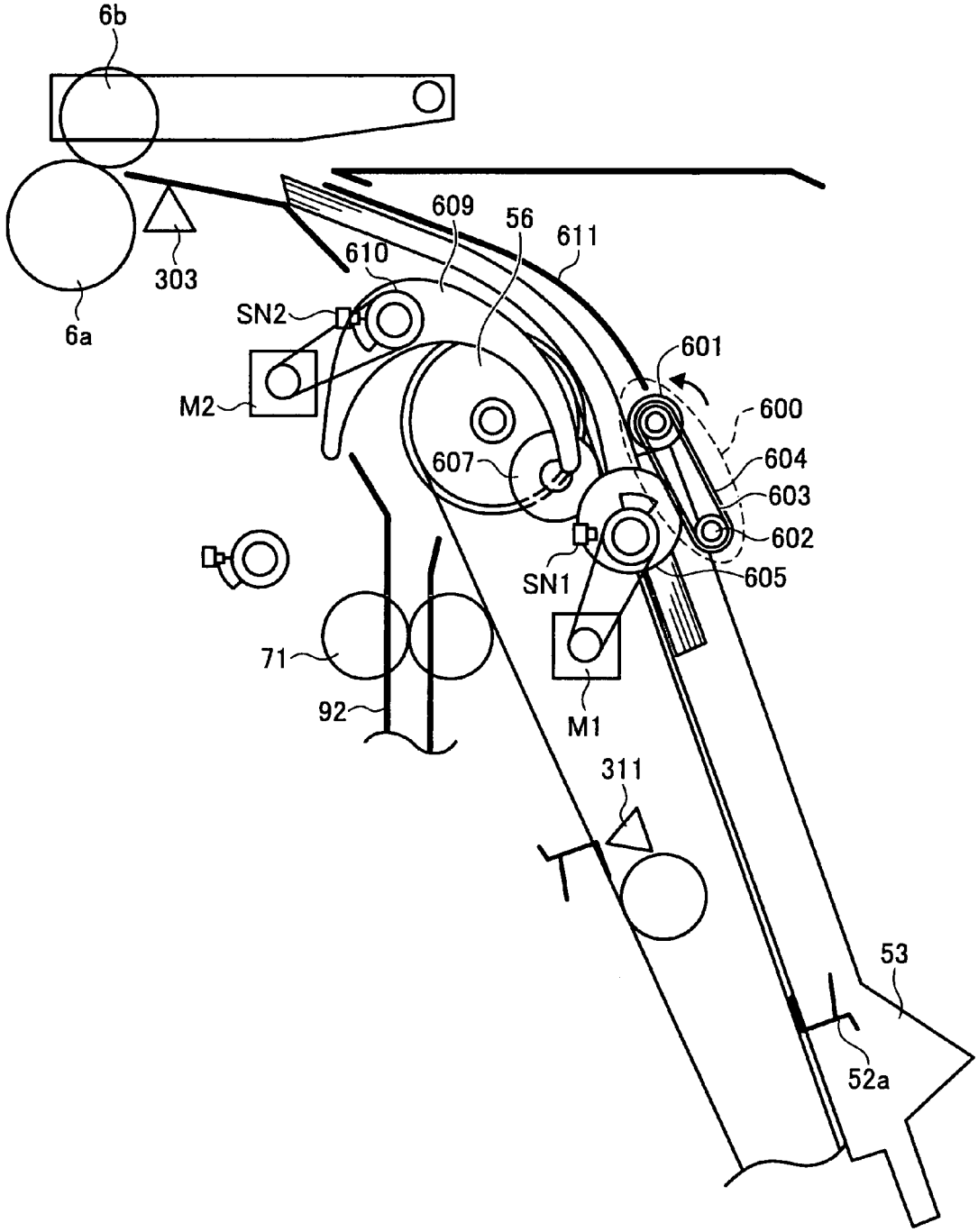
FIG. 23 is a diagram of a state in which the sheets are conveyed only by the conveying mechanism without applying a conveying force by the discharging pawl to the sheets when the sheets are discharged to a shift tray in the sheet processing apparatus according to the third embodiment.
Figure 24:
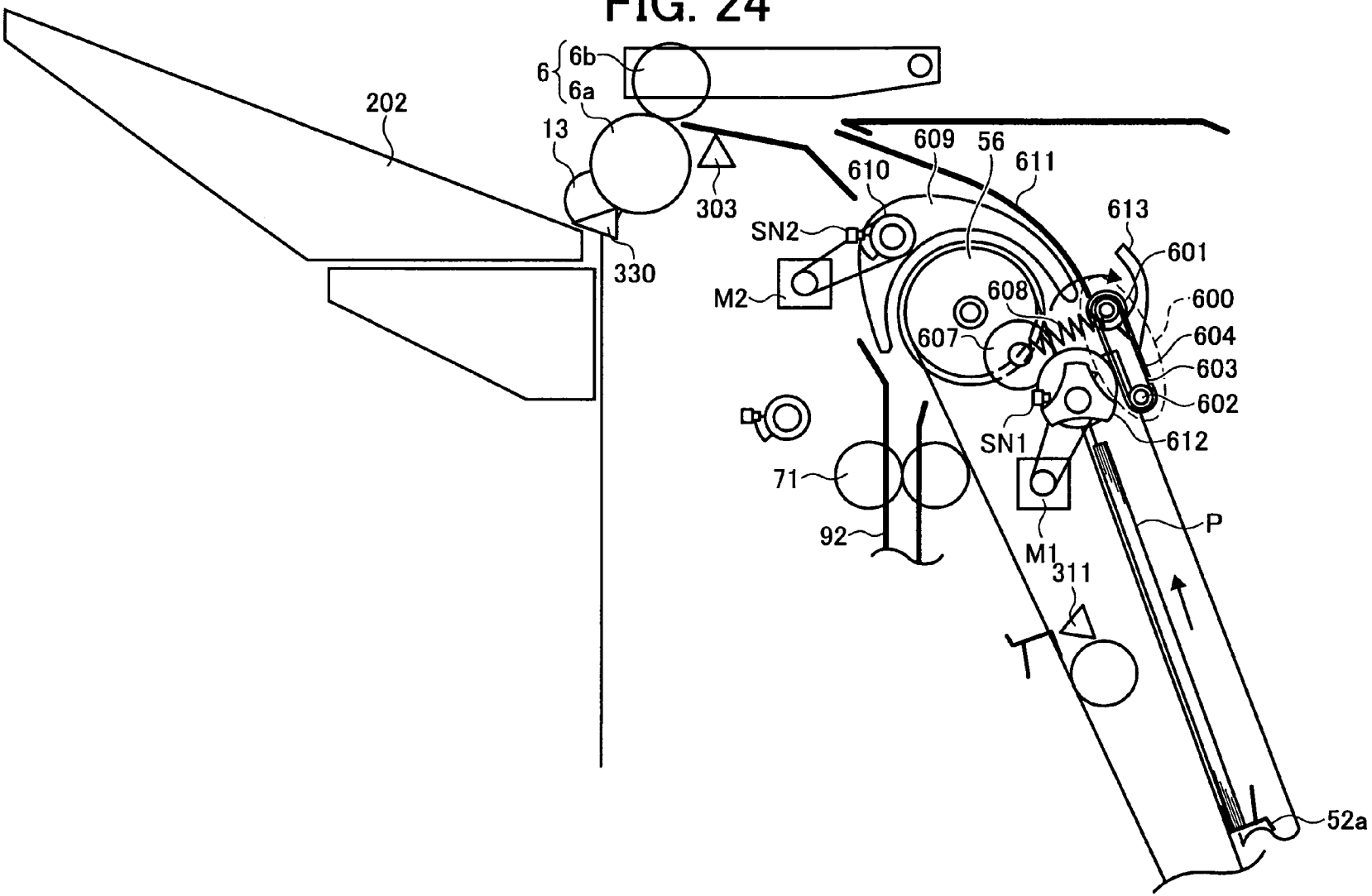
FIG. 24 is a diagram of a structure for manually opening the conveying mechanism of the sheet processing apparatus according to the third embodiment.

When the sheet stack aligned in the end-binding processing tray F is conveyed to the shift tray 202, a load applied to the discharging pawl 52*a* increases as the number of sheets of the sheet stack is larger. The sheet stack is buckled more easily as the length in the conveying direction of the sheets is larger. Therefore, as shown in FIG. 23, the sheet stack is discharged and conveyed to the shift tray 202 using the roller 601. This makes it possible to reduce a conveyance load on the discharging pawl 52*a* and prevent buckling of the sheet stack. When a jam of sheets occurs during a job or the number of sheets entering the end-binding processing tray F exceeds a defined number of sheets, an error is detected and the conveyance of the sheets is stopped. In this case, as shown in FIG. 24, the conveying mechanism 600 rotates to move in a direction away from the sheet stack to allow a user to smoothly perform jam processing. Further, to allow the user to move the conveying mechanism 600 away from the sheet stack, for example, a knob 612 may be provided coaxially with the cam 605 to make it possible to rotate the cam 605 and rotate to move the conveying mechanism 600. Alternatively, a lever 613 may be provided to make it possible to directly rotate to move the conveying mechanism 600. When the lever 613 is provided, if the lever 613 is operated in the clockwise direction in FIG. 24, it is possible to open a side of the conveying mechanism 600 that comes into contact with the sheet stack P.

Figure 25:
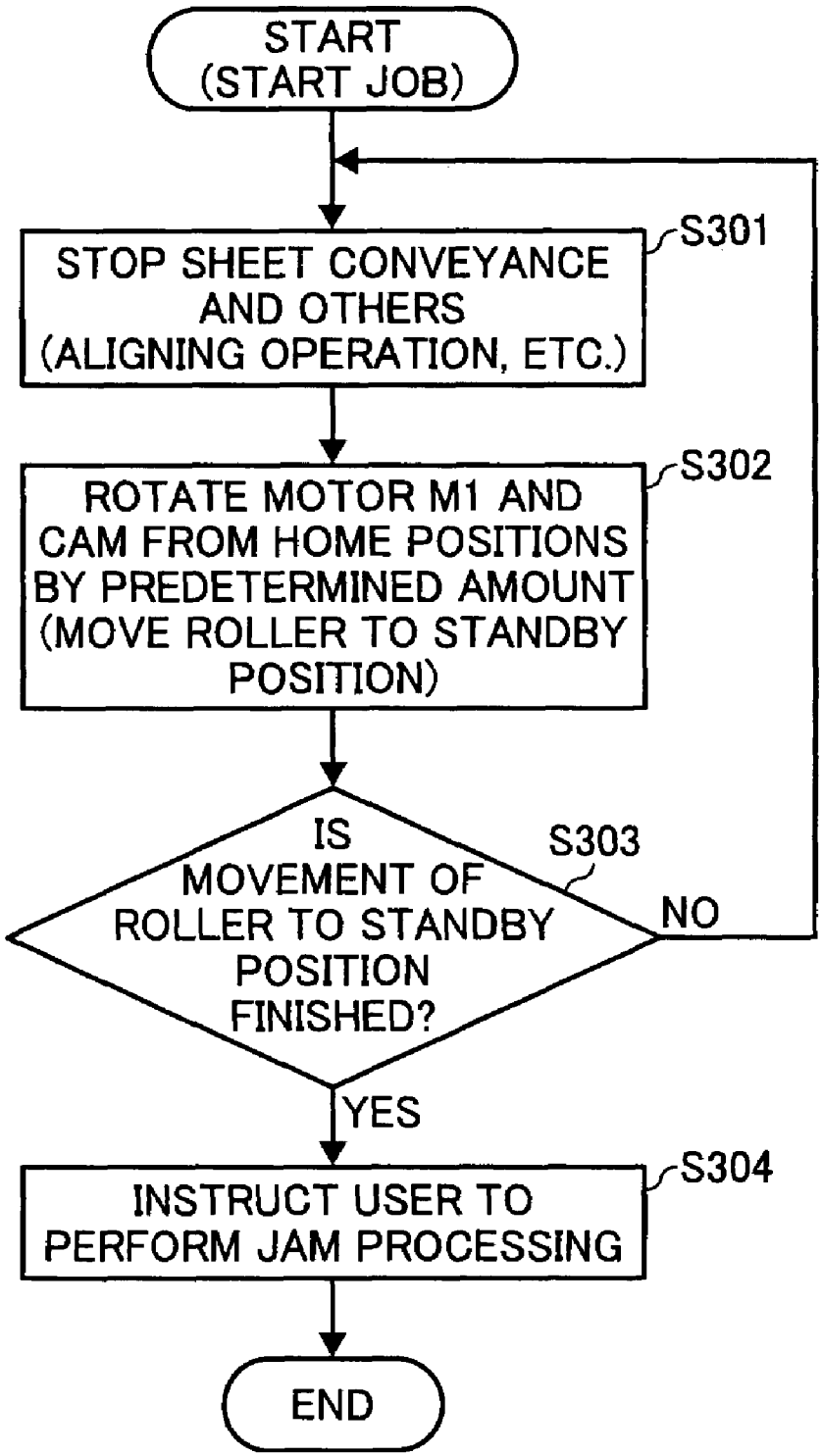
FIG. 25 is a flowchart showing a control procedure during jam processing by the sheet processing apparatus according to the third embodiment.

FIG. 25 is a flowchart of a control procedure during jam processing. As shown in FIG. 25, when job processing is started, first, the CPU 360 stops processing such as sheet conveyance and an aligning operation for sheets (step S301).

The CPU 360 rotates the motor M and the cam 605 from the home positions by the predetermined amount to move the roller 601 to the standby position (step S302). The CPU 360 judges whether the movement of the roller 601 to the standby position is finished (step S303) and instructs the user to perform jam processing (step S304). This instruction is performed by displaying the instruction on an operation display unit of the image forming apparatus PR.

Figure 26A:
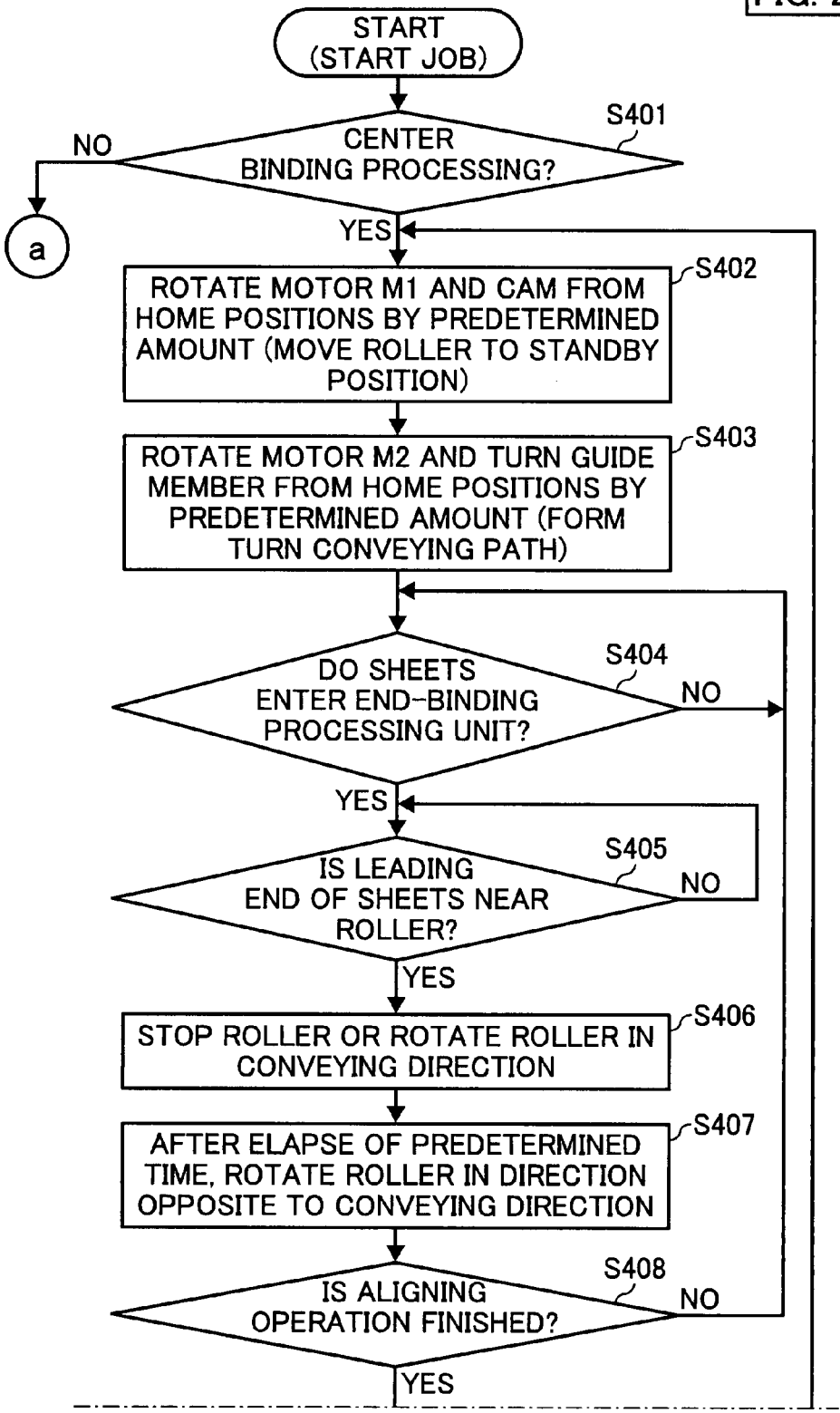
FIG. 26A is a flowchart of a processing procedure during center binding processing in an overall control procedure of the sheet processing apparatus according to the third embodiment.
Figure 26A:
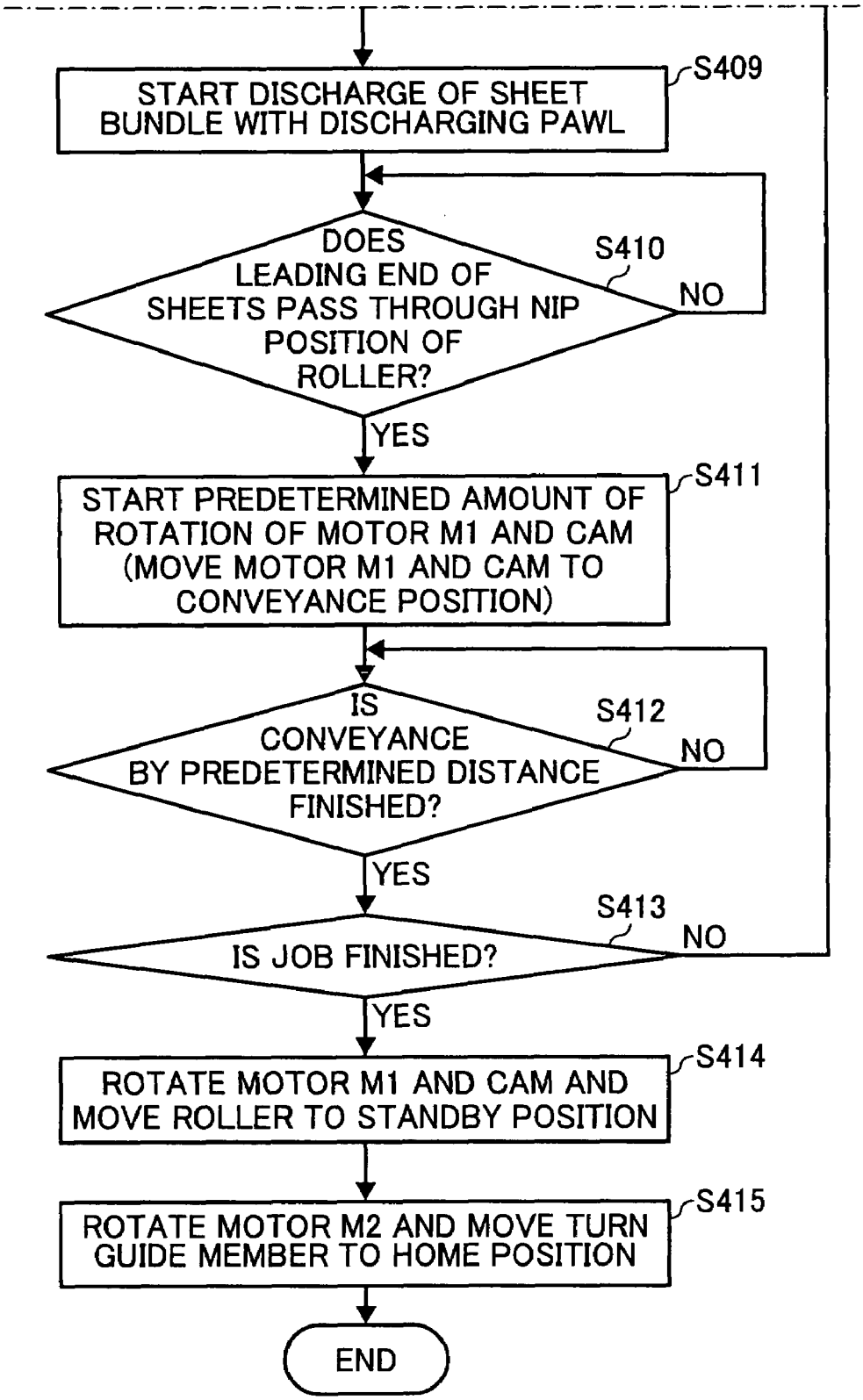
Figure 26B:
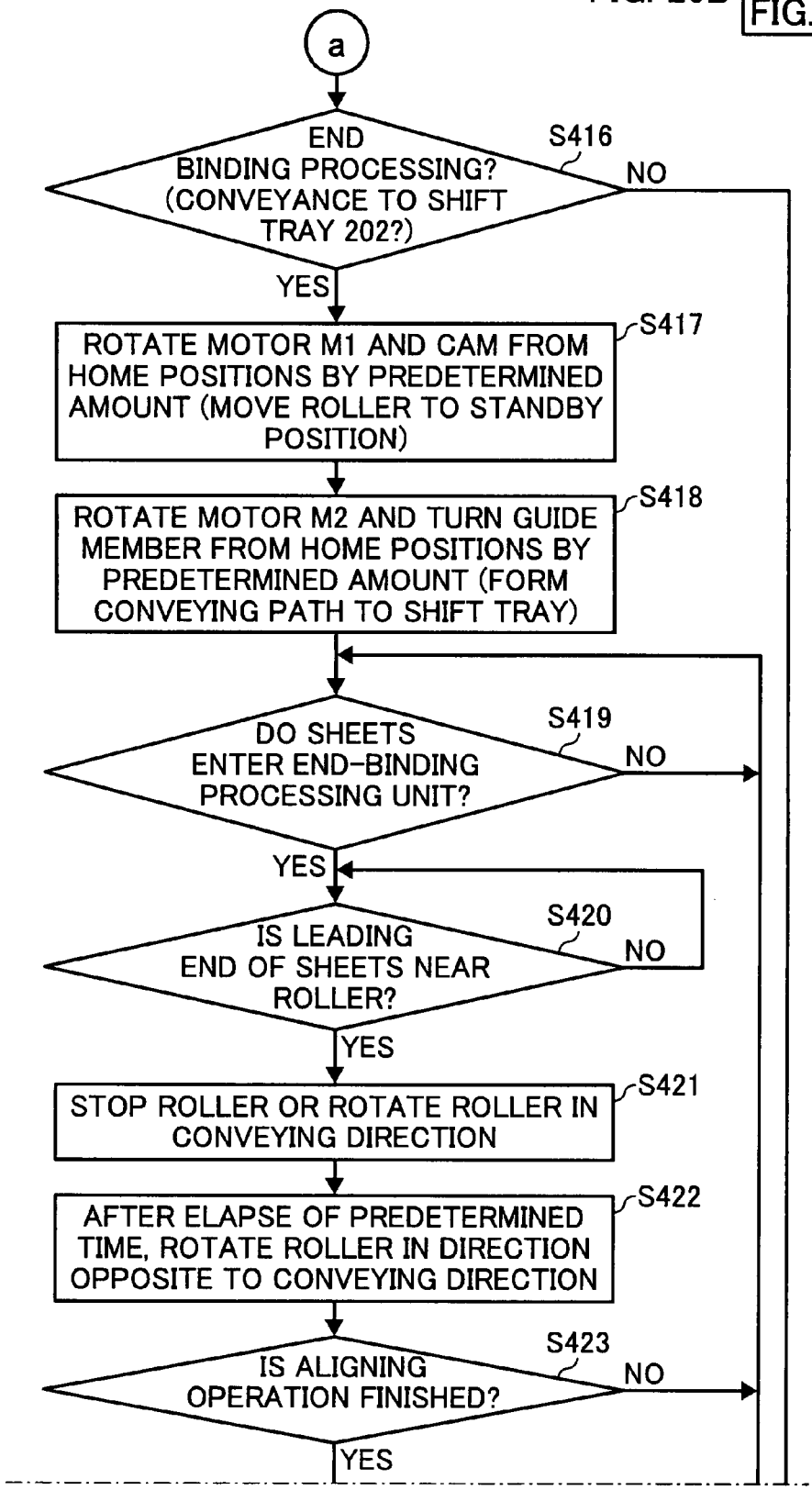
FIG. 26B is a flowchart of a processing procedure at the time when the center binding processing in the overall control procedure is not performed in the sheet processing apparatus according to the third embodiment.
Figure 26B:
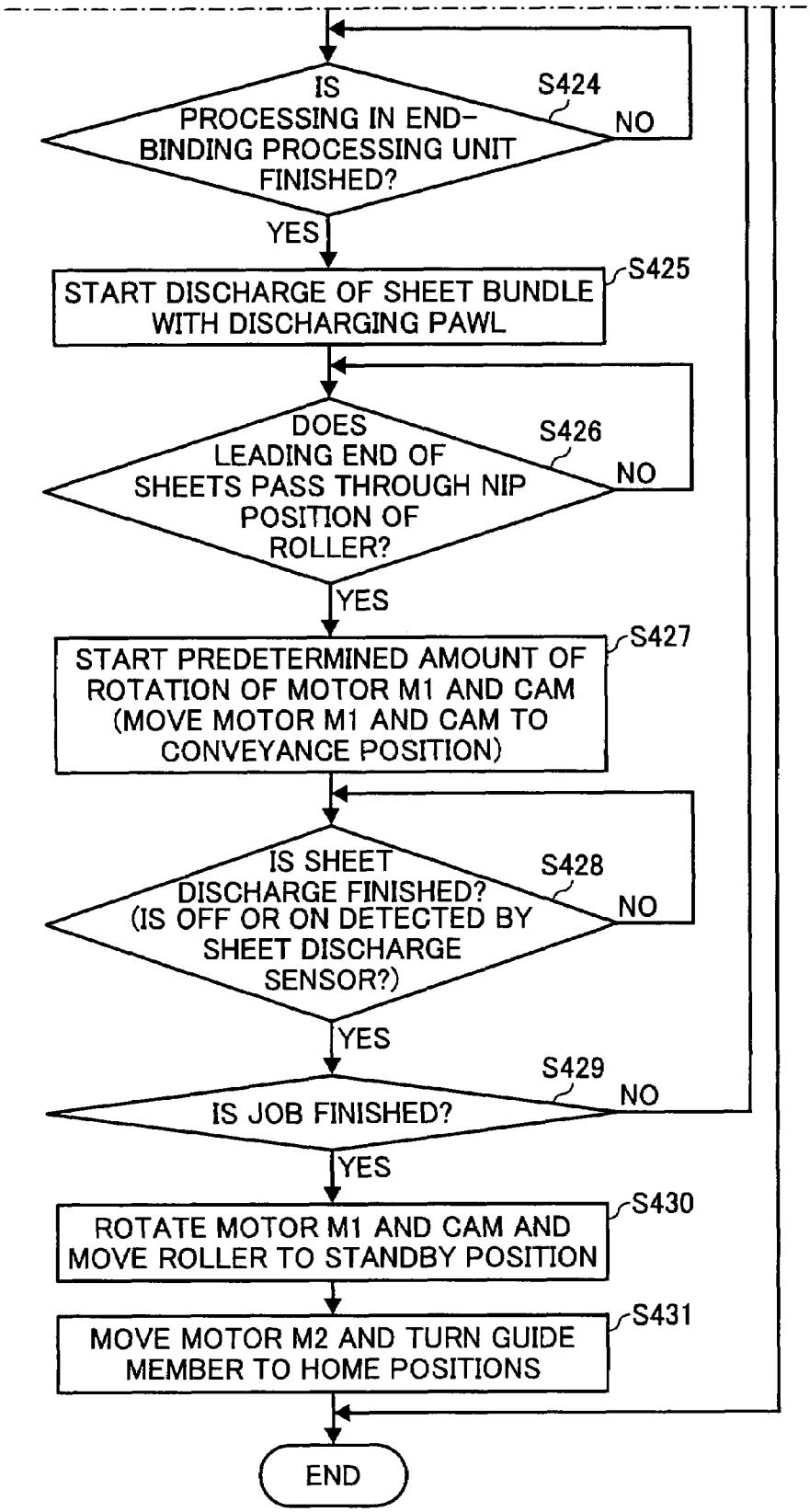

FIGS. 26A and 26B are flowcharts of an overall control procedure in the sheet processing apparatus PD according to the third embodiment.

In FIG. 26A, when a job is started, first, the CPU 360 checks whether center binding processing is performed (step S401). When the center binding processing is performed, the CPU 360 rotates the motor M1 and the cam 605 from the home positions by the predetermined amount to move the roller 601 to the standby position (step S402). The CPU 360 rotates the motor M2 and the turn guide member 609 from the home positions by the predetermined amount to form a turn conveying path (step S403). When sheets enters the end-binding processing tray F (YES at step S404) and a leading end of the sheets reaches the roller 601 or near the roller 601 (YES at step S405), the CPU 360 stops the roller 601 or rotates the roller 601 in the sheet conveying direction (step S406). When a predetermined time has elapsed after the rotation, the CPU 360 rotates the roller 601 in the direction opposite to the conveying direction (step S407). The CPU 360 waits for finish of an aligning operation while repeating the processing at step S404 and the subsequent steps.

When the aligning operation is finished (YES at step S408), the CPU 360 starts an operation for discharging the sheet stack by the discharging pawl 52*a* (step S409). When the leading end of the sheets passes through the nip position of the roller 601 (step S410), the CPU 360 starts rotation of the motor M1 and the cam 605 by the predetermined amount (step S411). When conveyance by a predetermined conveyance distance is finished (step S412), the CPU 360 repeats the processing at step S402 and the subsequent steps until the job is finished. When the job is finished (step S413), the CPU 360 rotates the motor M1 and the cam 605 to move the roller 601 to the standby position (step S414). Moreover, the CPU 360 rotates the motor M2, moves the turn guide member 609 to the home position (step S415), and finishes the processing.

On the other hand, when the job is not center binding at step S401, the CPU 360 shifts to the flowchart in FIG. 26B and checks whether the job is end binding processing (step S416). When the job is not end binding processing, the CPU 360 leaves this flowchart. When the job is end binding processing, the CPU 360 rotates the motor M1 and the cam 605 from the home positions by the predetermined amount to move the roller 601 to the standby position (step S417). The CPU 360 rotates the turn guide member 609 from the home position by the predetermined amount to form a conveying path to the shift tray 202 (step S418). When the sheets enter the end-binding processing tray F (YES at step S419) and the leading end of the sheets reaches the roller 601 or near the roller 601 (YES at step S420), the CPU 360 stops the roller 601 or rotates the roller 601 in the sheet conveying direction (step S421). When a predetermined time has elapsed after the rotation, the CPU 360 rotates the roller 601 in the direction opposite to the conveying direction (step S422). The CPU 360 waits for finish of the aligning operation while repeating the processing at step S419 and the subsequent steps (step S423).

When the aligning operation is finished (YES at step S423) and the processing in the end-binding processing tray F is finished (step S424), the CPU 360 starts an operation for discharging the sheet stack with the discharging pawl 52*a* (step S425). When the leading end of the sheets passes through the nip position of the roller 601 (step S426), the CPU 360 starts rotation of the motor M1 and the cam 605 by the predetermined amount to move the roller 601 to the sheet conveyance position (step S427). When the sheet discharge is finished (step S428), the CPU 360 repeats the processing at step S419 and the subsequent steps until the job is finished. When the job is finished (step S429), the CPU 360 rotates the motor M1 and the cam 605, and moves the roller 601 to the standby position (step S430). Moreover, the CPU 360 rotates the motor M2, moves the turn guide member 609 to the home position (step S431), and finishes the processing.

In the above explanation, the representative roller is explained as the conveying unit. However, it is possible to obtain the same effective when the conveying unit is a belt.

As described above, according to the third embodiment, in the conveying mechanism of the sheet processing apparatus, after the leading end of the sheets passes the conveying roller, the conveying roller is reversely rotated and a plurality of sheets are dropped into the trailing end fence to align the sheets in the sheet conveying direction. Consequently, a sheet processing mechanism that enables more highly accurate sheet alignment is provided.

A fourth embodiment of the present invention is different from the first embodiment in that a rotation fulcrum of the conveying roller of the conveying mechanism 600 is adjustable according to a stacked quantity of sheets and a type of the sheets and a movable conveyance support member is provided at the tip of the conveying roller.

Figure 27:
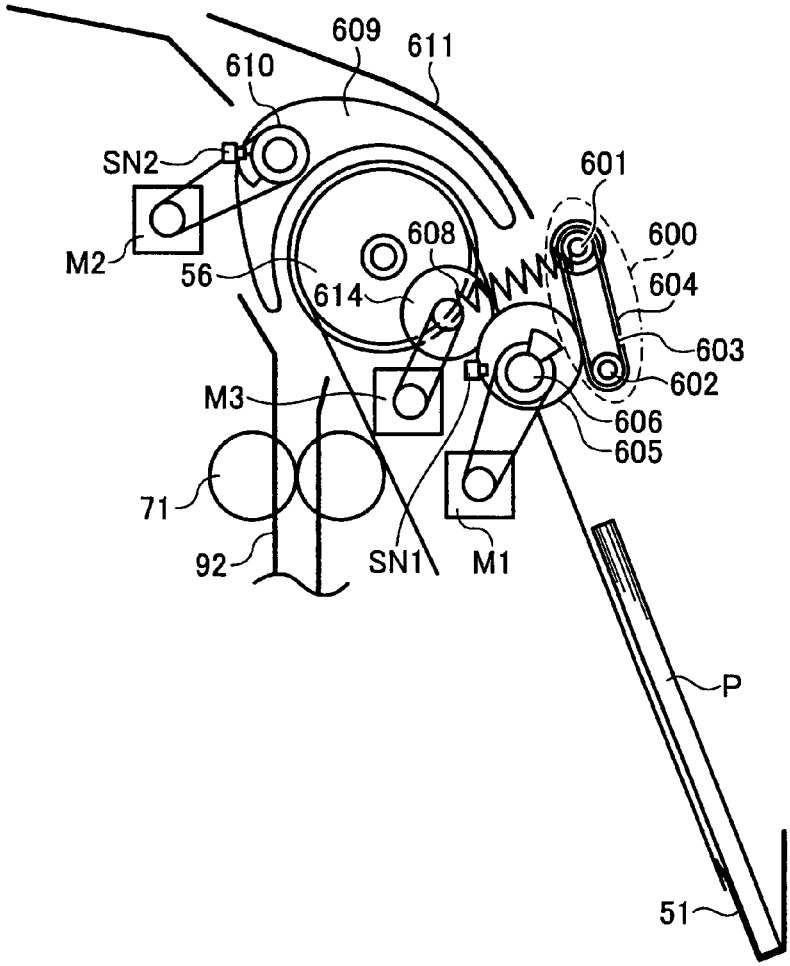
FIG. 27 is an enlarged diagram of a main part of a section of an end-face-binding processing tray and a folding processing tray in a sheet processing apparatus according to a fourth embodiment of the present invention.
Figure 28:
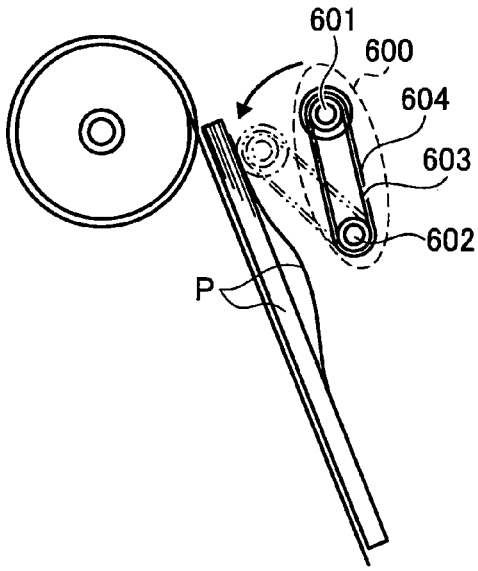
FIG. 28 is a diagram of a relation among a roller of a conveying mechanism, a discharging roller, and a sheet stack in the sheet processing apparatus according to the fourth embodiment.
Figure 29:
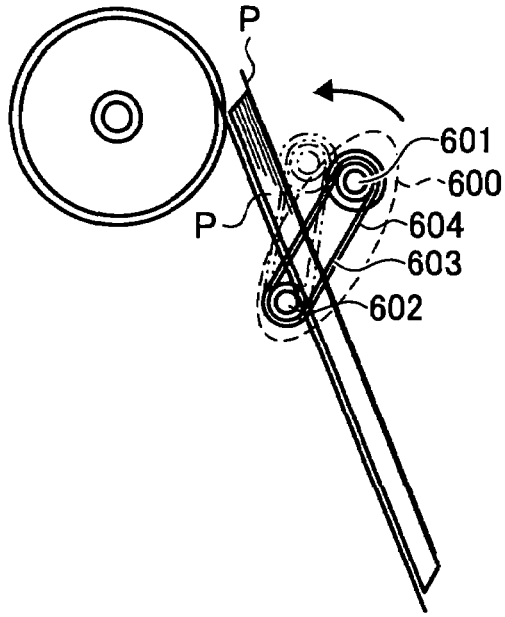
FIG. 29 is a diagram of a state in which a conveying force of the conveying mechanism varies in the sheet processing apparatus according to the fourth embodiment.
Figure 30:
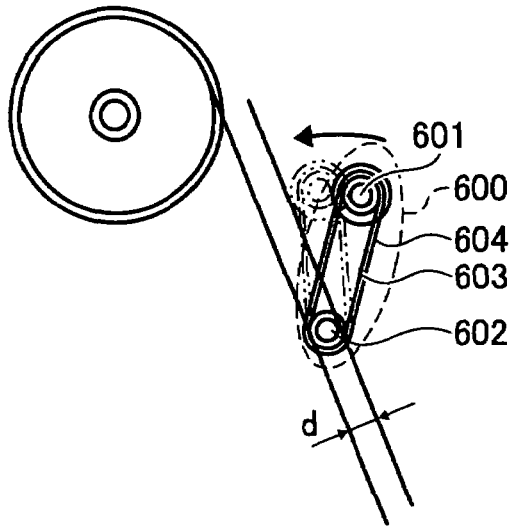
FIG. 30 is a diagram of another example of the relation among the roller of the conveying mechanism, the discharging roller, and the sheet stack in the sheet processing apparatus according to the fourth embodiment.

As shown in FIG. 27, when sheet-like recording media are aligned in the end-binding processing tray F, the conveying mechanism 600 is located in a position where the roller 601 is retracted. After the alignment of the sheet-like recording media is finished, the sheet stack P is lifted by the discharging pawl 52*a* and the roller 601 is brought into contact with the sheet stack P with the driving shaft 602 of the conveying mechanism 600 as a swing fulcrum. In this case, a rotation locus of the roller 601 changes depending on a position of the driving shaft 602. For example, as shown in FIG. 28, when the driving shaft 602 is located above the sheet stack P, a locus of the roller 601 coming into contact with the sheet stack P is in the direction opposite to the conveying direction of the sheet-like recording media. As a result, a sheet at the top of the sheet-like recording media may be shifted in the direction opposite to the conveying direction. Conversely, as shown in FIG. 29, when the driving shaft 602 is located below the sheet stack P, a locus of the roller 601 coming into contact with the sheet stack P is in the conveying direction of the sheet-like recording media. As a result, a sheet at the top of the sheet-like recording media may be shifted in the conveying direction. Therefore, to minimize the shift of the sheet-like recording media that occurs when the roller 601 comes into contact with the sheet-like recording media at the start of conveyance of the sheet stack P, as shown in FIG. 30, taking into account conveyable thickness d of the sheet stack P, it is necessary to locate the driving shaft 602 within a range of the thickness d or thickness close to the thickness d. In other words, it is necessary to bring the roller 601 into contact with the sheet stack P from a direction substantially perpendicular to the upper surface of the sheet stack P. When the roller 601 is brought into contact with the sheet stack P in this way, a component of force is not generated in a direction parallel to the upper surface of the sheet stack P. Even if a component of force is generated, the component of force is extremely small. Thus, the sheet stack P or the sheet-like recording medium at the top of the sheet stack P does not move as shown in FIGS. 28 and 29. More specifically, if the horizontal component of force is smaller than a frictional force between the surfaces of the sheet-like recording media, the sheet stack P keeps the state of alignment on the end-binding processing tray F.

As described above, according to the fourth embodiment, it is possible to adjust an aligning force (an aligning force in the conveying direction) applied to the sheet-like recording media according to a position where the roller 601 is pressed against the sheet stack P (an alignment position). Thus, the aligning force is changed and adjusted according to states of the sheet-like recording media such as the number of the sheet-like recording media, a type of the sheet-like recording media, and an image mode (types of images such as black and white, color, character, and pattern and a printing ratio). The alignment position is a distance of the roller 601 from the end-binding processing tray F. The aligning force applied to the sheet-like recording media by the roller 601 changes according to this distance. The aligning force applied to the sheet-like recording media is stronger as the position of alignment by the roller 601 is closer to the end-binding processing tray F. The aligning force needs to be adjusted in the following three cases.

It is necessary to increase the aligning force when a friction force of image surfaces is small or when sheets to be aligned are heavy (thick paper). The frictional force is small when, for example, a ratio of a printed image in a sheet-like recording medium, a so-called printing ratio is high.

It is necessary to decrease the aligning force when a frictional force of image surfaces is large or when sheets to be aligned are light (thin paper). The frictional force of image surface is large when, for example, a printing ratio is low.

It is necessary to apply a stable aligning force regardless of the number of sheets. When the number of sheets is small, the sheet-like recording media are aligned in a position where the roller 601 is close to the end-binding processing tray F. As the number of sheets increases, the sheet-like recording media are aligned in a position where the roller 601 is further apart from the end-binding processing tray F.

In these cases, setting of a level of a conveying force and a distance from the end-binding processing tray F is change according to a type of the sheet-like recording media, the thickness of the sheet-like recording media, a printing ratio, and the like. The CPU 360 judges the change according to the various kinds of information inputted from the image forming apparatus PR. The CPU 360 sets a distance from the end-binding processing tray F and rotates the cam 605 via the motor M1 to change the setting. In this case, distances at a plurality of stages are set in advance according to states of the sheet-like recording media and any one of the stages is selected according to information on the sheet-like recording media. This makes it possible to perform adjustment relatively easily.

Figure 31:
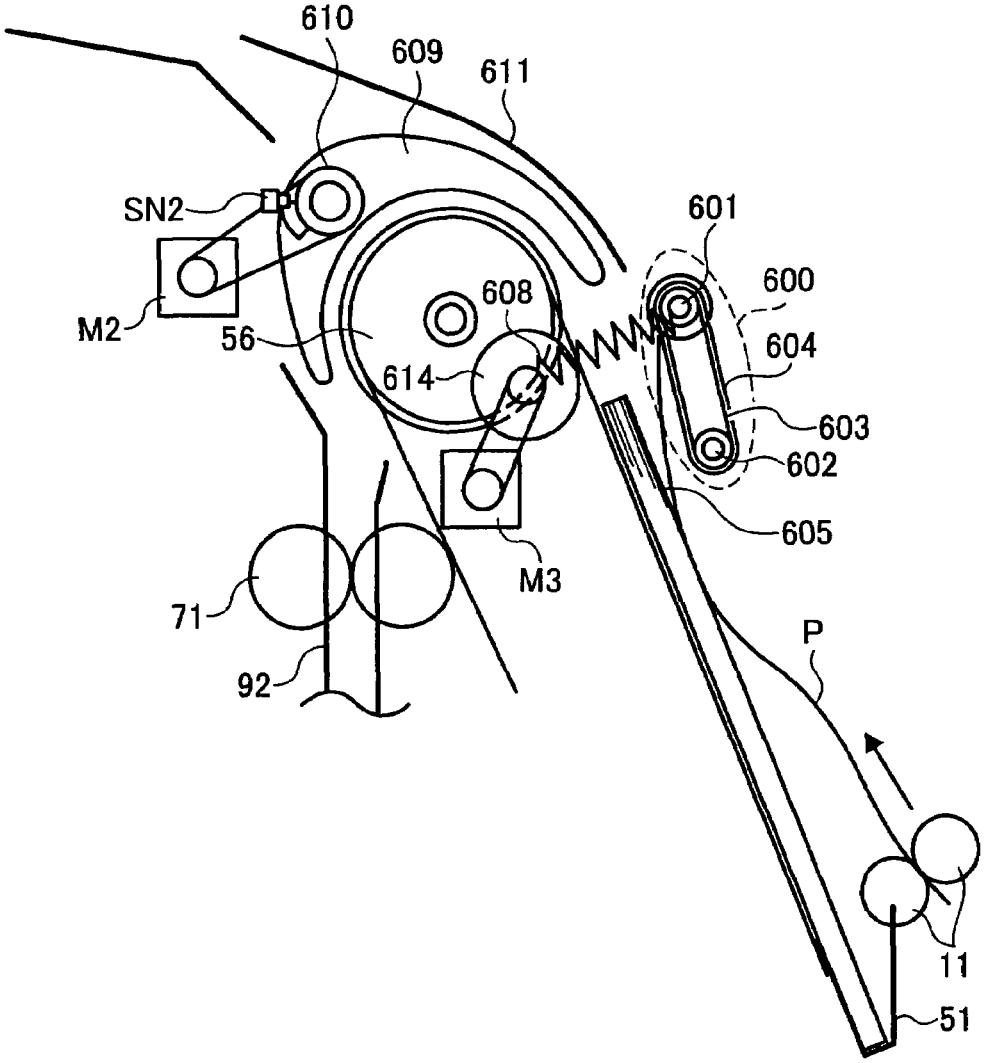
FIG. 31 is a diagram of a state in which sheet-like recording media are conveyed into an end-binding processing tray and a leading end of the sheet-like recording media comes into contact with the conveying mechanism to cause bend in the sheet processing apparatus according to the fourth embodiment.
Figure 32:
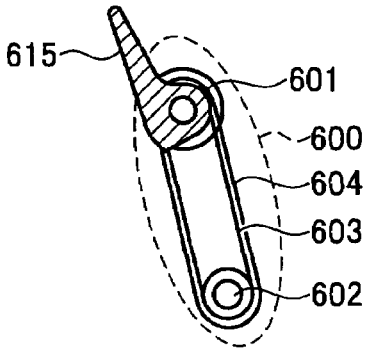
FIG. 32 is a diagram of a state in which a conveyance support member is provided in the conveying mechanism in the sheet processing apparatus according to the fourth embodiment.

In FIG. 31, when the sheet-like recording media are aligned by the end-binding processing tray F, the conveying mechanism 600 is located in a position where the roller 601 is retracted. However, when the sheet-like recording media are aligned, depending on a state of curl of the sheet-like recording media, the leading end of the sheet-like recording media entering the end-binding processing tray F comes into contact with the roller 601 of the conveying mechanism 600. As a result, the sheet-like recording media may be buckled to deteriorate an alignment quality of the sheet stack P. Thus, in this embodiment, to prevent the sheet-like recording media from coming into contact with the roller 601, a conveyance support member 615 shown in FIG. 32 is provided. The conveyance support member 615 has a function of preventing the leading end of the sheet-like recording media conveyed from coming into contact with a section for contact with the sheet-like recording medium of the roller 601.

Figure 33:
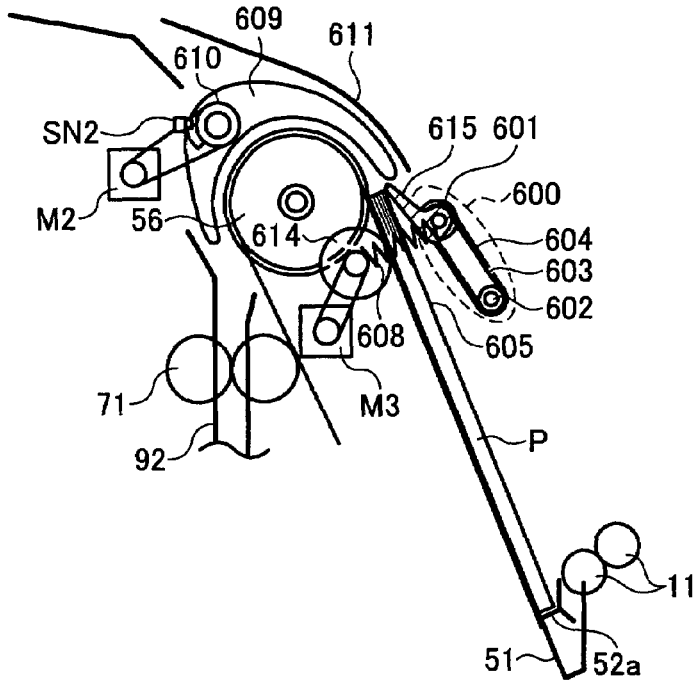
FIG. 33 is a diagram of a state of a turn conveying unit in which a leading end of a sheet stack is pressed by the conveyance support member when the sheet stack is conveyed to a center-binding processing tray side in the sheet processing apparatus according to the fourth embodiment.
Figure 34:
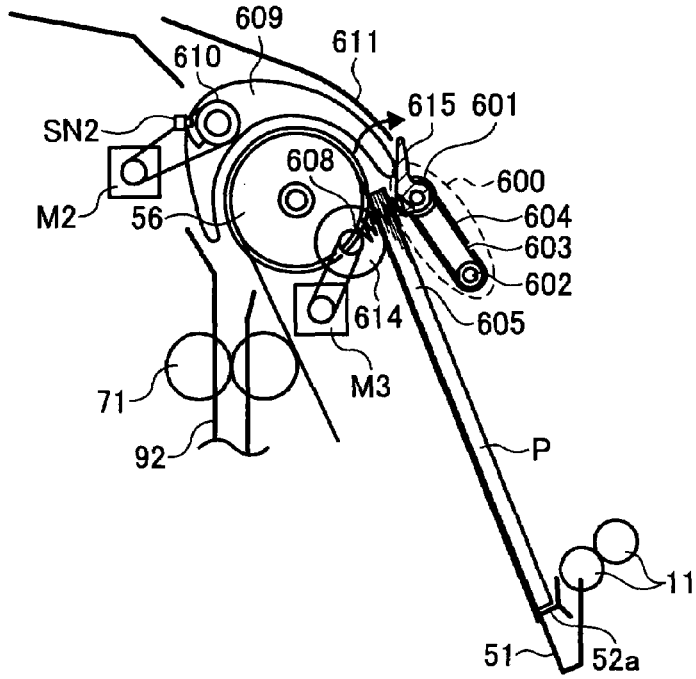
FIG. 34 is a diagram of a state of the turn conveying unit at the time when the sheet stack is conveyed to the center-binding processing tray side in the sheet processing apparatus according to the fourth embodiment.
Figure 35:
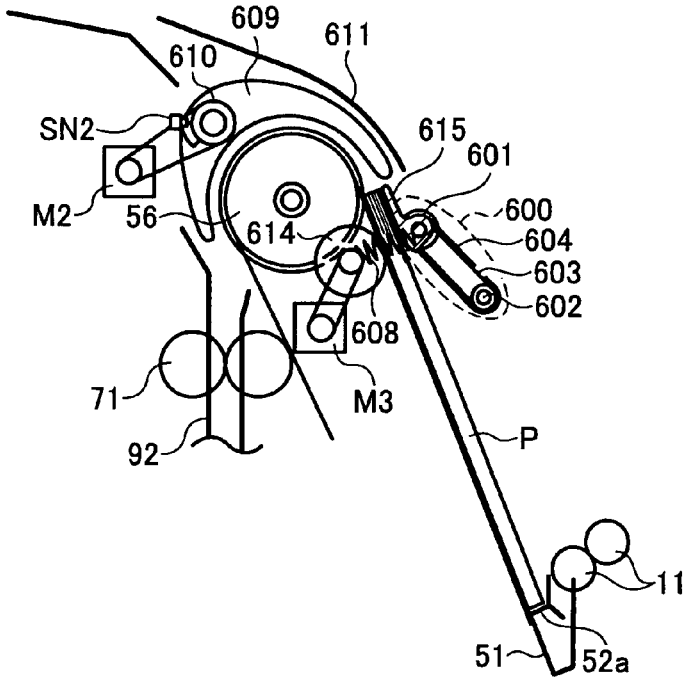
FIG. 35 is a diagram of a state of the conveyance support member of the conveying mechanism in the turn conveying unit at the time when the sheet stack is conveyed to the center-binding processing tray side in the sheet processing apparatus according to the fourth embodiment.

As shown in FIG. 33, when conveyance of the sheet-like recording media is started or when the sheet-like recording media are conveyed, if the conveyance support member 615 provided near the roller 601 of the conveying mechanism 600 (coaxially with the roller 601) is fixed, the conveying mechanism 600 rotates around the driving shaft 602. Thus, when the roller 601 is brought into contact with the sheet stack P, the conveyance support member 615 presses the sheet stack P and generates a conveyance resistance against the sheet stack P. Therefore, the conveyance support member 615 is allowed to freely rotate with respect to the conveying mechanism 600. Consequently, as shown in FIG. 34, the conveyance support member 615 is lifted by the turn guide member 609 when the sheet stack P is conveyed. Alternatively, the conveyance support member 615 is made of an elastic material. When an excessively large force (a reaction force) is generated, the conveyance support member 615 elastically deforms. Thus, even if the conveyance support member 615 comes into contact with the surface of the sheet stack P, it is possible to prevent the conveyance support member 615 from generating a large conveyance resistance.

The conveyance support member 615 is capable of freely rotating with respect to the conveying mechanism 600. The conveyance support member 615 is elastically urged in the counterclockwise direction in FIG. 32 by, for example, a helical torsion coil spring. In an initial state, as shown in FIG. 33, the tip of the conveyance support member 615 comes into contact with the leading end of the sheet stack P to prevent the roller 601 from coming into contact with the sheet stack P. However, when the sheet stack P is conveyed, the conveyance support member 615 needs to rotate in the clockwise direction as shown in FIG. 34 with a reaction force from the sheet stack P side generated by the elastic force of the elastic member 608 and allow the roller 601 to come into contact with the sheet stack P. Therefore, an elastic urging force applied to the conveyance support member 615 is set in a range in which the conveyance support member 615 comes into contact with the leading end of the sheet stack P in the initial state and allows the roller 601 to come into contact with the sheet stack P when the sheet stack P is conveyed. When elasticity of the conveyance support member 615 itself is used, an elastic urging force is set in the same manner.

Figure 36:
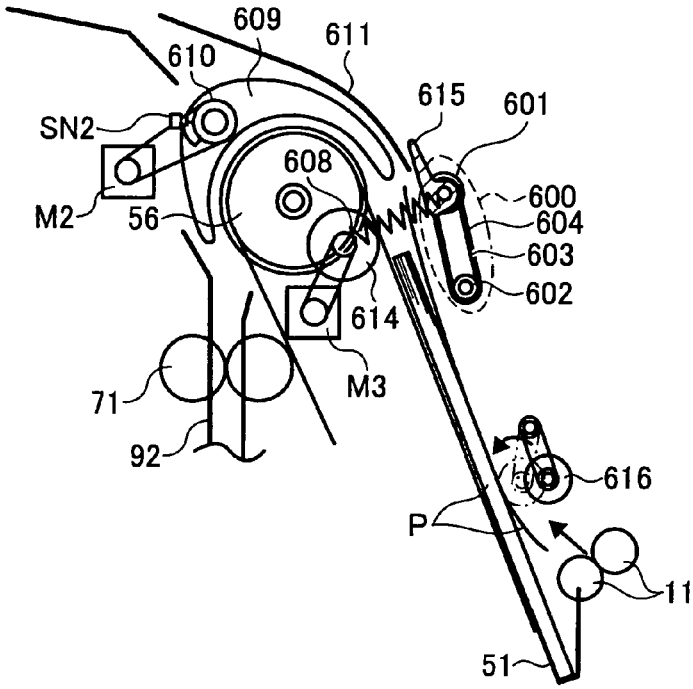
FIG. 36 is a diagram of a state in which the sheet-like recording media are aligned by a tapping roller in the sheet processing apparatus according to the fourth embodiment.

When the sheet-like recording media are aligned in the conveying direction in the end-binding processing tray F, as shown in FIG. 36, the sheet-like recording media are sent back in the trailing end fence 51 direction by a tapping roller 616 and aligned. However, when a force for sending back the sheet-like recording media in the trailing end fence 51 direction with a conveying force of the tapping roller 616 is insufficient, as shown in FIG. 37, it is also possible to send back the sheet-like recording media according to the rotation of the roller 601 of the conveying mechanism 600.

Figure 37:
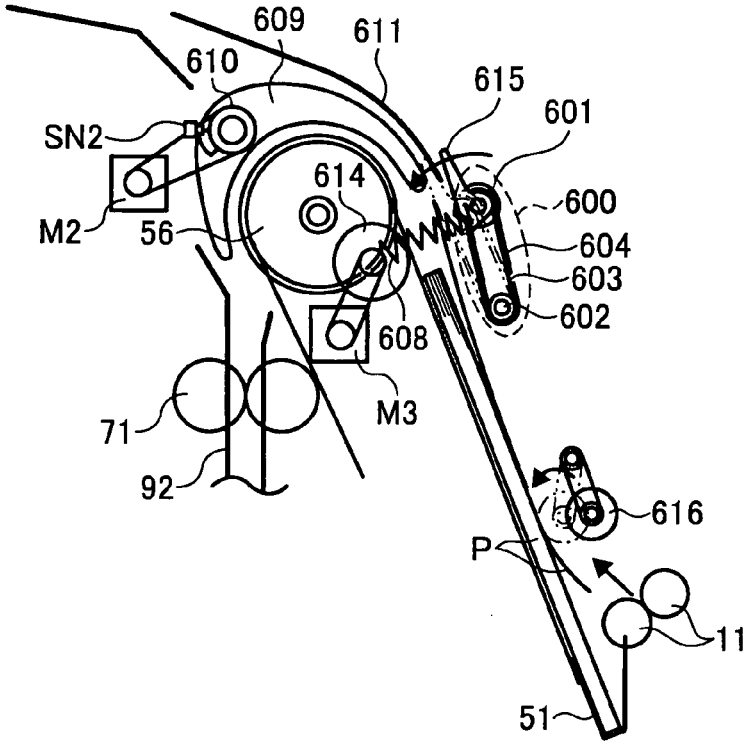
FIG. 37 is a diagram of a state at the time when the sheet-like recording media are aligned by the tapping roller and the conveying mechanism in the sheet processing apparatus according to the fourth embodiment.

When the sheet-like recording media are sent back in the trailing end fence 51 direction by reversely rotating the roller 601 of the conveying mechanism 600 as shown in FIG. 37, it is possible to control, according to an amount of rotation around the driving shaft 602 of the conveying mechanism 600, a force of the roller 601 coming into contact with the sheet-like recording media. When the sheet-like recording media are sent back in the trailing end fence 51 direction according to the rotation of the roller 601 of the conveying mechanism 600, it is also possible to control a conveying force applied to the sheet-like recording media by the roller 601 by discontinuously rotating the roller 601 of the conveying mechanism 600. Moreover, the control may be performed each of the sheet-like recording media conveyed to the end-binding processing tray F. However, even if the control is performed for each plurality of sheets taking into account durability of the driving shaft 602 of the conveying mechanism 600, it is possible to send back the sheet-like recording media in the trailing end fence 51 direction and align the sheet-like recording media. According to the control, it is possible to prevent the sheet-like recording media from being sent back excessively and improve an alignment quality.

When the sheet-like recording media are sent back to the trailing end fence 51 by the roller 601 of the conveying mechanism 600 and aligned, a necessary conveying force applied to the sheet-like recording media by the roller 601 changes according to friction that depends on an image state on the surfaces of the sheet-like recording media. A position where the roller 601 and the sheet-like recording media come into contact with each other changes according to the number of the sheet-like recording media, the thickness of the sheet-like recording media, and the like. Therefore, the image states such as a color mode or a monochrome mode and a ratio of an image in the sheet like recording media are obtained from the image forming apparatus PR. When it is considered based on the information that friction on the surfaces of the sheet-like recording media is low, a force of the roller 601 coming into contact with the sheet-like recording media is increased. It is also possible to obtain information such as the number and the thickness of the sheet-like recording media from a signal of a sheet-like recording media sensor or the like of the image forming apparatus or the sheet processing apparatus. Thus, it is possible to adjust, based on the information, a position where the roller 601 comes into contact with the sheet-like recording media. The position where the roller 601 comes into contact with the sheet-like recording media may be a position in a state set in advance when a product is shipped or may be set or adjusted after the shipment.

Figure 38:
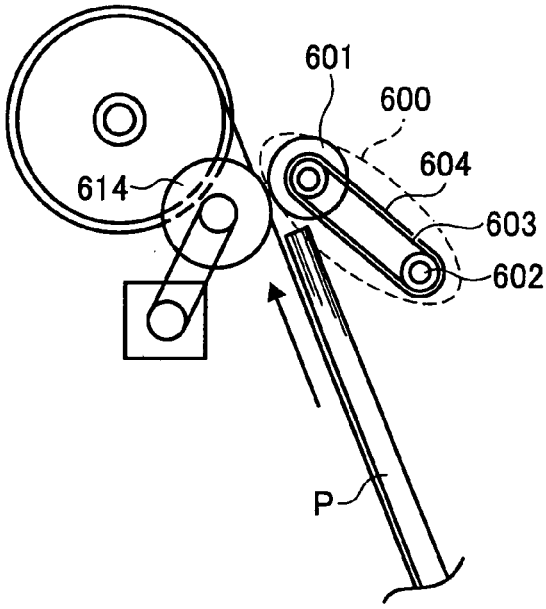
FIG. 38 is a diagram of a state in which the sheet stack is lifted by a discharging pawl and brought into a nip between the roller of the conveying mechanism and a roller opposed to the roller of the conveying mechanism in the sheet processing apparatus according to the fourth embodiment.

When the sheet-like recording media aligned in the end-binding processing tray F are conveyed to the center binding and folding processing tray G, as shown in FIG. 38, the sheet stack P is lifted by the discharging pawl 52*a* and sent into a nip formed by the roller 601 of the conveying mechanism 600 and the driving roller 614 opposed to the roller 601. In this case, the thick sheet stack P enters the narrow nip between the roller 601 and the driving roller 614. Thus, a trace of the roller may be left at the leading end of the sheet stack P or an alignment state of the sheet stack P is deteriorated.

Figure 39:
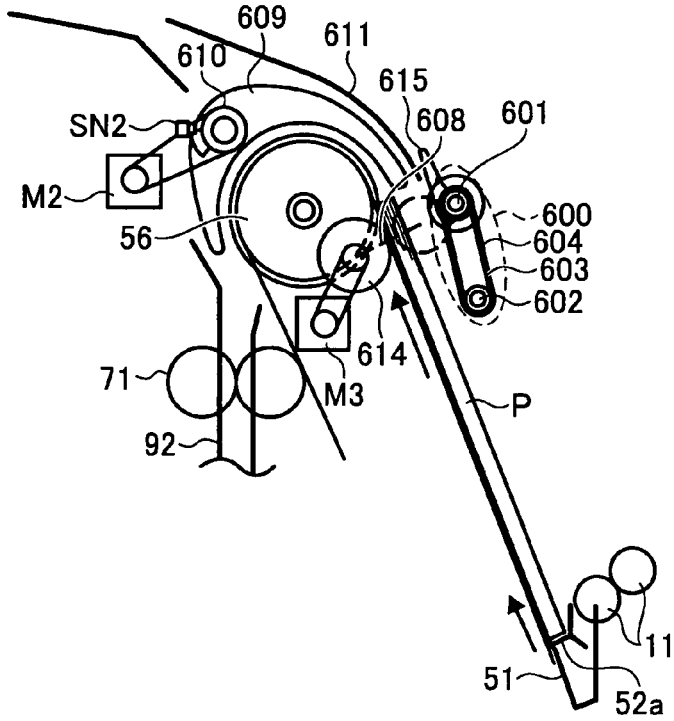
FIG. 39 is a diagram of a state in which the sheet stack, for which alignment processing is finished, is lifted by the discharging pawl and a leading end of the sheet-like recording media is brought into the opened nip between the roller of the conveying mechanism and the roller opposed to the roller of the conveying mechanism.
Figure 40:
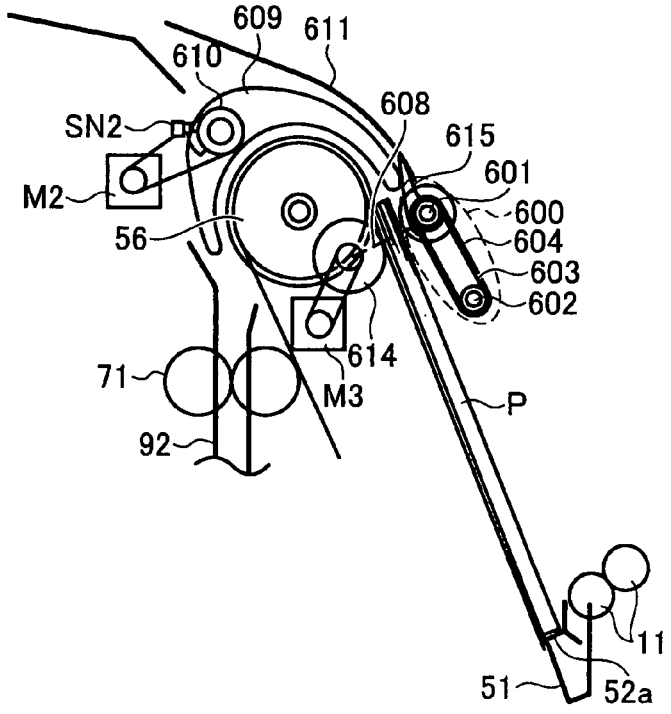
FIG. 40 is a diagram of a state in which the nip between the rollers is closed and a conveying force is applied to the sheet stack in the state in FIG. 39 in the sheet processing apparatus according to the fourth embodiment.

Thus, as shown in FIGS. 39 and 40, the sheet stack subjected to the alignment processing is lifted by the discharging pawl 52*a*. The leading end of the sheet-like recording media opens the nip between the roller 601 of the conveying mechanism 600 and the driving roller 614 opposed to the roller 601. After the leading end of the sheet-like recording media passes the opened nip, the roller 601 is brought into contact with the sheet-like recording media to convey the sheet-like recording media with the roller 601 and the driving roller 614.

Figure 41:
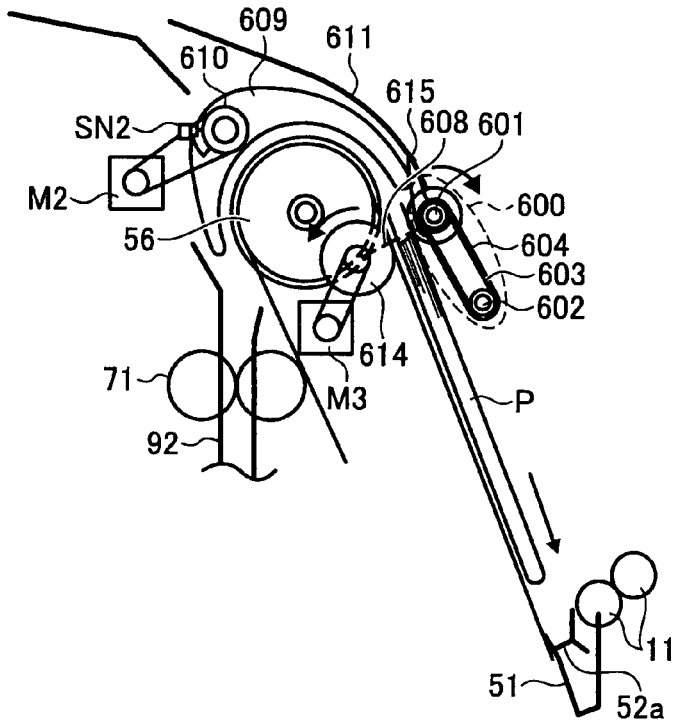
FIG. 41 is a diagram of a state in which, when the sheet stack is conveyed by the roller of the conveying mechanism, the sheet-like recording media on an inner side between a front surface and a rear surface of the sheet stack cannot be conveyed and slips down in a direction opposite to the conveying direction in the sheet processing apparatus according to the fourth embodiment.
Figure 42:
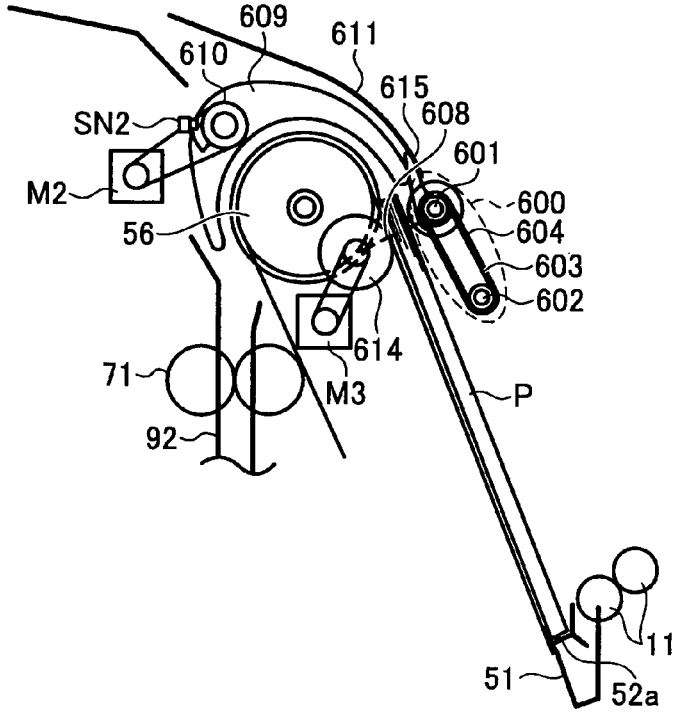
FIG. 42 is a diagram of a state in which, when the sheet stack is conveyed by the roller of the conveying mechanism, the sheet stack is conveyed by being caused to cooperate with the discharging pawl in the sheet processing apparatus according to the fourth embodiment.
Figure 43:
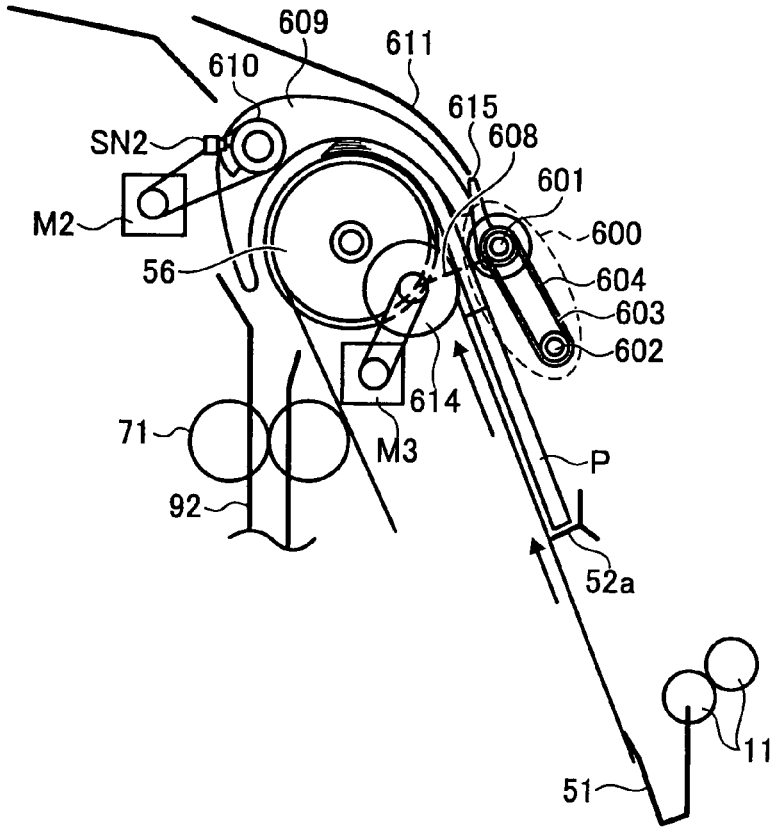
FIG. 43 is a diagram of a state in which the sheet stack is deflected by a turn guide member in the state in FIG. 42 and conveyed to the center-binding processing tray side in the sheet processing apparatus according to the forth embodiment.

Depending on an image state of the sheet-like recording media conveyed from the image forming apparatus PR, friction on the surfaces of the sheet-like recording media may excessively fall. In such a case, when the sheet-like recording media are aligned to form a stack, friction among the sheet-like recording media is low. Thus, when the sheet stack P is conveyed by the roller 601 of the conveying mechanism 600, as shown in FIG. 41, the sheet-like recording media on the inner side between the surface and the rear surface of the sheet stack P may be unable to be conveyed and stop or may be slip down in the direction opposite to the conveying direction. Therefore, even after the discharging pawl 52*a* lifts the trailing end of the sheet stack P to the position of the nip formed by the roller 601 of the conveying mechanism 600 and the driving roller 614 opposed to the roller 601 as shown in FIG. 42, as shown in FIG. 43, the sheet-like recording media are moved at speed identical with speed of the conveyance performed by the roller 601 and the driving roller 614 while the a trailing end thereof is supported. This makes it possible to surely convey the sheet stack P.

In this case, if operation speed of the discharging pawl 52*a* is higher than conveying speed of the roller 601 even a little, the discharging pawl 52*a* may sink in the trailing end of the sheet stack P to cause scratches on the sheet-like recording media. Thus, the operation speed of the discharging pawl 52*a* may be set lower than the conveying speed of the sheet stack P. If the discharging pawl 52*a* is started to move with a time difference from the start of the conveyance of the sheet stack P by the roller 601, since a gap is formed between the discharging pawl 52*a* and the sheet stack P, it is possible to prevent the scratches on the sheet stack P. Alternatively, the discharging pawl 52*a* may be caused to operate while being a fixed distance apart from the trailing end of the sheet stack P. In this case, when the conveying force by the roller 601 falls and the sheet stack P shifts downward, the conveying force of the discharging pawl 52*a* can be supplementarily applied to the sheet stack P.

The sheet stack P is conveyed by the roller 601 or the conveying mechanism 600 and the driving roller 614 while the trailing end of the sheet stack P is supported by the discharging pawl P. In this case, the discharging pawl 52*a* needs to support the trailing end of the sheet stack P until the sheet stack P is surely conveyed. Therefore, when an operation locus of the discharging pawl 52*a* is hindered by the conveying mechanism 600, the roller 601, and the like, the operation of the discharging pawl 52*a* has to be stopped before the sheet stack P is sufficiently conveyed by the roller 601. As a result, the sheet stack cannot be surely conveyed. Therefore, in this embodiment, as shown in FIG. 44, the conveying mechanism 600 does not hinder the operation locus of the discharging pawl 52*a* whatever position and posture the conveying mechanism 600 takes.

Figure 44:
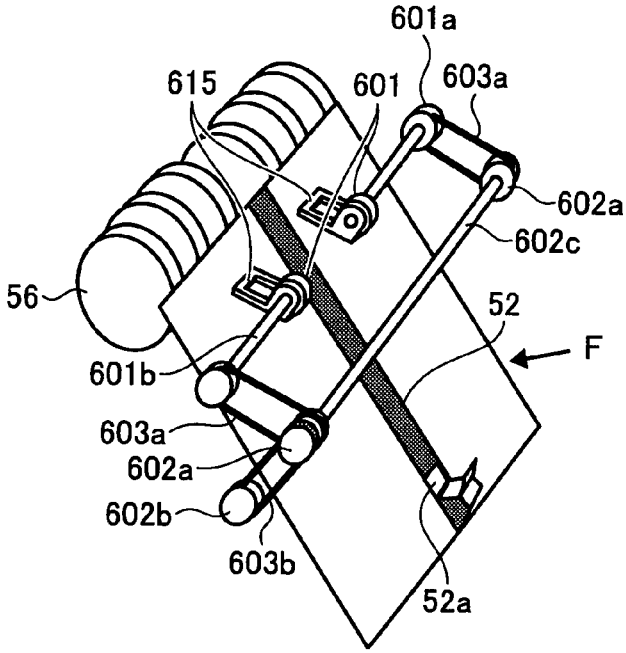
FIG. 44 is a diagram of an example of a conveying mechanism constituted not to interfere with the discharging pawl in the sheet processing apparatus according to the fourth embodiment.

In FIG. 44, the conveying mechanism 600 includes a pair of rollers 601 spaced apart across the discharging belt 52 and provided on both sides of the end-binding processing tray F, pulleys 601*a* provided via roller rotation shafts 601*b*, respectively, on the outer sides of the end-binding processing tray F coaxially with the rollers 601, driving shaft pulleys 602*a* integrally coupled rotatably via a coupling shaft 602*c*, the arm 604 that supports the pulleys 601*a* and the driving shaft pulleys 602*a*, and timing belts 603*a* laid over between the pulleys 601*a* and the driving shaft pulleys 602*a*. Moreover, the conveying mechanism 600 includes a driving shaft pulley 602*b* driven by a motor (not shown) for driving the driving shaft pulleys 602*a* and a timing belt 603*b* for transmitting a driving force of the driving shaft pulley 602*b* to the driving shaft pulleys 602*a*. The coupling shaft 602*c* is separated from the end-face-binding processing tray F by a distance for preventing interference with the discharging pawl 52*a*. With such a structure, spaces enough for preventing interference of the discharging pawl 52*a* are secured in a section between the rollers 601, where the discharging pawl 52*a* moves, and a section vertically above the end-face-binding processing tray F. Thus, the operation of the discharging pawl 52*a* is not hindered.

When the conveying mechanism 600 is constituted as shown in FIG. 44, the driving shaft pulley 602*b* functions as a swing fulcrum of the conveying mechanism 600. If the driving shaft pulley 602*b* is set to be located in the range of the thickness d of the sheet stack P shown in FIG. 30 or a range of thickness close to the thickness d, shift of the sheet-like recording media does not occur as explained above. Even if shift of the sheet-like recording media occurs, the shift is the minimum.

Figure 45:
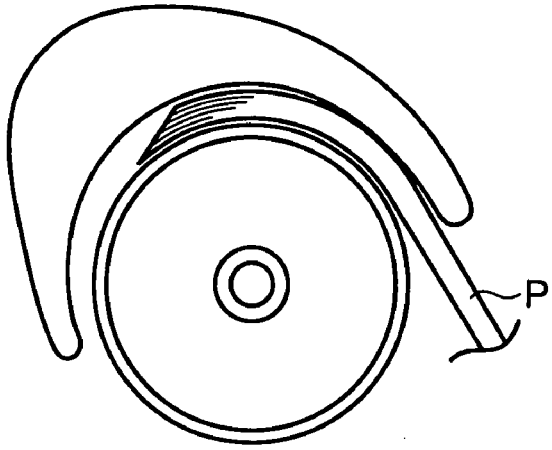
FIG. 45 is a state of a conveyance difference in the leading end of the sheet stack that occurs in the sheet stack between the turn guide member and the discharging roller in the sheet processing apparatus according to the fourth embodiment.
Figure 46:
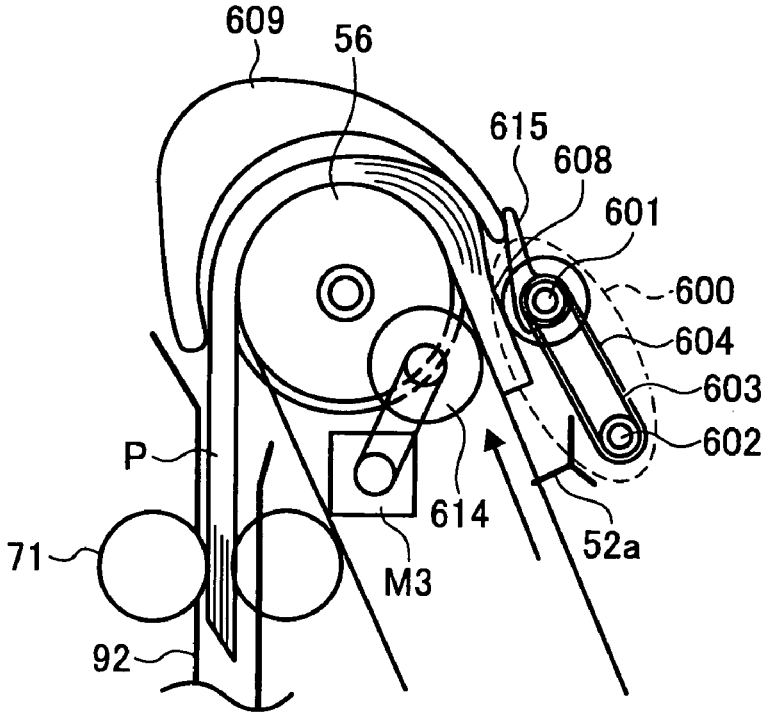
FIG. 46 is a diagram of a state in which the sheet stack is further conveyed while the conveyance difference is maintained in the state in FIG. 45 in the sheet processing apparatus according to the fourth embodiment.

As shown in FIG. 45, when the thick sheet stack P passes the turn section between the turn guide member 609 and the discharging roller 56, a conveyance difference occurs between the sheet-like recording media on the inner side and the outer side in the sheet stack P. Therefore, the leading end of the sheet-like recording media enters the pair of stack conveying rollers 71 located on the downstream side of the conveying mechanism 600 and the discharging roller 56. Thereafter, when the sheet stack P continues to be conveyed by the roller 601 of the conveying mechanism 600, the driving roller 614, and the pair of stack conveying rollers 71, the sheet stack P continues to be conveyed by the pair of stack conveying rollers 71 with the conveyance difference left therein and the conveyance difference does not occur at the trailing end of the sheet-like recording media P conveyed by the rollers 601 and the driving roller 614. Thus, as shown in FIG. 46, the outer side of the sheet stack P starts to bend in the turn section. Therefore, when the sheet stack P is conveyed while this state is maintained, wrinkles or the like may occur in the sheet stack.

To prevent this phenomenon, the conveyance by the conveying mechanism 600 is released when a fixed quantity of the sheet-like recording media are conveyed after the pair of stack conveying rollers 71 start the conveyance of the sheet stack P. Consequently, since the conveyance difference, which occurs when the sheet stack P is deflected in the turn section (along the turn guide member 609), naturally appears in the trailing end of the sheet stack P, it is possible to eliminate bend and wrinkles.

The conveyance difference, which occurs when the sheet stack P passes the turn section, is different depending on the thickness of the sheet stack P. In general, the conveyance difference is larger when the thickness of the sheet stack P is larger. When an area occupied by a color image or an image in the sheet-like recording media is large, friction on the surfaces of the sheet-like recording media falls. Thus, friction among the sheet-like recording media also falls and an amount of shift among the sheet-like recording media increases in the turn conveying path having a large conveyance resistance. Therefore, when it is predicted that the amount of shift becomes large from information on image states, timing when the roller 601 of the conveying mechanism 600 separates from the sheet stack P and stops applying a conveying force is set earlier than default timing. When it is judged from information such as the number and the thickness of the sheet-like recording media that the thickness of the sheet stack P is large, in the same manner as above, the timing when the roller 601 separates from the sheet stack P and stops applying a conveying force is set earlier than the default timing.

According to such a control, since the sheet-like recording media are not affected by the conveyance difference, it is possible to eliminate bend and wrinkles.

Shift that occurs when the leading end of the sheet-like recording media enters the stack conveying roller 71 (shift due to the conveyance difference between the inner side and the outer side of the turn guide member 609 and shift due to slip that occurs among the roller 601, the driving roller 614, and the sheet stack) increases or decreases depending on the states (the number of sheets, a type of the recording medium, an image mode, a printing ratio, etc.) of the sheet-like recording media. Thus, it is conceivable to adjust a quantity of conveyance by the roller 601 (timing for separating the roller 601 from the sheet stack after bringing the roller 601 into contact with the sheet-like recording media) when the quantity of conveyance by the roller 601 is reduced, i.e., when the timing for separating the roller 601 from the sheet stack is set to be earlier. In both the cases, leading end shift is large. When the thickness of the sheet stack is large, the conveyance difference between the inner side and the outer side of the turn increases. When friction on image surfaces is small (when images occupy a large area in the sheet-like recording media), since slip tends to occur between the roller 601 and the sheet-like recording media, an amount of shift of the leading end of the sheet stack increases. It goes without saying that the thickness of the sheet stack also increases, for example, when the number of sheets is large, when thick paper is mixed in the sheet-like recording media, and when an area of an image in the sheet-like recording media is large and curl generally tends to be large.

Figure 47:
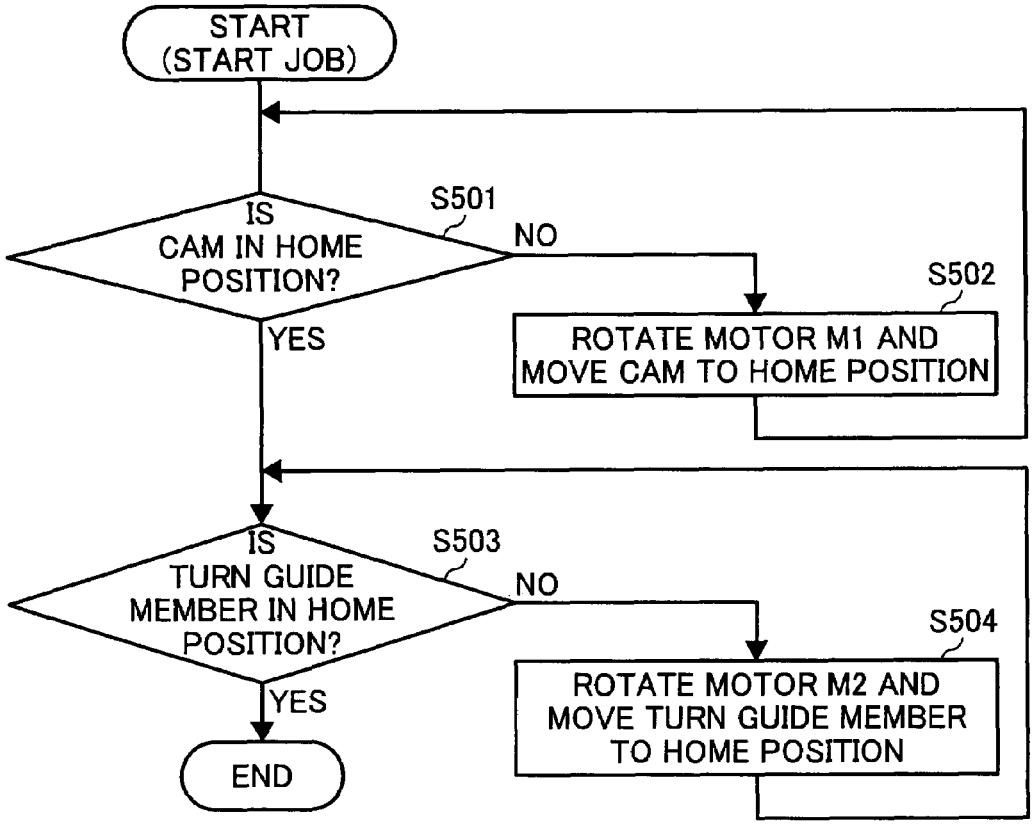
FIG. 47 is a flowchart of a processing procedure of an initial operation of the sheet processing apparatus according to the fourth embodiment.

FIG. 47 is a flowchart of a control procedure during initial processing in the conveying mechanism 600 and the turn section executed by the control unit 350. For this control procedure, the CPU 360 of the control unit 350 executes a program stored in the RAM (not-shown) using the RAM (not-shown) as a work area.

In the flowchart in FIG. 47, first, the CPU 360 checks whether the cam 605 of the conveying mechanism 600 is located in the home position (step S501). When the cam 605 is not located in the home position, the CPU 360 drives the motor M1 to move the cam 605 to the home position (step S502). When the cam 605 is located in the home position, the CPU 360 checks whether the turn guide member 609 is located in the home position (step S503). When the turn guide member 609 is not located in the home position, the CPU 360 drives the motor M2 to locate the turn guide member 609 in the home position (step S504). The CPU 360 locates the cam 605 and the turn guide member 609 in this way and finishes the initial processing.

Figure 48A:
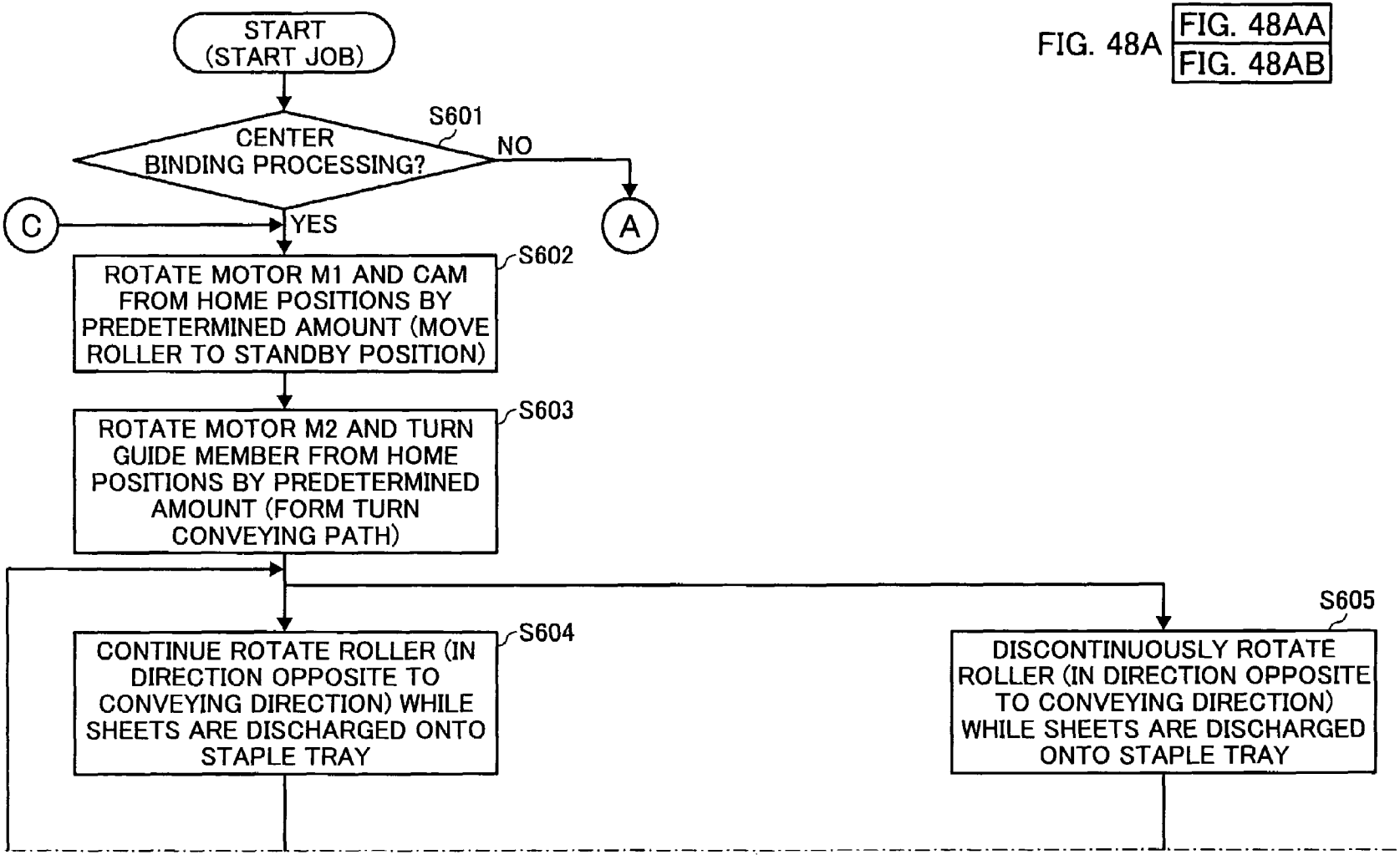
FIG. 48A is a flowchart of a processing procedure in a former half during center binding processing of an overall control procedure in the sheet processing apparatus according to the fourth embodiment.
Figure 48A:
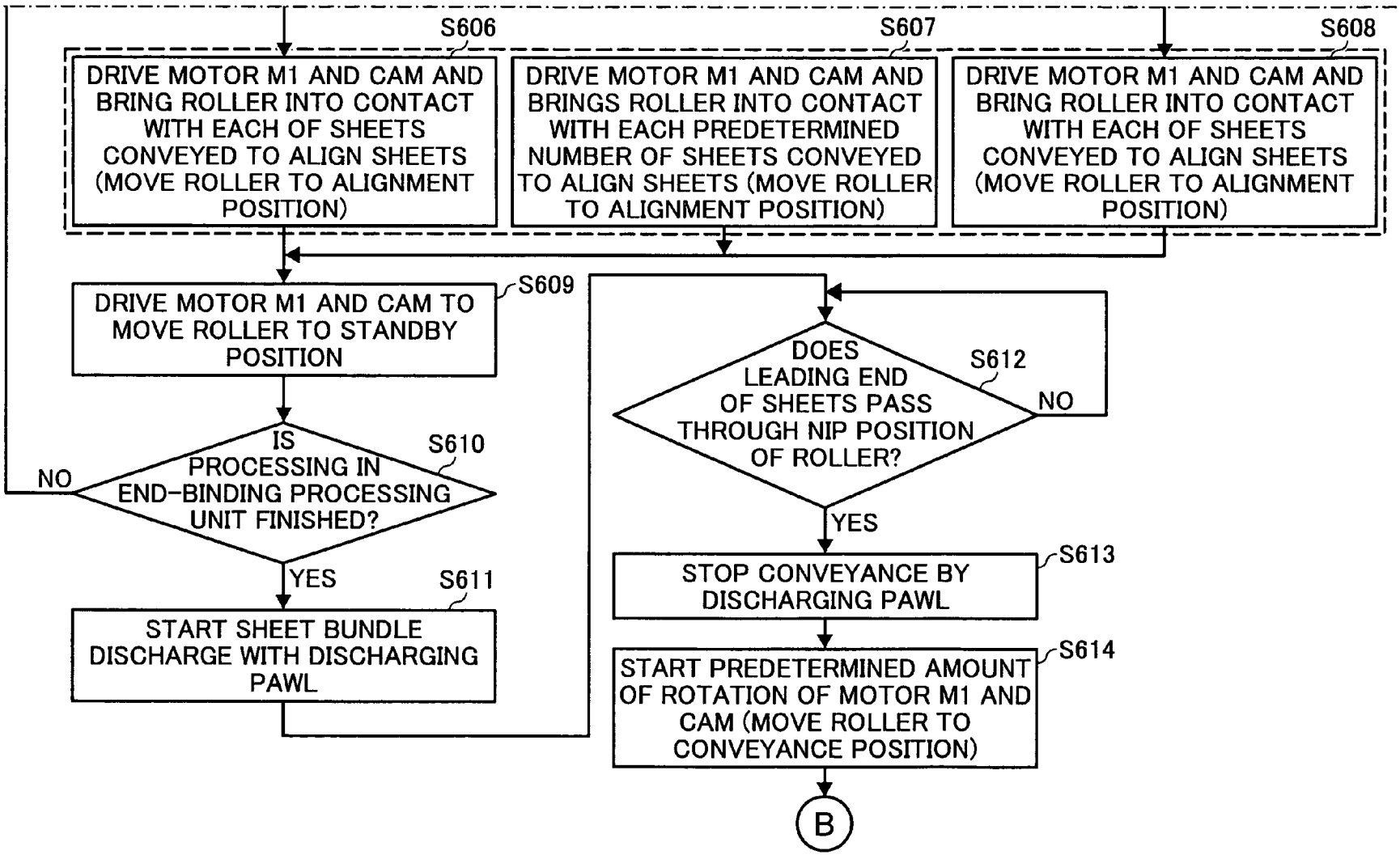
Figure 48B:
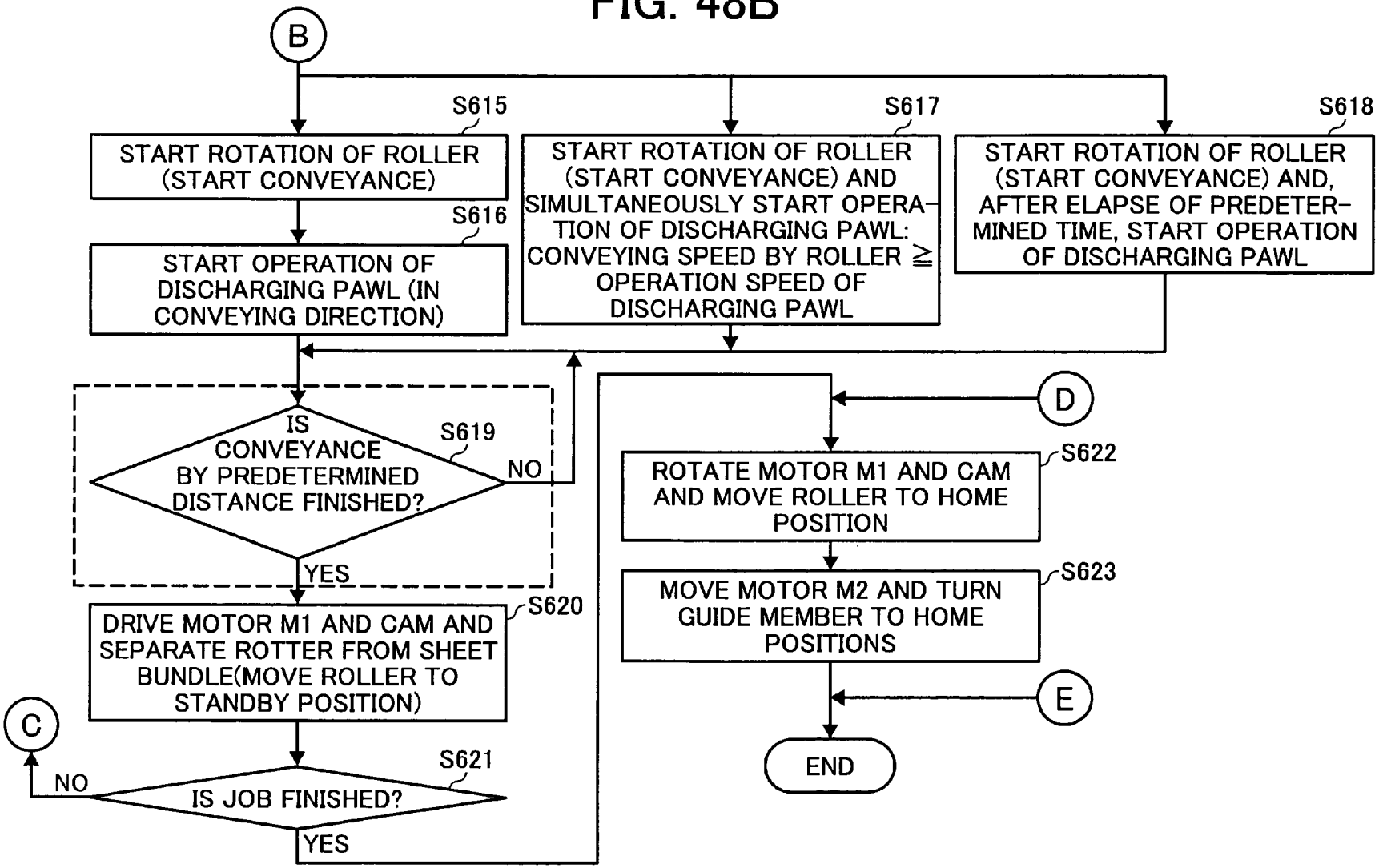
FIG. 48B is a flowchart of a processing procedure in a latter half during the center binding processing of the overall control procedure of the sheet processing apparatus according to the fourth embodiment.
Figure 48C:
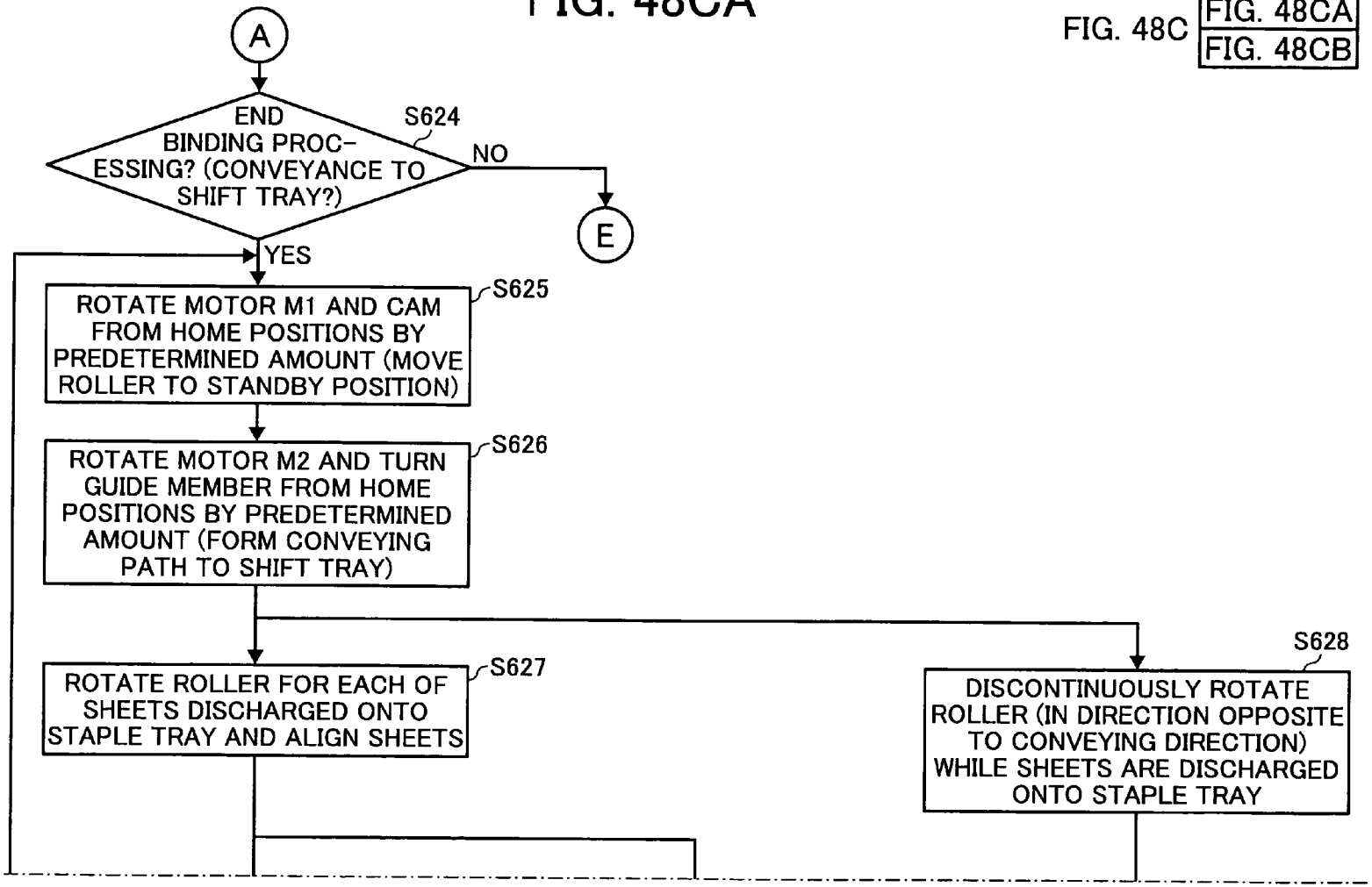
FIG. 48C is a flowchart of a processing procedure at the time when the center binding processing of the overall control procedure is not performed in the sheet processing apparatus according to the fourth embodiment.
Figure 48C:
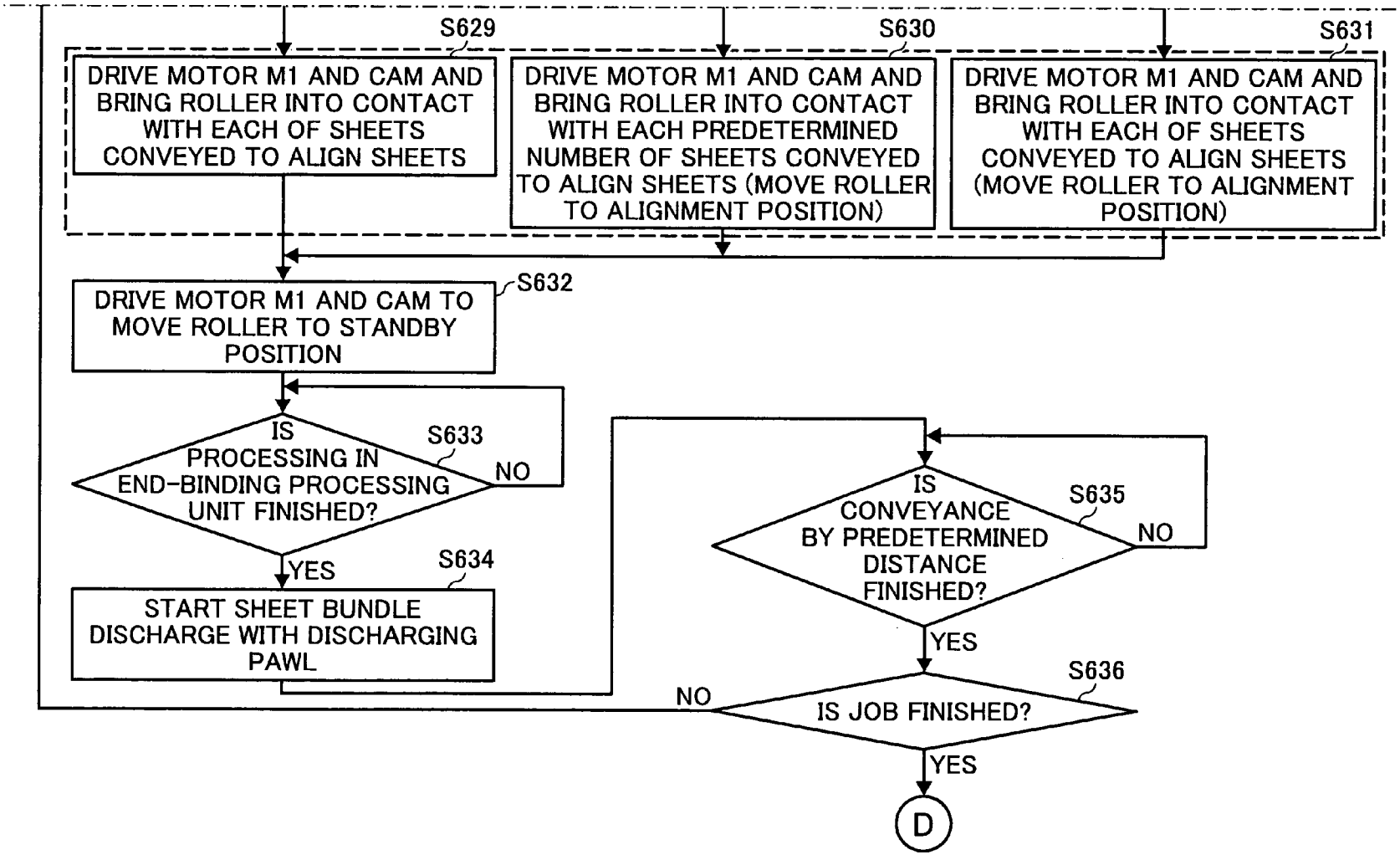

FIGS. 48A to 48C are flowcharts of an overall control procedure of the sheet processing apparatus PD in this embodiment. Although the flowcharts are divided into three figures, one processing procedure is shown in the figures.

In FIG. 48A, when a job is started, first, the CPU 360 checks whether center binding processing is performed (step S601). When the center binding processing is performed (YES at step S601), the CPU 360 rotates the motor M1 and the cam 605 from the home positions by the predetermined amount to move the roller 601 to the standby position (step S602) and rotates the motor M2 and the turn guide member 609 from the home positions by the predetermined amount to form a turn conveying path (step S603). While the sheet-like recording media are discharged to the end-binding processing tray F, the CPU 360 continuously rotates the roller 601 in the direction opposite to the conveying direction (step S604) or discontinuously rotates the roller 601 in the direction opposite to the conveying direction (step S605) to drive the motor M1 and the cam 605 and bring the roller 601 into contact with each of the sheet-like recording media conveyed to align the sheet-like recording media (steps S606 and S608). Alternatively, after the processing at step S604, at step S607, the CPU 360 drives the motor M1 and the cam 605 to bring the roller 601 into contact with each predetermined number of the sheet-like recording media conveyed and align the sheet-like recording media.

After the processing at steps S606, S607, and S608, the CPU 360 drives the motor M1 and the cam 605 to move the roller 601 to the standby position (step S609). When the processing in the end-binding processing tray F is finished (YES at step S610), the CPU 360 starts discharge of the sheet stack with the discharging pawl 52*a* (step S611). On the other hand, when the processing is not finished (NO at step S610), the CPU 360 returns to step S604 or step S605 and repeats the operation corresponding to conveyance of the next sheet-like recording media.

After the discharge of the sheet stack by the discharging pawl 52*a* is started at step S611, the CPU 360 checks whether the leading end of the sheet-like recording media has passed through the nip position of the roller 601 (step S612). When the leading end of the sheet-like recording media passes the nip position, the CPU 360 stops the conveyance by the discharging pawl 52*a* (step S613) and rotates the motor M1 and the cam 605 by the predetermined amount and moves the roller 601 to the conveying direction (step S614). Subsequently, the CPU 360 rotates the roller 601 to start conveyance of the sheet stack (step S615) and starts operation of the discharging pawl 52*a* in the conveying direction (step S616). Alternatively, subsequent to the step S614, the CPU 360 starts operation of the discharging pawl 52*a* simultaneously with the start of rotation of the roller 601 (step S617). Alternatively, the CPU 360 starts operation of the discharging pawl 52*a* when a predetermined time has elapsed after the start of rotation of the roller 601 (step S618). At step S617, the CPU 360 starts operation of the discharging pawl 52*a* at an operation speed equal to or higher than conveying speed of the roller 601.

When the processing of any one steps S616, S617, and S618 is performed and the sheet-like recording media are conveyed a predetermined distance (step S619), the CPU 360 drives the motor M1 and the cam 605 to move the roller 601 to the standby position and separate the roller 601 from the sheet stack P (step S620). The CPU 360 executes the series of operations until the job is finished. When the job is finished (step S621), the CPU 360 rotates the motor M1 and the cam 605 and moves the roller 601 to the home position (step S622), move the motor M2 and the turn guide member 609 to the home positions (step S623), and finish the processing.

On the other hand, when the job is not the center binging processing at step S601 (NO at step S601), the CPU 360 checks whether the job is end binding processing (step S624). When the job is the end binding processing (YES at step S624), the CPU 360 rotates the motor M1 and the cam 605 from the home positions by the predetermined amount to move the roller 601 to the standby position (step S625). Subsequently, the CPU 360 rotates the motor M2 and the turn guide member 609 from the home positions by the predetermined amount to form a conveying path to the shift tray 202 (step S626). As described above, this conveying path is a path formed between the outer surface of the turn guide member 609 and the guide plate 611.

When the guide path to the shift tray 202 is formed at step S626, the CPU 360 rotates the roller 601 in the opposite direction for each of the sheet-like recording media discharged onto the end-binding processing tray F and starts an aligning operation (step S627). The CPU 360 drives the motor M1 and the cam 605 to bring the roller 601 into contact with each of the sheet-like recording media conveyed (step S629). Alternatively, the CPU 360 drives the motor M1 and the cam 605 to bring the roller 601 into contact with each predetermined number of the sheet-like recording media conveyed and align the sheet-like recording media (step S630). After the processing at step S626, while the sheet-like recording media are discharged onto the end-binding processing tray F, the CPU 360 causes the roller 601 to discontinuously continue the rotation in the direction opposite to the conveying direction (step S628). The CPU 360 drives the motor M1 and the cam 605 to bring the roller 601 into contact with each of the sheet-like recording media conveyed and align the sheet-like recording media (step S631).

After the processing at any one of steps S629, S630, and S631, the CPU 360 drives the motor M1 and the cam 605 to move the roller 601 to the standby position (step S632). When the processing in the end-binding processing tray F is finished (step S633), the CPU 360 starts discharge of the sheet stack P with the discharging pawl 52*a* (step S634). At a point when the sheet stack P is conveyed a predetermined distance (step S635), when the job is finished (YES at step S636), the CPU 360 rotates the motor M1 and the cam 605 to move the roller 601 to the home position (step S622). The CPU 360 further moves the motor M2 and the turn guide member 609 to the home positions (step S623) and finishes the processing. When the job is not finished (NO at step S636), the CPU 360 returns to step S625 and repeats the processing at step S625 and the subsequent steps until the job is finished.

On the other hand, when the job is not the end-binding processing at step S624, the CPU 360 directly finishes the processing of the flowchart.

As described above, according to the fourth embodiment, in the conveying mechanism of the sheet processing apparatus, it is possible to adjust a rotation fulcrum of the conveying roller and the movable conveyance support member is provided at the tip of the conveying roller. Consequently, a sheet processing mechanism that enables more highly accurate sheet alignment is provided.

As set forth hereinabove, according to an embodiment of the present invention, the sheet stack is conveyed by the conveying unit that applies a conveying force to the sheet stack on the turn conveying path and on the upstream side. Thus, it is possible to convey the sheet stack while maintaining an aligned state of the sheet stack.

The conveying unit applies the conveying force to the outer side of the sheet stack conveyed on the turn conveying path. Thus, when the sheet stack is conveyed on a bent conveying path connecting the binding processing unit to the center binding processing unit, the problems in that the conveying force is less easily transmitted to sheets on the outer side of the sheet stack and that a conveyance difference tends to occur in the sheets on the outer side compared with sheets on the inner side are solved. It is possible to convey the sheet stack while maintaining the aligned state of the sheet stack.

The conveying unit is movable to at least two positions, i.e., a position where the conveying unit applies the conveying force to the sheet stack and a position where the conveying unit does not apply the conveying force to the sheet stack. Thus, the conveying unit does not hinder alignment of the sheet stack. When an error such as a sheet jam is detected, since it is possible to release the conveying unit to the position where the conveying unit does not apply the conveying force to the sheet stack, the user can easily perform jam processing.

The driving shaft that applies a driving force to the conveying unit and the rotation fulcrum during movement of the conveying unit are coaxial. Thus, the structure of the sheet processing apparatus is simplified and deterioration in assemblability and an increase in cost of the product are not caused. Further, it is not necessary to move the sheets in the direction opposite to the conveying direction to strike the trailing end of the sheets against the end fence and align the sheets.

A position to which the conveying unit can be retracted is set in a position where, even when the thickness and the number of sheets of a sheet stack that can be processed in the end-binding processing unit are the maximum, the conveying unit does not hinder conveyance of the sheet stack. Thus, the leading end of the sheet stack and the conveying unit do not come into contact with each other and the leading end of the sheet stack is not damaged by scratches, fold, and the like.

A position to which the conveying mean can be retracted is set, according to information such as the number and a type of sheets of a sheet stack processed in the end-binding processing unit, in a position where the conveying unit does not hinder conveyance of the sheet stack. Thus, regardless of whether the number of aligned sheets is small or large, it is possible to set an operation time the same and productivity does not fall. Further, it is possible to prevent conveyance troubles such as buckling of sheets from occurring.

The conveyance support member forming the turn conveying path is movable and a sheet stack is guided by the conveyance support member even when the sheet stack is conveyed from the end-binding processing unit to the stacking means. Thus, the structure of the sheet processing apparatus is simplified and deterioration in assemblability and an increase in cost of the product are not caused. Further, although a friction state among sheets is different depending on the number of sheets, a quality of the sheets, a printing state, and the like, the conveying mechanism can automatically adjust a conveying force for conveying the sheet stack according to the number of sheets, the quality of the sheets, the printing state, and the like. Consequently, it is possible to improve a conveyance quality.

When the conveying unit applies a conveying force to a sheet stack, a stronger conveying force is applied as the thickness of the sheet stack is larger. Thus, it is possible to increase a conveying force for delivering the sheet stack as the number of sheets is larger. When the sheet stack is sent from the binding processing unit to the bent conveying path connected to the center-binding processing unit and when the sheet stack is delivered from the end-binding processing unit on to the stacking means, it is possible to secure a sufficient conveying force.

When the sheet stack is delivered from the binding processing unit to the bent conveying path connected to the center-binding processing unit, if conveying speed for the sheet stack is lower than conveying speed of the discharging pawl that pushes up the trailing end of the sheets, the sheet stack may be buckled or the trailing end of the sheets may be damaged by scratches, fold, and the like. However, since conveying speed of the conveying mechanism is set higher than the conveying speed of the discharging pawl, it is possible to prevent such damages from occurring.

A shape of the conveyance support member immediately before the roller of the conveying unit that applies a conveying force to a sheet stack is formed to make an angle of contact between the roller and a leading end of the sheet stack gentle. Thus, even when large curl occurs at a leading end of sheets, since it is possible to reduce a contact angle between a portion of the curl and the roller of the conveying unit that applies a conveying force, it is unlikely that the leading end of the sheets is damaged by scratches, fold, and the like.

When a sheet stack is conveyed from the binding processing unit onto the stacking means, if the sheet stack is discharged by only the discharging pawl that pushes up a trailing end of sheets, the sheet stack may be buckled and cannot be discharged. However, since the conveying mechanism is simultaneously used, it is possible to prevent buckling and a jam from occurring. When an error such as a jam is detected, a user can easily remove a sheet.

When a sheet stack is formed by sheets having small surface friction or sheets with surface friction reduced by images, if a conveying force is applied to only the outer side of the sheets, the conveying force may not be transmitted to the inner side and only the sheets on the outer side may be conveyed. However, by applying the conveying force from the inner side as well, it is possible to collectively convey the sheets without causing slip among the sheets.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a first processing unit that applies first processing to a recording medium;

a second processing unit that applies second processing to the recording medium;

a roller that has a conveying path to convey the recording medium from the first processing unit to the second processing unit along an outer circumference;

a guide member that guides the recording medium to the conveying path to convey the recording medium to the second processing unit;

a conveying unit that applies a conveying force to a stack of recording media at an upstream of the guide member in a recording-medium conveying direction while holding the stack; and a driving unit that moves the conveying unit to at least one of a driving position where a driving force is applied to the stack and a retracted position where the driving force is not applied to the stack.

2. The sheet processing apparatus according to claim 1, wherein the conveying unit applies a driving force to outside the stack.

3. The sheet processing apparatus according to claim 1, wherein a driving shaft that applies a driving force to the conveying unit and a driving shaft of the driving unit are coaxial.

4. The sheet processing apparatus according to claim 1, wherein the retracted position is arranged not to affect conveyance of the stack in the first processing unit regardless of thickness of the stack to be processed.

5. The sheet processing apparatus according to claim 1, wherein the retracted position is arranged not to affect the first processing regardless of thickness of the stack to be processed.

6. The sheet processing apparatus according to claim 1, further comprising:

a supporting unit that swingably supports the guide member; and a switching unit that swings the guide member with respect to the supporting unit, and switches the conveying path to convey the recording medium to the second processing unit and a conveying path to convey the recording medium from outside, the guide member to a discharge side where the recording medium is discharged.

7. An image forming apparatus comprising the sheet processing apparatus according to claim 1.

8. A sheet processing apparatus comprising:

a processing unit that applies predetermined processing to a recording medium or a stack of recording media;

a conveying unit that is located in the processing unit and conveys the recording medium or the stack, wherein the conveying unit stops or applies a conveying force in a conveying direction when a leading end of the recording medium or the stack passes through the conveying unit first time; and a separating unit that automatically or manually separates the conveying unit from the recording medium or the stack when an error occurs in conveyance of the recording medium or the stack.

9. The sheet processing apparatus according to claim 8, wherein the conveying unit includes a rotating member, and the conveying force is applied by a rotational force of the rotating member.

10. A sheet processing apparatus comprising:

a holding unit that temporarily holds a recording medium or a stack of recording media;

a processing unit that applies predetermined processing to the recording medium or the stack; and a conveying unit that is located in the holding unit and conveys the recording medium or the stack, wherein the conveying unit includes a swing fulcrum that defines a position of the recording medium being aligned and a position of the stack being conveyed, and the swing fulcrum is arranged such that displacement of each recording medium is minimum when the conveying unit comes into contact with the stack during conveyance of the stack.

11. The sheet processing apparatus according to claim 10, wherein the conveying unit includes a roller that applies a conveying force to the recording medium or the stack;

a driving unit that drives the roller to swing with respect to the swing fulcrum; and a supporting member that presses a leading end of the stack.

12. The sheet processing apparatus according to claim 11, wherein the roller and the stack come into contact with each other during conveyance of the stack after the leading end of the stack passes through a nip of the roller.

13. The sheet processing apparatus according to claim 11, further comprising a preventing unit that prevents the supporting member from coming into contact with the stack.

14. The sheet processing apparatus according to claim 10, further comprising a discharging unit that discharges the stack from the holding unit while the conveying unit is conveying the stack.

15. The sheet processing apparatus according to claim 14, wherein the discharging unit starts discharging operation when or after the conveying unit starts conveying the stack, discharges the stack at a speed equal to or less than conveying speed of the conveying unit, and operates in a position at a predetermined distance from a trailing end of the stack during conveyance of the stack.

16. The sheet processing apparatus according to claim 10, wherein the conveying unit is arranged not to interfere with other members that operate during alignment and conveyance of the stack.

17. The sheet processing apparatus according to claim 10, wherein the conveying unit releases a conveying force applied to the stack when the stack reaches other conveying units downstream from the conveying unit after a predetermined amount of recording media are conveyed.

18. An image forming apparatus comprising the sheet processing apparatus according to claim 10.

* * * * *